US007789317B2

(12) United States Patent
Votaw et al.

(10) Patent No.: US 7,789,317 B2
(45) **Date of Patent: *Sep. 7, 2010**

(54) SYSTEM AND METHOD FOR HEAT PUMP ORIENTED ZONE CONTROL

(75) Inventors: Mark Votaw, North Canton, OH (US); Joseph Ramunni, Wadsworth, OH (US); Thomas Delp, Aurora, OH (US); Dennis Laughlin, Chardon, OH (US); Al Zelczer, University Heights, OH (US); Leonard Roth, University Heights, OH (US); Vladimir Sipershteyn, Independence, OH (US)

(73) Assignee: Arzel Zoning Technology, Inc., Cleveland, OH (US)

( * ) Notice: Subject to any disclaimer, the term of this patent is extended or adjusted under 35 U.S.C. 154(b) by 1014 days.

This patent is subject to a terminal disclaimer.

(21) Appl. No.: 11/469,971

(22) Filed: Sep. 5, 2006

(65) Prior Publication Data

US 2007/0063059 A1 Mar. 22, 2007

Related U.S. Application Data

(63) Continuation-in-part of application No. 11/226,165, filed on Sep. 14, 2005.

(51) Int. Cl.
*F24D 19/10* (2006.01)
*F24F 11/00* (2006.01)

(52) U.S. Cl. ..... 236/1 B; 236/49.3; 165/217

(58) Field of Classification Search ..... 236/1 B, 236/49.3; 165/213, 217

See application file for complete search history.

(56) References Cited

U.S. PATENT DOCUMENTS

| | | | | |
|---|---|---|---|---|
| 2,254,185 | A | | 8/1941 | Newton |
| 4,261,509 | A | | 4/1981 | Anders et al. |
| 4,265,299 | A | | 5/1981 | Harnish |
| 4,324,288 | A | | 4/1982 | Karns |
| 4,501,125 | A | | 2/1985 | Han |
| 4,530,395 | A | | 7/1985 | Parker et al. |
| 5,245,835 | A | | 9/1993 | Cohen et al. |
| 5,701,750 | A | | 12/1997 | Ray |
| 5,829,674 | A | | 11/1998 | Vanostrand et al. |
| 5,979,167 | A | * | 11/1999 | Kochavi et al. ..... 62/186 |

(Continued)

OTHER PUBLICATIONS

International Search Report for PCT application no. PCT/US07/77500 mailed Apr. 7, 2008.

(Continued)

*Primary Examiner*—Marc E Norman
(74) *Attorney, Agent, or Firm*—Hahn Loeser & Parks LLP

(57) ABSTRACT

A system and method to control environmental parameters of pre-defined zones within an environment using an electronic controller are disclosed. The system includes a non-proprietary electronic controller which enables a weighting value to be assigned to each zone within the environment. The electronic controller also detects any zone service calls from sensor devices associated with each of the zones and determines a cumulative weighting value in response to the detected zone service calls. The electronic controller selects an equipment staging combination from at least two possible equipment staging combinations in response to thermal capacity, and an air handler stage is selected in response to at least the cumulative zone weighting value.

81 Claims, 45 Drawing Sheets

U.S. PATENT DOCUMENTS

| | | | |
|---|---|---|---|
| 6,786,473 | B1 | 9/2004 | Alles |
| 6,865,449 | B2 | 3/2005 | Dudley |
| 6,997,390 | B2 | 2/2006 | Alles |
| 7,062,830 | B2 | 6/2006 | Alles |
| 2005/0064812 | A1 | 3/2005 | Darling |
| 2005/0116055 | A1 | 6/2005 | Alles |
| 2005/0156050 | A1 | 7/2005 | Shah et al. |

OTHER PUBLICATIONS

Written Opinion for PCT application no. PCT/US07/77500 mailed Apr. 7, 2008.

* cited by examiner

FIG. 6

600

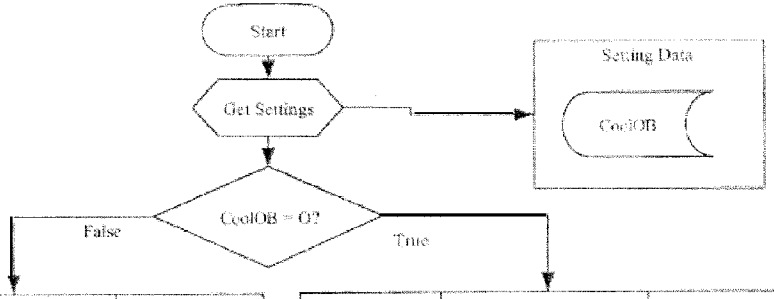

| Thermostat Inputs | Translations | HVAC Output |
|---|---|---|
| O | Cooling Mode | B |
| G | Fan Only | G |
| GO | Fan Only in Cooling Mode | G,B |
| Y1,G | Heating | Y1,G |
| Y1,GO | Cooling | Y1,G,B |
| Y1,Y2,G | 2 stage Heating | Y1,Y2,G |
| Y1,Y2,G,O | 2 Stage Cooling | Y1,Y2,G,B |
| W1,Y1,G | 1 Stg Hp heat w/ backup electric heat | W,Y1,G |
| W1,Y1,Y2,G | 2 stage hp heat w/ backup resistance heat | W1,Y1,Y2,G |
| W1,W2Y1,Y2,G | 2 stage hp heat w/ 2 stg backup resistance heat | W1,W2,Y1,Y2,G |
| W1 | FFuel heat Call | W1 |
| W1,G | FFuel hot call w/ Fan | w1,G |
| W1,W2 | 2 stage FFuel Heat Call | W1,W2 |
| W1,W2,G | 2 stage FFuel Heat Call w/ Fan | W1,W2,G |
| E | Emergency Heat Flag | E |
| D | Dehumidification | D |
| H | Humidification | H |

| Thermostat Inputs | Translations | HVAC Output |
|---|---|---|
| O | Cooling Mode | N/A |
| G | Fan Only | G |
| GO | Fan Only in Cooling Mode | G |
| Y1,G | Heating | Y1,G |
| Y1,G,O | Cooling | Y1,G,O |
| Y1,Y2,G | 2 stage Heating | Y1,Y2,G |
| Y1,Y2,G,O | 2 Stage Cooling | Y1,Y2,G,O |
| W1,Y1,G | 1 Stg Hp heat w/ backup electric heat | W,Y1,G |
| W1,Y1,Y2,C | 2 stage hp heat w/ backup resistance heat | W1,Y1,Y2,G |
| W1,W2Y1,Y2,G | 2 stage hp heat w/ 2 stg backup resistance heat | W1,W2,Y1,Y2,G |
| W1 | FFuel heat Call | W1 |
| W1,G | FFuel hot call w/ Fan | w1,G |
| W1,W2 | 2 stage FFuel Heat Call | W1,W2 |
| W1,W2,G | 2 stage FFuel Heat Call w/ Fan | W1,W2,G |
| E | Emergency Heat Flag | E |
| D | Dehumidification | D |
| H | Humidification | H |

| Variable | Description | Source |
|---|---|---|
| CoolOB | Sets the reversing Valve Output for the type of HVAC Equipment being used | Set Wiz |

FIG. 7

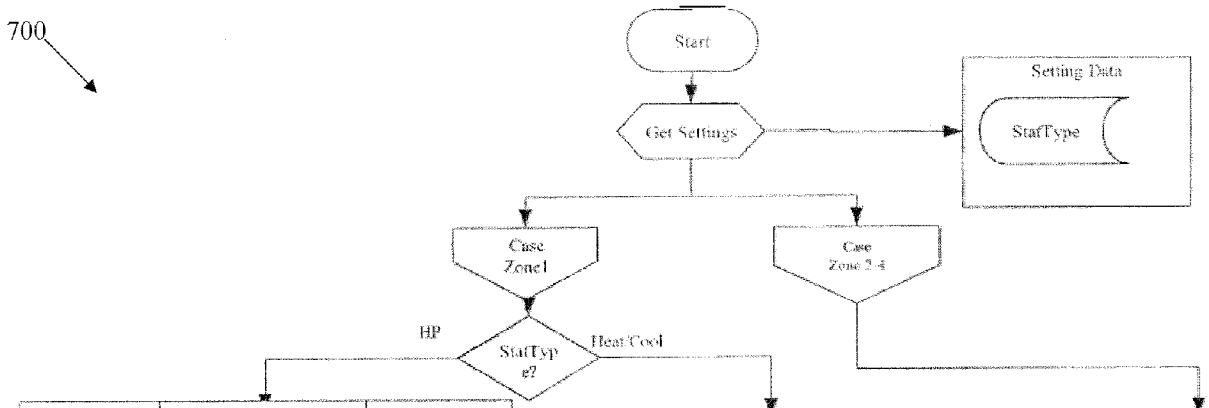

| Thermostat Inputs | Translations | Input to Computer |
|---|---|---|
| O | Cooling Mode | N/A |
| G | Fan Only | G |
| GO | Fan Only in Cooling Mode | G |
| Y1,G | Heating | Y1,G |
| Y1,G,O | Cooling | Y1,G,O |
| Y1,Y2,G | 2 stage Heating | Y1,Y2,G |
| Y1,Y2,G,O | 2 Stage Cooling | Y1,Y2,G,O |
| W1,Y1,G | 1 Stg Hp heat w/ backup electric heat | W,Y1,G |
| W1,Y1,Y2,G | 2 stage hp heat w/ backup resistance heat | W1,Y1,Y2,G |
| W1,W2Y1,Y2,G | 2 stage hp heat w/ 2 stg backup resistance heat | W1,W2,Y1,Y2,G |
| W1 | FFuel heat Call | W1 |
| W1,G | FFuel het call w/ Fan | w1,G |
| W1,W2 | 2 stage FFuel Heat Call | W1,W2 |
| W1,W2,G | 2 stage FFuel Heat Call w/ Fan | W1,W2,G |
| E | Emergency Heat Flag | E |
| D | Dehumidification | D |
| H | Humidification | H |

| Thermostat Inputs | Translations | Input to Computer |
|---|---|---|
| G | Fan | G |
| Y1G | Cooling | Y1,G,O |
| Y1,Y2,G | 2 Stage Cool | Y1,Y2,G,O |
| W1 | Heating | Y1,G |
| W1,G | heating w/fan | Y1,G |
| W1,W2 | 2 stage heating | Y1,Y2,G |
| W1,W2,G | 2 Stage Heating w/ Fan | Y1,Y2,G |
| D | Dehumidify | D |
| H | Humidify | H |

| Thermostat Inputs | Translations | Input to Computer |
|---|---|---|
| G | Fan | g |
| YG | Cooling | Y1,G,O |
| W | Heating | Y1,G |
| WG | Heating w/Fan | Y1,G |

| Variable | Description | Source |
|---|---|---|
| StatType | Determines what signals program looks for from the Zone1 Thermostat | Set Wiz |

FIG. 8a

| ZONE1 STAT TYPE? |
|---|
| HEAT PUMP |
| HEAT / COOL |

| ZONE1 RELATIVE WEIGHT | | |
|---|---|---|
| 10% | 40% | 70% |
| 20% | 50% | 80% |
| 30% | 60% | 90% |

| ZONE2 RELATIVE WEIGHT | | |
|---|---|---|
| 10% | 40% | 70% |
| 20% | 50% | 80% |
| 30% | 60% | 90% |

| ZONE3 RELATIVE WEIGHT | | |
|---|---|---|
| 10% | 40% | 70% |
| 20% | 50% | 80% |
| 30% | 60% | 90% |

| ZONE4 RELATIVE WEIGHT | | |
|---|---|---|
| 10% | 40% | 70% |
| 20% | 50% | 80% |
| 30% | 60% | 90% |

| STAGING THRESHOLD |
|---|
| 60% |

Increment/decrement by 10% intervals

| FARENHIEGHT OR |
|---|
| CELSIUS |
| F |
| C |

| MIN HEAT TEMP |
|---|
| 90 DEGREES |

Increment/decrement by 1 degree increments

| MAX COOLING TEMP |
|---|
| 50 DEGREES |

Increment/decrement by 1 degree increments

| BALLANCE POINT |
|---|
| 25 DEGREES |

Increment/decrement by 1 degree increments

| OUTDOOR RESET TEMP |
|---|
| 30 DEGREES |

Increment/decrement by 1 degree increments

| LEAVING AIR TEMP |
|---|
| HIGH LIMIT |
| 110 DEGREES |

Increment/decrement by 1 degree increments

| LEAVING AIR TEMP |
|---|
| LOW LIMIT |
| 42 DEGREES |

Increment/decrement by 1 degree increments

| LEAVING AIR TEMP |
|---|
| HIGH LIMIT-BACKUP |
| 140 DEGREES |

Increment/decrement by 1 degree increments

FIG. 8b

| | | | | | | | | | | | | | | | | | | | |
|---|---|---|---|---|---|---|---|---|---|---|---|---|---|---|---|---|---|---|---|
| B | A | C | K | U | P | | H | E | A | T | | S | O | U | R | C | E | | |
| | E | L | E | C | T | R | I | C | | | | | | | | | | | |
| | G | A | S | | | | | | | | | | | | | | | | |
| | | | | | | | | | | | | | | | | | | | |

| | | | | | | | | | | | | | | | | | | | |
|---|---|---|---|---|---|---|---|---|---|---|---|---|---|---|---|---|---|---|---|
| F | U | R | N | A | C | E | | C | T | R | L | | F | A | N | ? | | | |
| | | Y | E | S | | | | | | | | | | | | | | | |
| | | N | O | | | | | | | | | | | | | | | | |
| | | | | | | | | | | | | | | | | | | | |

| | | | | | | | | | | | | | | | | | | | |
|---|---|---|---|---|---|---|---|---|---|---|---|---|---|---|---|---|---|---|---|
| D | E | H | U | M | I | D | I | F | I | C | A | T | I | O | N | | | | |
| | | S | I | G | N | A | L | | | | | | | | | | | | |
| | | | | 2 | 4 | V | A | C | | | | | | | | | | | |
| | | | | | 0 | V | A | C | | | | | | | | | | | |

| | | | | | | | | | | | | | | | | | | | |
|---|---|---|---|---|---|---|---|---|---|---|---|---|---|---|---|---|---|---|---|
| E | N | D | - | O | F | - | C | Y | L | E | | T | I | M | E | | | | |
| | | 9 | 0 | | S | E | C | O | N | D | S | | | | | | | | |
| | | | | | | | | | | | | | | | | | | | |
| | | | | | | | | | | | | | | | | | | | |

Increment or decrement in 10-second intervals

| | | | | | | | | | | | | | | | | | | | |
|---|---|---|---|---|---|---|---|---|---|---|---|---|---|---|---|---|---|---|---|
| D | E | H | U | M | I | D | I | F | I | C | A | T | I | O | N | | | | |
| C | Y | C | L | E | | T | I | M | E | | | | | | | | | | |
| | | | | 1 | 0 | M | I | N | U | T | E | | | | | | | | |
| | | | | | | | | | | | | | | | | | | | |

Increment or decrement in 5-MINUTE intervals

910

1030

1040

1050

| Variable Name | Description | Source |
|---|---|---|
| HpEccDelay | Time to hold dampers in position after HP call | SetWiz |
| FfEccDelay | Time to hold dampers in position after FF call | Set Wiz |
| EndCycle | #of Mins delay end of cycle time | Set Wiz |

| Variable | Description | Source |
|---|---|---|
| Priority | Sets the Priority Service (Heating,Cooling, or First Come) | Set Wiz |
| | | |
| | | |
| | | |
| | | |
| | | |
| | | |

| Variable Name | Description | Source |
|---|---|---|
| HpEccDelay | Time to hold dampers in position after HP call | SetWiz |
| FFEccDelay | Time to hold dampers in position after FF call | Set Wiz |
| EndCycle | #of Mins delay end of cycle time | Set Wiz |

| Variable | Description | Source |
|---|---|---|
| HeatLAT | Low Leaving Air Temperature Limit | Set Wiz |
| CoolOB | Defines Heating or cooling Mode | Setwiz |
| BkypType | Defines Backup Ht Type | SetWiz |
| FFHTLAT | High LAT Limit for Fossil Fuel Furnace | SetWiz |
| | | |

1800

| Variable | Description | Source |
|---|---|---|
| CoolLat | Low Limit for Leaving Air Control | Set Wiz |
| | | |
| | | |

| Variable | Description | Source |
|---|---|---|
| CoolLAT | Low Leaving Air Temperature Limit | Set Wiz |
| CoolOB | Defines Condition or O/B for a cooling call | Set Wiz |

FIG. 23c

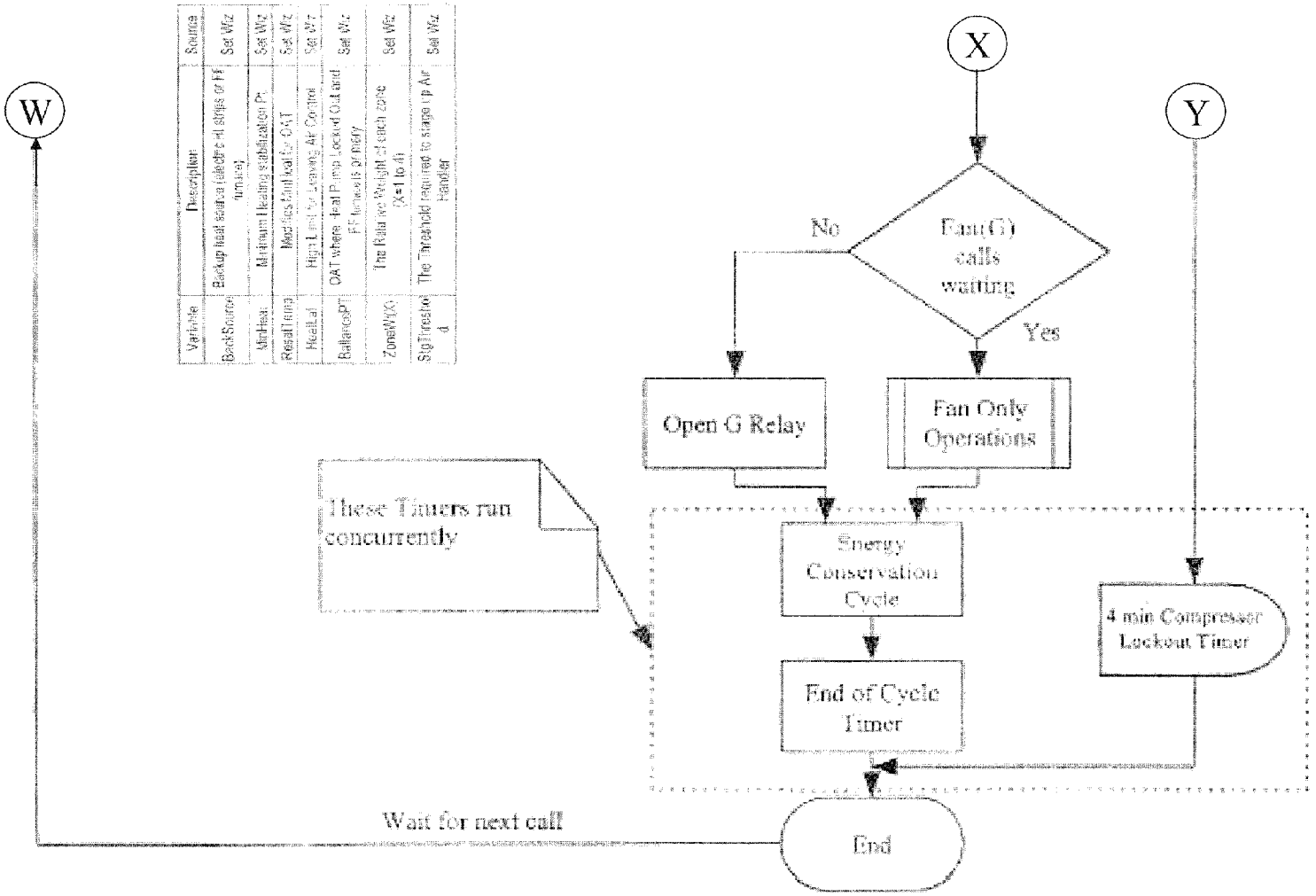

| Variable | Description | Source |
|---|---|---|
| BackSource | Backup heat source (electric HI strips or HP unit) | Sel Wiz |
| MinHeat | Minimum Heating stabilization Pt | Sel Wiz |
| ResetHrs | Max hrs Until Heat Cy OAT | Sel Wiz |
| HeatLvl | High Limit for Leaving Air Control | Sel Wiz |
| BalancePT | OAT where Heat Pump Loaded Out and FF Increase is primary | Sel Wiz |
| ZoneWt(X) | The Rain Wt Weight of each zone (X=1 to 4) | Sel Wiz |
| SigTresho d | The Threshold required to stage up Air Handler | Sel Wiz |

SYSTEM AND METHOD FOR HEAT PUMP ORIENTED ZONE CONTROL

CROSS-REFERENCE TO RELATED APPLICATIONS/INCORPORATION BY REFERENCE

This U.S. patent application is a continuation-in-part (CIP) of pending U.S. patent application Ser. No. 11/226,165, filed on Sep. 14, 2005.

TECHNICAL FIELD

Certain embodiments of the present invention relate to zoned control of an environment. More particularly, certain embodiments of the present invention relate to a system and method to control environmental parameters of pre-defined zones within an environment using an electronic controller and weighted zones.

BACKGROUND OF THE INVENTION

The cooling and heating of commercial buildings and residential homes is typically accomplished via forced air and forced hot or cooled water distribution systems. A furnace, heat pump, other fossil fuel furnace, and/or air conditioner are typically used to supply heated air or cooled air to areas of the building or home via ducts. Such distribution systems are often controlled by a single thermostat which is centrally located within the building or home. A person sets the thermostat to a particular temperature setting. When the temperature measured by the thermostat deviates a pre-defined amount from the set temperature, a furnace, heat pump, other fossil fuel furnace, or air conditioner is turned on to provide heated or cooled air to the various regions of the building or home via the duct work or water lines.

Even though the desired temperature may be achieved at the location of the thermostat, the resultant temperatures in the various other regions of the building or home may still deviate quite a bit from this desired temperature. Therefore, a single centrally located thermostat likely will not provide adequate temperature control for individual rooms and areas. In an attempt to address this problem, duct work and valves throughout the building or home are fitted with manually adjustable dampers which help to control the flow of air to the various regions. The dampers and valves are typically each adjusted to a single position and left in that state. Such an adjustment may be fine for a particular time of year, outside temperature level, and humidity level, but is likely not optimal for most other times of the year and other temperature and humidity levels. It is often time consuming and difficult to re-adjust the dampers and valves for optimal comfort level.

The industry has developed multi-zone control systems in an attempt to better control the environmental parameters in each room or region of a home or building, for example, by placing thermostats in each larger room or groups of rooms. However, such systems to date have not been flexible enough to be entirely successful. For example, if a thermostat in a first room calls for heat, a furnace may be turned on to provide the heat. However, some of this heat may still be getting distributed to other rooms which do not presently require heat. As a result, these other rooms may become uncomfortably warm. Having multiple furnaces, air conditioners, and/or heat pumps which are connected to different thermostats and service only certain rooms may help this problem, however, this tends to be an expensive solution due to the extra equipment required and resulting service charges.

Heat pumps are relatively inexpensive to operate and can both heat air and cool air. Heat pumps use a refrigeration system to cool air and use the same refrigeration system run in reverse to heat air. Environmental control of several zones via heat pumps typically calls for a separate heat pump and thermostat for each zone or installation of a multi-zone system as previously described.

In view of the foregoing discussion, it is apparent that there is a need for a more efficient way of controlling the distribution of air and environmental parameters for several zones in a building or home.

Further limitations and disadvantages of conventional, traditional, and proposed approaches will become apparent to one of skill in the art, through comparison of such systems and methods with the present invention as set forth in the remainder of the present application with reference to the drawings.

SUMMARY OF THE INVENTION

An embodiment of the present invention comprises a method to control environmental parameters of pre-defined zones within a first environment using an electronic controller. The method comprises assigning a weighting value to each of the pre-defined zones within the environment using the electronic controller. The method also comprises detecting any zone service calls from sensor devices associated with each of the pre-defined zones using the electronic controller. The method further comprises determining a cumulative zone weighting value in response to the detected zone service calls using the electronic controller and selecting a staging combination from at least two possible staging combinations in response to at least the cumulative zone weighting value using the electronic controller.

A further embodiment of the present invention comprises a system to control environmental parameters of pre-defined zones within a first environment. The system includes an electronic controller, wherein the electronic controller associates an assigned weighting value to each of the pre-defined zones within the environment; detects any zone service calls from sensor devices associated with each of the pre-defined zones; determines a cumulative zone weighting value in response to the sensed zone service calls; and selects a staging combination from at least two possible staging combinations in response to at least the cumulative zone weighting value.

Another embodiment of the present invention comprises a method to control environmental parameters of pre-defined zones within a first environment using a non-proprietary electronic controller. The method includes assigning a weighting value to each of the pre-defined zones within the first environment, using the non-proprietary electronic controller, based on at least duct work capacity for each predefined zone. The method further includes the non-proprietary electronic controller detecting any zone service calls from sensor devices associated with each of the pre-defined zones and determining a cumulative zone weighting value in response to the detected zone service calls. The method also includes the non-proprietary electronic controller selecting an air handler stage from at least two possible air handler stages in response to at least the cumulative zone weighting value.

In accordance with an embodiment of the present invention, the non-proprietary electronic controller is capable of staging an air handler of a forced air system based on the cumulative zone weighting value, independent of the staging of the heating and/or cooling equipment of the forced air system.

In accordance with an embodiment of the present invention, the non-proprietary electronic controller is capable of staging heating and/or cooling equipment of a forced air system based on thermal capacity alone, not just on calls from the pre-defined zones.

A further embodiment of the present invention comprises a forced air system to control environmental parameters of pre-defined zones within a first environment. The forced air system comprises a non-proprietary electronic controller which is capable of:

(1) being used to assign a weighting value to each of the pre-defined zones within the first environment based on at least duct work capacity for each predefined zone:
(2) detecting any zone service calls originating from any of the pre-defined zones;
(3) determining a cumulative zone weighting value in response to the detected zone service calls; and
(4) selecting an air handler stage from at least two possible air handler stages in response to at least the cumulative zone weighting value.

Another embodiment of the present invention comprises a non-proprietary electronic controller for use in a forced air system to control environmental parameters of pre-defined zones within a first environment, wherein the non-proprietary electronic controller is capable of:

(1) being used to assign a weighting value to each of the pre-defined zones within the first environment based on at least duct work capacity for each predefined zone;
(2) detecting any zone service calls originating from any of the pre-defined zones;
(3) determining a cumulative zone weighting value in response to the detected zone service calls; and
(4) selecting an air handler stage from at least two possible air handler stages in response to at least the cumulative zone weighting value.

In accordance with an embodiment of the present invention, the non-proprietary electronic controller is capable of supporting a set of functions including all of resistance heat lock-out, outdoor reset, outdoor temperature balance point, selectable O/B outputs, and discharge temperature controls.

In accordance with an embodiment of the present invention, an electronic controller has been designed to optimize the operation of heating and air conditioning equipment. The electronic controller refines control of the equipment by bringing on only specific subsystems of the heating and cooling equipment, depending on the demand from the environmental sensors, the outside air temperature, the temperature of the air leaving the equipment, and the electric utility efficiency programs. The electronic controller allows the available airflow to be concentrated to the areas where there is a current demand for heating, cooling, or ventilation by controlling a set of air-driven zone dampers.

Embodiments of the present invention provide the ability to choose between more distinct operating modes for the heating and cooling equipment than has typically been contemplated in the past. Embodiments of the present invention provide algorithms to incorporate humidification and dehumidification equipment and techniques that have not typically been a part of a zoning system.

In accordance with an embodiment of the present invention, a plain English "setup wizard" is provided as part of the controller which allows HVAC installers to configure the system quickly and easily for any system. That is, the controller is a non-proprietary controller that is designed to be configured for and useable with any standard forced air system. In accordance with an embodiment of the present invention, simple and inexpensive standard heat/cool thermostats are used on predefined zones 2 through 4 to make installation easier (e.g., single stage thermostats). Zones 2-4, using simple thermostats, depend more on the controller for zone control. That is, the simple single stage thermostats can only tell the controller if its zone needs heating or cooling. The simple thermostats cannot tell the controller how much heating or cooling is needed or that a zone still needs more heating or cooling. Embodiments of the present invention allow installers to use any thermostat, either heat pump or heat/cool on a predefined zone 1 (e.g., a smarter more complex multi-stage thermostat with emergency or auxiliary heat capability, or a simple thermostat as used on zones 2-4). As a result, the installer is able to tale advantage of certain advanced features built into today's modern thermostats. Installers may also use wireless, auto changeover, single- or two-stage thermostats, or any thermostat that provides installer with the level of control which they desire.

In accordance with an embodiment of the present invention, when a call for heating or cooling is started, an electronic controller monitors the temperature of the air leaving the heating or cooling equipment (i.e., the Leaving Air Temperature). The electronic controller monitors the change over unit time in the LAT temperature. Any given piece of HVAC equipment may produce a finite amount of heating and cooling. Therefore, a temperature profile of the LAT will start with a steep curve and then flatten out as the equipment nears capacity. The electronic controller watches for that flattening and then compares the actual LAT to a value assigned during the setup wizard procedure. If the LAT is not warm or cold enough to exceed a minimum heating or a maximum cooling level, then the HVAC equipment is stepped up to a next operational mode with more capacity. That is, the system stages on capacity, not just demand from one or more zones. If the LAT gets too close to a maximum heating or a minimum cooling temperature, then higher stages of capacity are turned off and the system is allowed to operate in a less than full-capacity mode, which is more efficient. If the LAT reaches the assigned setpoint, then the HVAC equipment is turned off to prevent equipment damage.

In accordance with an embodiment of the present invention, during setup each of the defined zones is assigned a relative zone weight. As the logic of capacity and demand are followed and there is a call to increase capacity, the electronic controller will step up to the next highest operational mode. The zone weights being served at that time are totaled. If the total weights are not above a threshold assigned during the setup wizard, then the compressor capacity is increased but the air-handler speed is not increased. This allows a determined amount of air to be delivered to any ductwork configuration without having to resort to allowing some air to escape back through the return (known as bypass air).

The zone weights may be set to any value between 10% and 90%, in accordance with an embodiment of the present invention, which allows an operator to over- or under-serve any particular area, or duct condition. Further, the zone weight is used to set priority between opposing heating or cooling calls and allows an operator to customize the operation of the system to meet the customer's lifestyle to a very high degree.

In accordance with an embodiment of the present invention, there are four choices of priority which are:

1. Zone weight where the relative weights of the zones are totaled by service desired and the service with the greatest weight is served first.

2. Heating where a heating call will be served first and a running cooling call is interrupted.

3. Cooling where a cooling call will be served first and a running heating call is interrupted.

4. Automatic mode where the first in a particular cycle will define the priority system.

In accordance with another embodiment of the present invention, if an opposing call waits for 20 minutes without being served, the priority will switch to that call for up to 20 minutes. After that, the priorities will change back and forth on a 20 minute cycle to prevent unserved or "orphan zones". In accordance with yet another embodiment of the present invention, "Fan Only" ventilation calls are served anytime there are no calls for either heating or cooling.

In accordance with an embodiment of the present invention, the outside air temperature (OAT) sensor readings are used to adjust the minimum heat setting. Such a function takes the place of an additional control required for some installations called an Outside Reset Controller. As the temperature outside gets colder, the equipment will have to provide more heat to maintain inside temperatures. Therefore, the minimum heat setting is adjusted to force the system to operational modes that provide more heating capacity more quickly.

In accordance with an embodiment of the present invention, when the electronic controller is used in conjunction with a heat pump with a fossil fuel backup furnace, the OAT sensor readings are used to determine when to change over from heat generated by an electric heat pump to heat generated by the backup fossil fuel furnace. This is known as "Balance Point" and is a function of the relative efficiency of the heat pump and the furnace as the OAT falls. The Balance Point is assigned during the setup wizard process.

Many electric utilities have incentive programs or regulatory restrictions about when a heat pump may use backup resistance heat. The OAT sensor readings are used to prevent the heat pump from adding resistance heat in an auxiliary mode above a given temperature. That given temperature is assigned during the setup wizard process.

An embodiment of the present invention features a LCD screen as part of the electronic controller to output data to the operator. The output screen shows which calls are being served, which zones are being served, and the total weight of the zones being served. The output screen displays the LAT and OAT temperatures and displays equipment lockouts that are currently in place. Any purges between heating and cooling calls are also displayed.

In accordance with an embodiment of the present invention, each zone has its own display to display what (if anything) that zone's sensor is calling for. The display shows how long that zone has been served or how long until it will be served. The assigned weight for that zone is also displayed.

In accordance with an embodiment of the present invention, the electronic controller provides a variable purge cycle between heating and cooling calls, depending on the equipment that just finished a call. If an electric heat pump was running in a compressor mode, the heat exchange ends very quickly after the compressor(s) are turned off and there is a 30 second wait. At the completion of a fossil fuel furnace cycle, however, there is a large amount of heat stored in the heat exchanger. Therefore, the purge cycle lasts for two minutes.

In accordance with an embodiment of the present invention, if there is a call waiting for service that includes a fan input (G), then the fan call is served without any interruption such that the fan is not switched off and then back on again.

In accordance with another embodiment of the present invention, a variable end of cycle timer is provided by the electronic controller. At the conclusion of the purge cycle, the pump is allowed to run for an assignable period of time with all of the solenoids turned off. This drives all of the zone dampers open, depending on the length of the cycle selected and the number of dampers employed. This is adjustable from 0 to 180 seconds and is assigned during the setup wizard process.

In accordance with an embodiment of the present invention, if the electronic controller detects an emergency heat call, this indicates that the operator has switched the zone 1 thermostat (of a first zone) to the "Emergency Heat" position (i.e., selects the emergency heat mode). Likely, this indicates that something has happened to the compressor(s) of the heat pump. In such a situation when "Emergency Heat" is selected, the non-proprietary electronic controller will respond by allowing all zones to receive emergency heat (i.e., the heat pump won't be used for any of the zones). The emergency call is latched in until a normal heating call is received indicating that the heat pump has been fixed and the zone 1 thermostat has been switched out of the "Emergency Heat" position.

These and other advantages and novel features of the present invention, as well as details of illustrated embodiments thereof, will be more fully understood from the following description and drawings.

BRIEF DESCRIPTION OF SEVERAL VIEWS OF THE DRAWINGS

FIG. 6 is a flowchart of an exemplary embodiment of a method for translating thermostat inputs to HVAC outputs based on the type of HVAC equipment being used, in accordance with various aspects of the present invention.

FIG. 7 is a flowchart of an exemplary embodiment of a method for translating thermostat inputs to electronic controller inputs based on zone, in accordance with various aspects of the present invention.

FIGS. 8*a*-8*b* show exemplary embodiments of setting options that may be displayed to an operator of the electronic controller via a display device, in accordance with various aspects of the present invention.

FIGS. 23*a*-23*c* illustrate a flowchart of an exemplary embodiment of a method for performing a heating procedure, in accordance with various aspects of the present invention.

DETAILED DESCRIPTION OF THE INVENTION

Figure 1A:
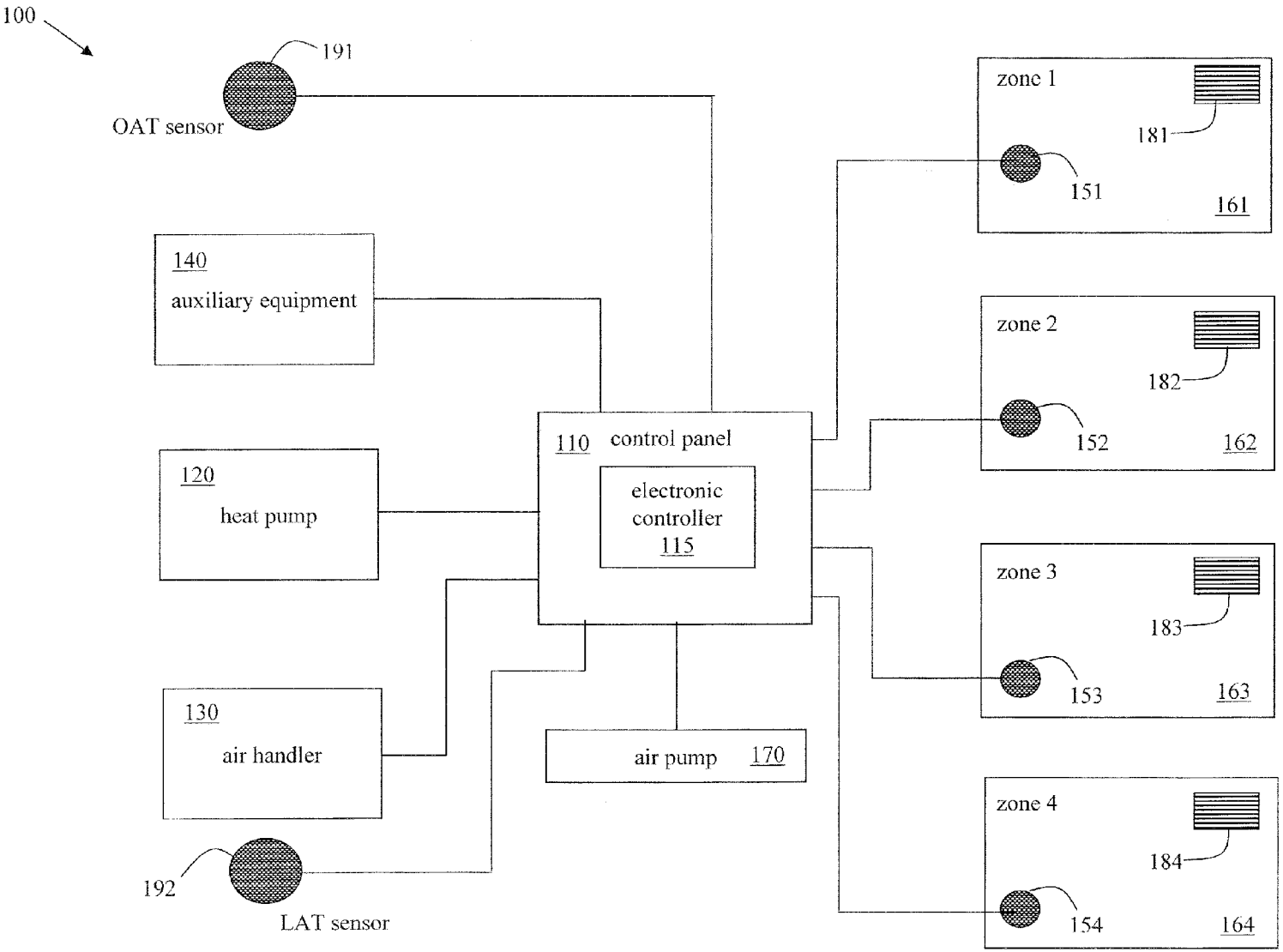
FIG. 1A illustrates a schematic block diagram of an exemplary embodiment of a system to control environmental parameters of pre-defined zones within a first environment, in accordance with various aspects of the present invention.

As used herein, the term "non-proprietary" means useable with any standard commercial forced air system (e.g., any standard commercial heat pump system). FIG. 1A illustrates a schematic block diagram of an exemplary embodiment of a system 100 to control environmental parameters of pre-defined zones within a first environment, in accordance with various aspects of the present invention. The system 100 includes a control panel 110, at the heart of the system 100, which includes an electronic controller 115. The system 100 further includes a heat pump 120 and an air handler 130 both operationally connected to the control panel 110 such that the operation of the heat pump 120 and the air handler 130 may be controlled by the electronic controller 115 of the control panel 110. The system 100 also includes auxiliary equipment 140 operationally connected to the control panel 110 such that the operation of the auxiliary equipment 140 may be controlled by the electronic controller 115 of the control panel 110.

The system 100 further comprises sensor devices 151-154 each operationally connected to the electronic controller 115 with each one of the sensor devices occupying a zone (161-164) of an environment to be environmentally controlled. The sensor devices are used to call for service. The system 100 also includes at least one air pump device 170 operationally connected to the control panel 110 such that the distribution of air may be controlled by the electronic controller 115 of the control panel 110. The system 100 further includes at least one air damper 181-184 associated with each of the zones 161-164 and being operationally connected to the air pump device 170. In accordance with an alternative embodiment of the present invention, the dampers 181-184 may be electromechanical dampers or any other type of damper. The system also includes an outside air temperature (OAT) sensor 191 and a leaving air temperature (LAT) sensor 192 each operationally connected to the electronic controller 115 of the control panel 110. The OAT sensor measures the temperature of the outside air in a second external environment which is external to the first indoor environment. Each zone may comprise a separate room or connected areas in a house or other building, for example. Zones may also be defined by a time of day. For example, a bedroom zone may only be dynamically controlled at night when the bedroom is in use, and left closed off during the day when the bedroom is not in use. Similarly, an office building or restaurant not used at night may be closed off at certain hours of the night and dynamically controlled during the day.

In accordance with an embodiment of the present invention, the control panel 110 includes not only the electronic controller 115 but other components, as well, such as solenoids, relays, and a power supply for providing power and/or control air to the various system elements (i.e., the heat pump 120, the air handler 130, the air dampers 181-184, etc.) through activation by the electronic controller 115. For example, to turn on the heat pump 120, the electronic controller 115 activates relays in the control panel 110 to switch electrical power to the heat pump 120. As another example, to provide air from the air pump device 170 to one of the air dampers 181-186, the electronic controller 115 activates (via an activation signal) a solenoid on the control panel 110 to switch air to an air damper (e.g., 181). In general, the electronic controller 115 is a non-proprietary controller and independently controls activation of the heat pump 120, air handler 130, auxiliary equipment 140, and the air dampers 181-184 when properly configured to a particular forced air system having such components.

The electronic controller 115 also receives input signals from the various sensor devices 151-154, 191, and 192. The sensor devices 151-154 may include, for example, thermostats and/or humidistats for monitoring temperature and/or humidity of the corresponding zones 161-164. The electronic controller 115 uses these input signals to determine when and how to activate the various equipment (120, 130, 140, 170).

The auxiliary equipment 140 may include an auxiliary heating source such as a fossil fuel system. Such an auxiliary heating source may include a gas, propane, or oil furnace, or a resistive heat strip, for example. Other auxiliary equipment such as, for example, auxiliary cooling equipment (e.g., an air conditioner) and a humidifier are possible as well, in accordance with various embodiments of the present invention.

In general, the heat pump 120, air handler 130, and auxiliary equipment 140 may include one or more stages of operation. Since, the controller 115 is non-proprietary, the controller 115 may be configured to work with any standard forced air system having any standard number of stages. For example, the heat pump 120 may include two compressor stages of operation where either only the first compressor stage is activated, or both the first and second compressor stages are activated (e.g., when more cooling is needed). The air handler 130 may include two stages or speeds of operation such as, for example, a low fan speed stage and a high fan speed stage. The auxiliary equipment 140 may include, for example, two heat strip stages of operation where either only the first heat strip stage is activated, or both the first and second heat strip stages are activated (e.g., when more heat is needed). In accordance with an embodiment of the present invention, the activation of the various stages of the equipment may be controlled independently by the electronic controller 115 based on the determined need for heating, cooling, humidification, dehumidification, and/or air capacity (air volume).

Figure 1B:
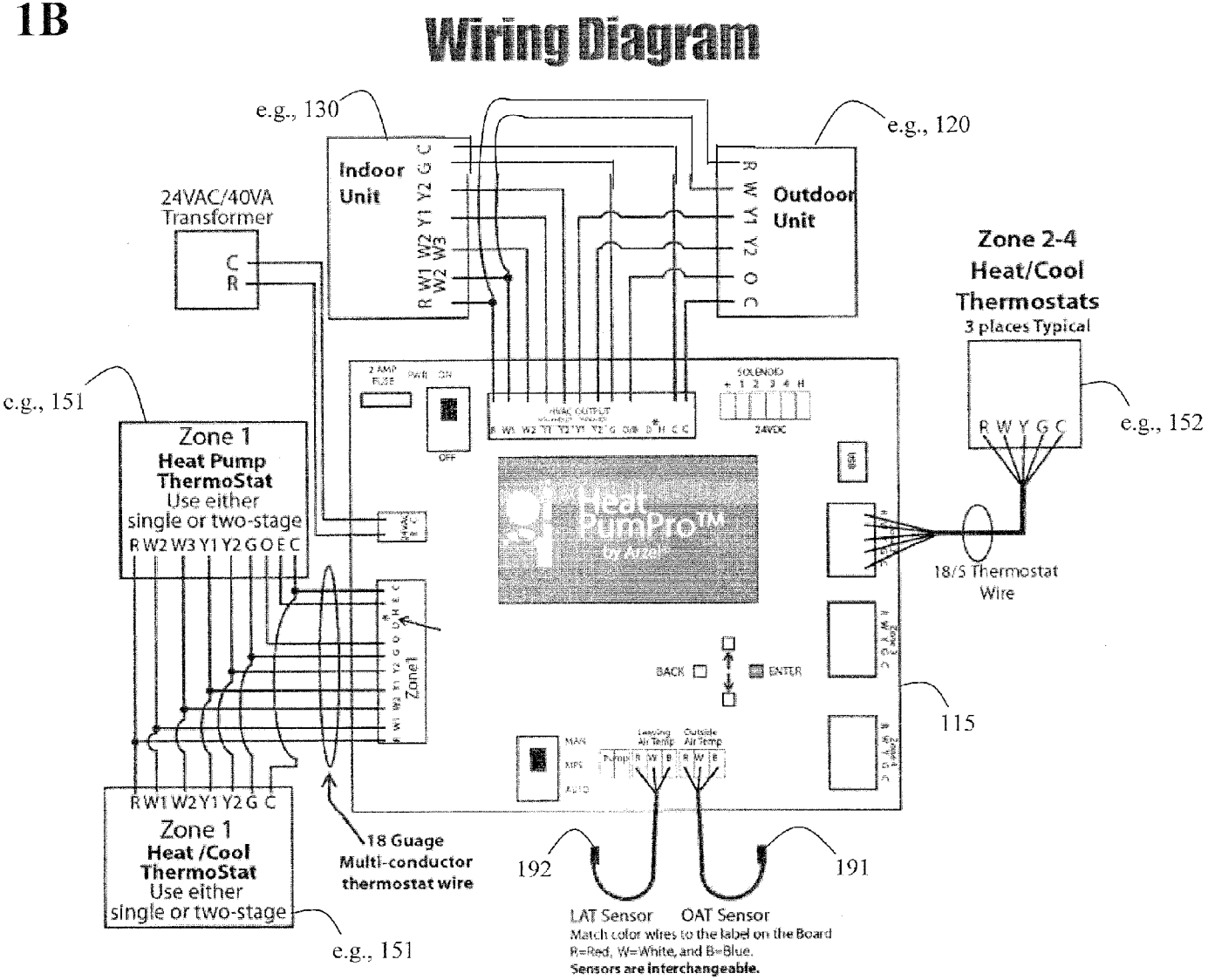
FIG. 1B illustrates a first exemplary embodiment of a schematic wiring diagram of the system of FIG. 1A, in accordance with various aspects of the present invention.

FIG. 1B illustrates a first exemplary embodiment of a schematic wiring diagram of the system 100 of FIG. 1A, in accordance with various aspects of the present invention. For example, the connections are shown for how to wire a sensor 151 for zone 1, which may be a complex heat pump thermostat or a heating/cooling thermostat (single stage or two-stage), to the controller 115. Also, the connections are shown for how to wire the OAT sensor 191 and the LAT sensor 192 to the controller 115. Further, the connections are shown for how to wire a sensor 152 for zone 2, which may be a simple thermostat, to the controller 115. Also, the connections are shown for how to wire a combination of a heat pump 120 and an air handler 130, which may break down into an outdoor unit and an indoor unit, to the controller 115.

Figure 1C:
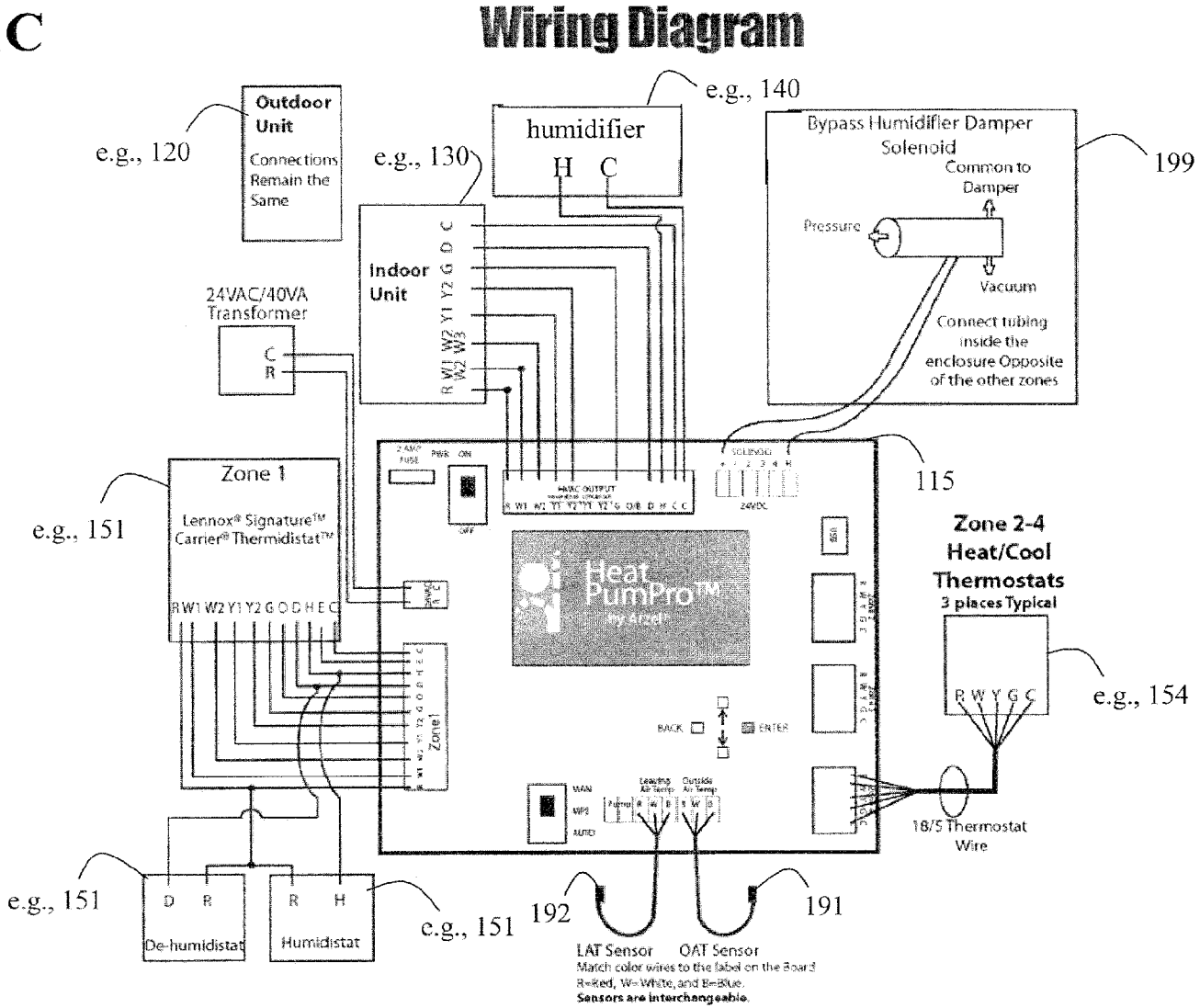
FIG. 1C illustrates a second exemplary embodiment of a schematic wiring diagram of the system of FIG. 1A, in accordance with various aspects of the present invention.

FIG. 1C illustrates a second exemplary embodiment of a schematic wiring diagram of the system 100 of FIG. 1A, in accordance with various aspects of the present invention. For example, the connections are shown for how to wire a sensor 151 for zone 1, which may be a complex heat pump thermostat or a humidistat or a de-humidistat, to the controller 115. Also, the connections are shown for how to wire the OAT sensor 191 and the LAT sensor 192 to the controller 115. Further, the connections are shown for how to wire a sensor 154 for zone 4, which may be a simple thermostat, to the controller 115. Also, the connections are shown for how to wire a combination of a heat pump 120 and an air handler 130, which may break down into an outdoor unit and an indoor unit, to the controller 115. Further, the connections are shown for how to wire a humidifier 140 to the controller 115. A solenoid 199 may also be wired and is dedicated to automatically operating a damper for the humidifier, as will be explained later herein.

Figure 2A:
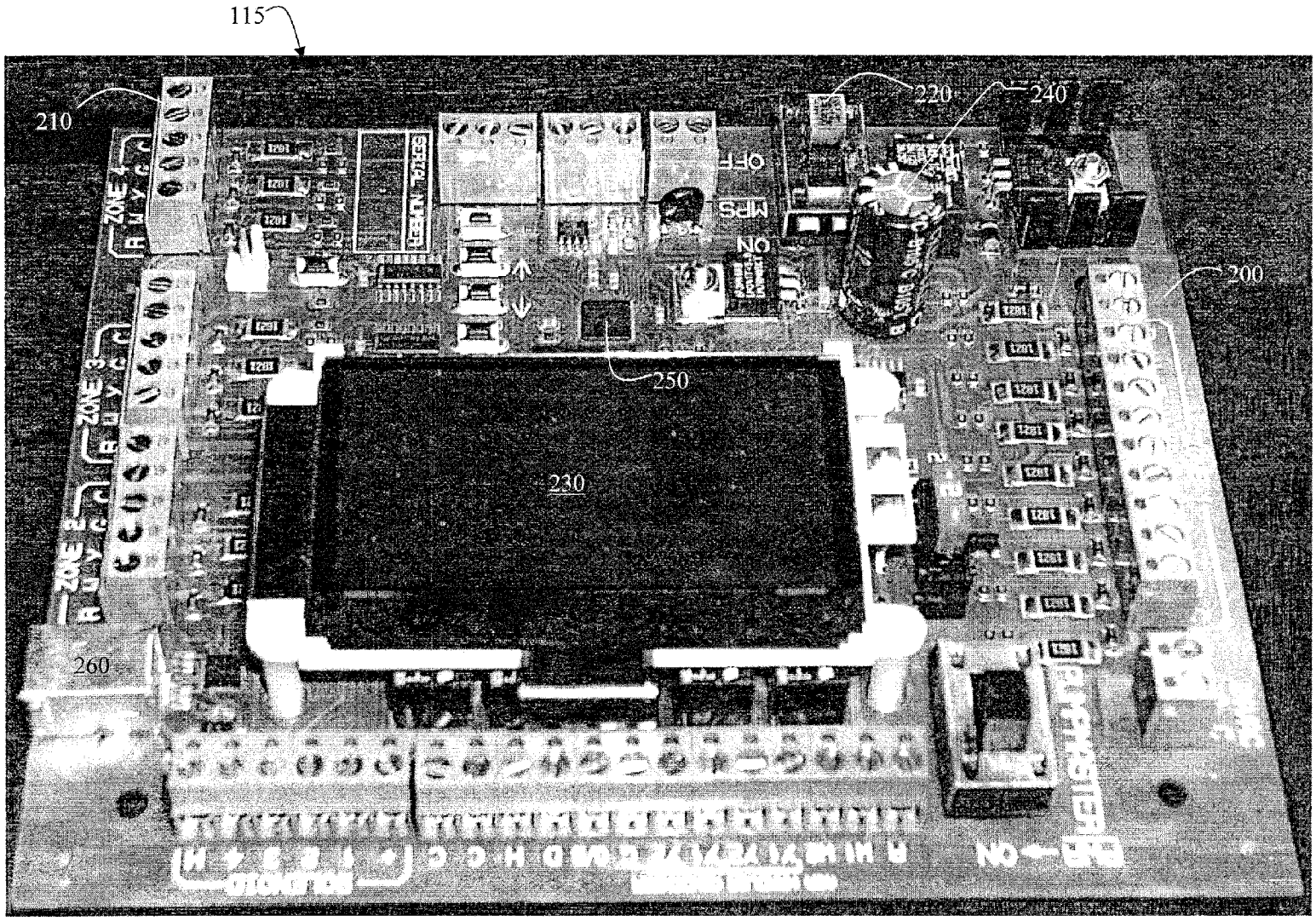
FIG. 2A is a first illustration of an exemplary embodiment of an electronic controller used in the system of FIG. 1A, in accordance with various aspects of the present invention.

FIG. 2A is a first illustration of an exemplary embodiment of an electronic controller 115 used in the system 100 of FIG. 1A, in accordance with various aspects of the present invention. The electronic controller 115 comprises a circuit board 200 with various components and devices mounted to the circuit board 200 including terminals (e.g., 210), switches (e.g., 220), a microprocessor, an LCD display device 230, resistors, capacitors (e.g., 240), integrated circuit chips (e.g., 250), as well as other components.

In accordance with an embodiment of the present invention, the display device 230 may be used by an operator to aid the operator in manually selecting setting options (a first, a second, a third set of options, etc.) which are pre-programmed into the electronic controller 115. Such manual selecting includes the steps of powering up the electronic controller 115, displaying a first set of options on the display device 230, selecting at least one of the options from the first set of options using at least one switching device on the electronic controller 115, displaying a second set of options on the display device 230, and selecting at least one of the options from the second set of options using at least one switching device on the electronic controller 115. The process of displaying a next set of options and selecting from the next set of options may continue until all available selections are made. A list of selections and associated setting options are presented later herein. Also, the LCD display device 230 functions as an input/output indicator by displaying each thermostat call and the service currently being provided, in accordance with an embodiment of the present invention.

The electronic controller 115 further includes a USB (universal serial bus) port 260. The USB port 260 allows a personal computer (PC), for example, to interface to the electronic controller 115. In accordance with an embodiment of the present invention, the electronic controller 115 stores a history of operational data which may be read out of the electronic controller 115 by the PC via the USB port 260. The history of operational data may include, for example, a listing of zone service calls that occurred over the last 24 hours or more, and a listing of stage activations initiated by the electronic controller 115 over the last 24 hours or more. Such historical information may be used by a technician to troubleshoot the system 100. Also, in accordance with an embodiment of the present invention, a set of default options may be reloaded from the PC into the electronic controller 115 via the USB port 260. Reloading the set of default options overrides any manual option selections that were previously made via the display device 230.

Also, in accordance with an embodiment of the present invention, the USB port 260 may be used to allow the electronic controller 115 to interface with home automation equipment (e.g., a home automation device). The software of the electronic controller 115 is designed with "hooks" for integration with home automation packages. Data that may be Output via the USB port to a home automation package include the last five events, the current damper states, the current service being provided, the current LAT, the current OAT, and any current thermostat or sensor requests. The home automation equipment may include a separate device with software that takes the data provided by the controller 115 and reports the data to a remote user via a dialer capability, email, or a web-based interface, for example. The user may have the capability to respond to the report in a similar manner in order to, for example, change the temperature in the home or turn off part of the HVAC system. The interface between the controller 115 and the home automation equipment may be wired or wireless, in accordance with various embodiments of the present invention.

Figure 2B:
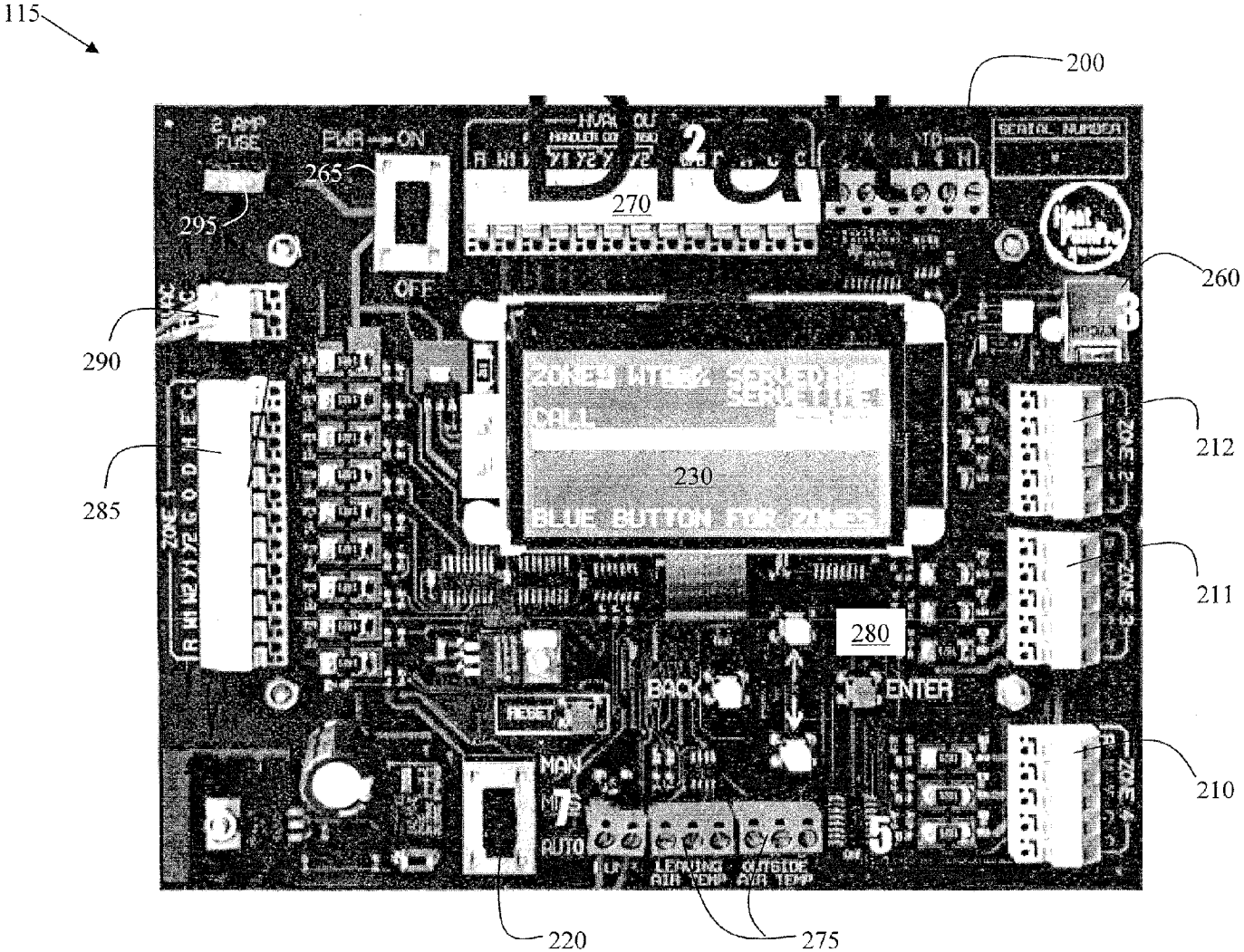
FIG. 2B is a second illustration of the exemplary embodiment of the electronic controller used in the system of FIG. 1A, in accordance with various aspects of the present invention.

FIG. 2B is a second illustration of the exemplary embodiment of the electronic controller 115 used in the system 100 of FIG. 1A, in accordance with various aspects of the present invention. The power switch 265 is used to control 24 VAC power to the control panel 110. The HVAC outputs 270 are the dry contacts to control the HVAC equipment. The terminals 210, 211, and 212 are the thermostat inputs for zone 4, zone 3, and zone 2, respectively. The sensor inputs 275 are the inputs for the LAT sensor and OAT sensor. Control buttons 280 provide a programming interface with components of the controller 115. The switch 220 is used to control power for the micro pump (air pump device 170). The zone 1 input terminal 285 accepts inputs from any 24 VAC thermostats (heat pump or heat/cool). The 24 VAC power input 290 is provided via transformer connections "R" and "C". The 2-amp fuse 295 protects the board 200 against thermostat shorts.

Figure 3:
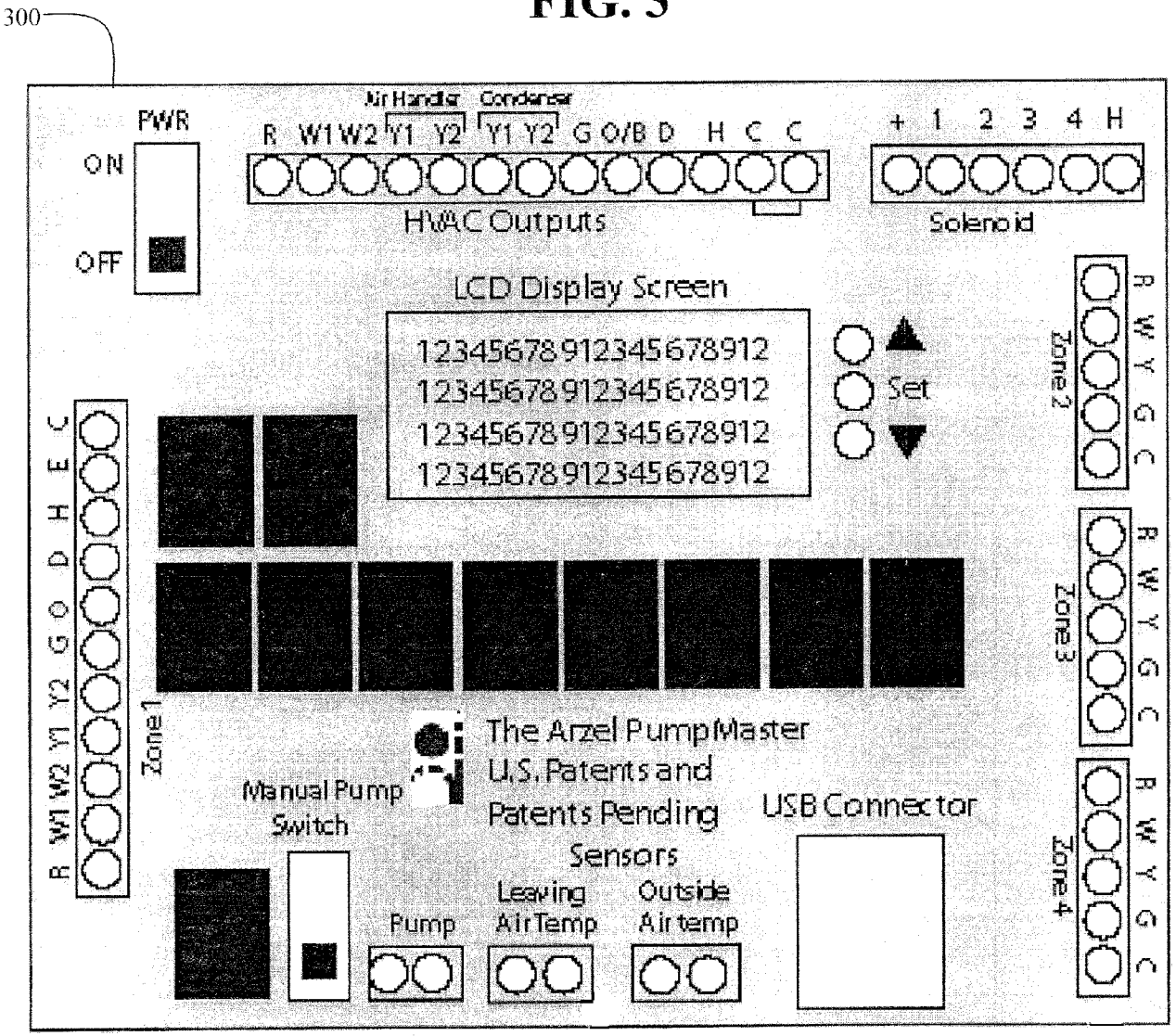
FIG. 3 is a schematic illustration of an embodiment of the layout of terminals, switches, and certain other components of an electronic controller used in the system of FIG. 1A, in accordance with various aspects of the present invention.

FIG. 3 is a schematic illustration of an embodiment of the physical layout 300 of terminals, switches, and certain other components of the electronic controller 115 used in the system 100 of FIG. 1A, in accordance with various aspects of the present invention.

Figure 4:
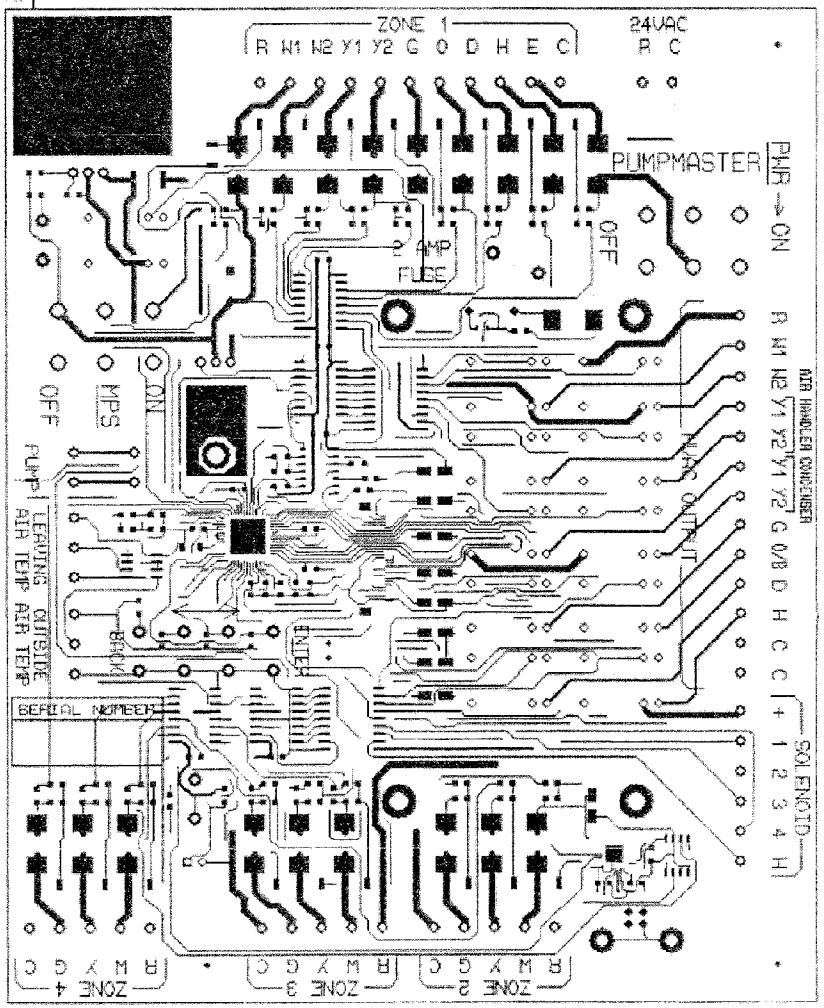
FIG. 4 is a schematic illustration of an embodiment of a circuit board layout of the electronic controller of FIGS. 2A and 2B, in accordance with various aspects of the present invention.

FIG. 4 is a schematic illustration of an embodiment of a circuit board layout 400 of the electronic controller 115 of FIGS. 2A and 2B, in accordance with various aspects of the present invention.

Figure 5A:
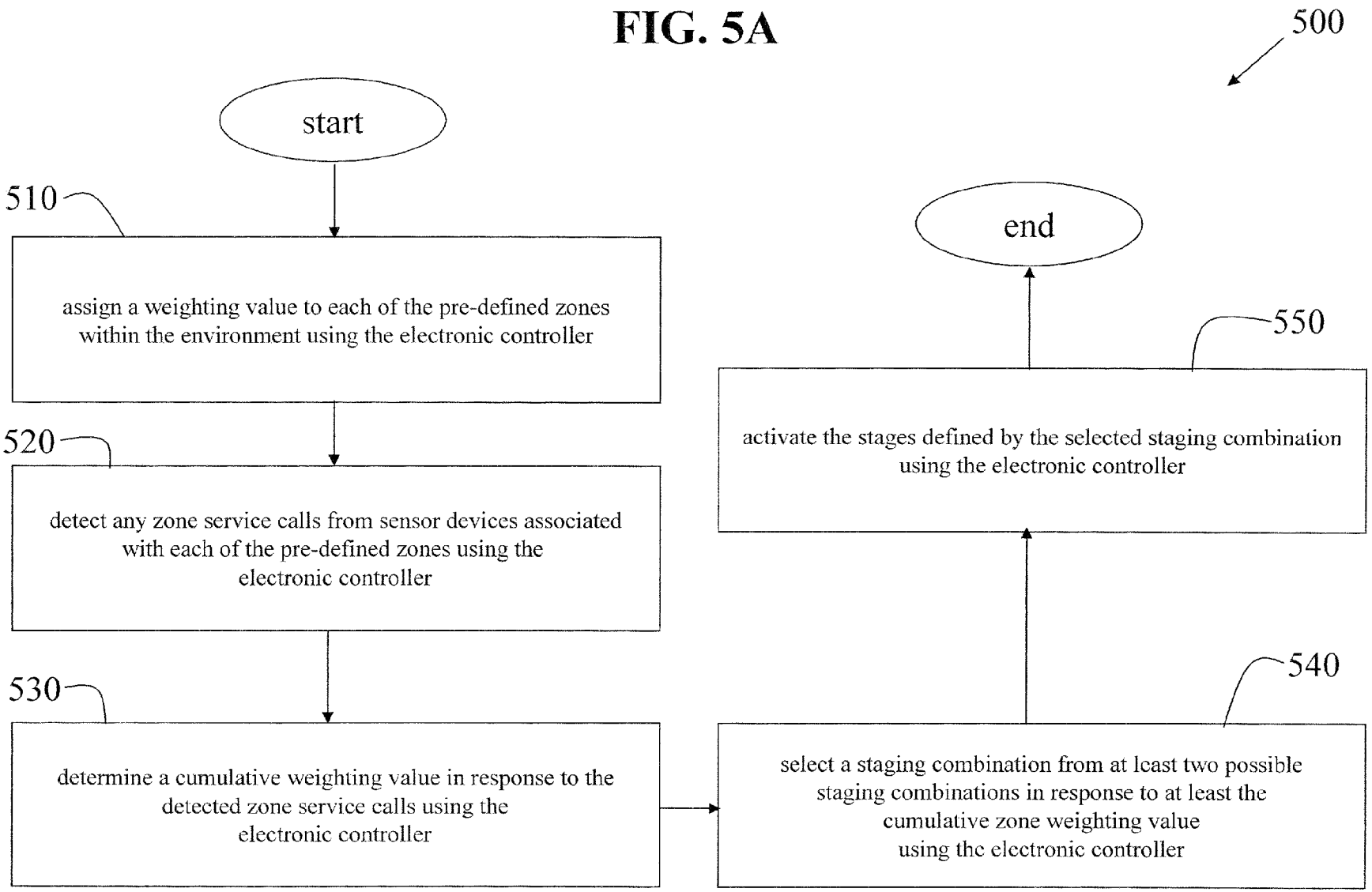
FIG. 5A illustrates a flowchart of a first embodiment of a method to control environmental parameters of pre-defined zones within a first environment using the system of FIG. 1A which includes the electronic controller of FIGS. 2A and 2B, in accordance with various aspects of the present invention.

FIG. 5A illustrates a flowchart of an embodiment of a method 500 to control environmental parameters of pre-defined zones within a first environment using the system 100 of FIG. 1A which includes the electronic controller 115 of FIGS. 2A and 2B, in accordance with various aspects of the present invention. In step 510, a weighting value is assigned to each of the pre-defined zones within a first environment using an electronic controller. In step 520, any zone service calls from sensor devices associated with each of the pre-defined zones are detected using the electronic controller. In step 530, a cumulative weighting value is determined in response to the detected zone service calls using the electronic controller. In step 540, an equipment staging combination is selected from at least two possible equipment staging combinations in response to at least the cumulative zone weighting value using the electronic controller. In step 550, the stages defined by the selected equipment staging combination are activated using the electronic controller.

As an example, referring to FIG. 1A, zone 1 161 may be assigned a weighting value of 35%, zone 2 162 may be assigned a weighting value of 10%, zone 3 163 may be assigned a weighting value of 20%, and zone 4 164 may be assigned a weighting value of 45%. These weighting values may be assigned based on the square footage area (i.e., floor space) of the zones or the separate spatial volumes of the zones, for example. In general, a larger zone may receive a higher weighting value. Also, weighting values may be based on the criticality of protecting equipment or produce in a zone (e.g., protecting expensive computer equipment or perishable food).

The weighting values for the various zones are programmed into the electronic controller 115 by an operator using the LCD display 230 and associated switches as a user interface. Next, zone service calls are detected by the electronic controller 115 from thermostat 151 in zone 1 161 and thermostat 154 in zone 4 164. Both zones are calling for heat. Since the weighting value associated with zone 1 61 is 35% and the weighting value associated with zone 4 164 is 45%, the cumulative weighting value is the sum of the two which is 80%, which is a fairly high cumulative weighting value, and is higher than a pre-defined zone weighting threshold of, for example, 60%.

As a result, the electronic controller 115 selects an equipment staging combination which includes two or more compressor stages of the heat pump 120 and a second higher air blower speed of the air handler 130. The selected stages are activated by the electronic controller 115 via the control panel 110, and the electronic controller 115 directs air from the air pump device 170 to the air dampers 181 and 184 in zone 1 161 and zone 4 164 in order to open these air dampers. As a result, the heat pump 120 provides heat to the air handler 130 which blows heated air to zone 1 161 and zone 4 164. The dampers 182 and 183 in zone 2 162 and zone 3 163 remain closed. Once the servicing of the zones is completed, the air dampers may be closed by the electronic controller 115.

A zone service call may include any of a heating call, a cooling call, a humidification call, a de-humidification call, and a fan-only call, in accordance with an embodiment of the present invention.

Continuing with the example, once zone 1 161 and zone 4 164 are properly heated, the electronic controller 115 closes the dampers 181 and 184 and de-activates the two stages of the heat pump 120 and the air handler 130. Next, the electronic controller 115 receives and detects a new zone service call from the thermostat 152 of zone 2 162. The weighting value associated with zone 2 162 is 10%. Since zone 2 162 is the only zone calling, the cumulative weighting value is also 10% which is below the threshold of 60%. As a result, the electronic controller 115 selects a new equipment staging combination which includes a first compressor stage of the heat pump 120 and a first lower air blower speed of the air handler 130. The selected stages are activated by the electronic controller 115 via the control panel 110, and the electronic controller 115 directs air from the air pump device 170 to the air dampers 182 in zone 2 162 in order to open this air damper. As a result, the heat pump 120 provides heat to the air handler 130 which blows heated air to zone 2 162. The dampers 181, 183 and 184 in zone 1 161, zone 3 163, and zone 4 164 remain closed.

As may be seen from the previous example, the weighting of the zones, the determination of a cumulative weighting value, and the independent control and activation of the heat pump stages and the air handler stages allow the system 100 to select the best combination of equipment stages to be activated in order to properly heat the calling zones in a more efficient manner. Similarly, other types of zone service calls such as cooling, humidification, dehumidification, and fan-only may be effected in the same way by allowing the system 100 to select, via the electronic controller 115, the best combination of stages of the heat pump 120, the auxiliary equipment 140, and the air handler 130. For example, for certain applications, it has been found that the best staging combination involves using the zone weighting values only to stage the air handler 130, independent of the staging of the other equipment. The controller 115 allows the air handler and the other equipment to be controlled and staged independently. For example, the heat pump may be staged based on LAT and OAT, but not zone weightings, and the air handler is staged based on the zone weightings. That is, the air handler staging, in this embodiment, is based strictly on zone weighting and not temperature. In this way, airflow may be better matched to duct capacity. The zone weightings for the air handler are based on the amount of ductwork being served at any one time for the calling zones.

In accordance with an embodiment of the present invention, one or more of the sensors 151-154 may include a humidistat for measuring a humidity level in a zone, or may be a combination thermostat/humidistat for measuring temperature and humidity level in a zone. When a zone calls for lowering the humidity level, two or more stages of the heat pump may be employed to provide maximum cooling capacity but only the first stage (i.e., lower speed) of the air handler may be activated such that the lower speed of the air passing over the cooling coils in the heat pump will allow more moisture to condense out of the air, for example.

Various staging combinations are provided by the electronic controller 115 in an attempt to better control the environmental parameters (e.g., temperature, humidity, air flow) within the various zones. In accordance with an embodiment of the present invention, the allowable staging combinations may be as follows:

1) a first stage of a heat pump and a first stage (low speed) of an air handler;

2) a first stage and a second stage of a heat pump and a first stage (low speed) of an air handler;

3) a first stage and a second stage of a heat pump and a second stage (high speed) of an air handler;

4) a first stage and a second stage of a heat pump, a second stage (high speed) of an air handler, and a first stage of an auxiliary heat source;

5) a first stage and a second stage of a heat pump, a second stage (high speed) of an air handler, and a first stage and a second stage of an auxiliary heat source.

Each of the staging combinations includes a unique, predefined combination of heat pump and/or auxiliary equipment stages that may be activated by the electronic controller along with different air handler stages that may be activated by the electronic controller for servicing the calling zones. Other staging combinations are possible as well, in accordance with various embodiments of the present invention. For example, a staging combination may include turning on a fan of the air handler 130 without activating any stages of the heat pump 120 or auxiliary equipment 140. This may be desirable simply to move air around a zone or zones, or to bring outside air in from outside of the house or building (i.e., from an external environment), for example. Again, in accordance with another embodiment of the present invention, only the air handler may be staged based on zone weighting, as will be elaborated upon later herein with reference to FIG. 5B.

The outside-air-temperature (OAT) sensor 191 may be used to report a temperature of the outside (i.e., external) environment to the electronic controller 115. As a result, the electronic controller may 115 may use the outside-air-temperature as another input in the process to decide which stages to activate when a zone or zones is calling for service. For example, if it is the middle of winter and a user of the system 100 is entertaining a large number of people within a building such as, for example, a home, a restaurant, or a hotel, the temperature within the building may start to increase to an uncomfortable level. The outside-air-temperature as measured by the OAT sensor 191 and reported to the electronic controller 115 may be, for example, 40 degrees F. When the temperature inside a zone of the building reaches an uncomfortably warm level, the electronic controller 115 may open a damper to the outside and activate the air handler 130 to allow the cool outside air to be brought into the building instead of turning on an air conditioner or activating the heat pump 120 for cooling. Furthermore, the measured OAT may be used to determine whether or not any auxiliary equipment is allowed to be activated.

In accordance with an embodiment of the present invention, if the OAT is below a balance point threshold value, then any backup auxiliary heating will be used. If the OAT is below a low ambient threshold value, then cooling calls are served with the fan only. If the OAT is above a high ambient threshold value, then heating calls are served with the fan only. If the OAT is above an auxiliary heat lockout threshold value, then auxiliary heat is not allowed.

The leaving-air-temperature (LAT) sensor 192 may be used to report a temperature of the air leaving the air handler 130 to the electronic controller 115. As a result, the electronic controller 115 may use the leaving-air-temperature as another input in the process of deciding which stages to activate when a zone or zones is calling for service. That is, the system stages on thermal capacity, not just demand from one or more zones. The system does not have to wait for a thermostat to fall below or rise above a set temperature within a zone and call for more heating or cooling before reacting by changing the staging. For example, a first stage of the heat pump 120 may be used to cool zones within a house when the outside-air-temperature is around 80 degrees F. In such a scenario, the leaving-air-temperature from the air handler 130 may typically be around 70 degrees F. and does a fine job of cooling the calling zones to 74 degrees F. within a reasonable period of time. However, on a very hot day when the outside-air-temperature is above 95 degrees F., with only the first stage of the heat pump 120 activated, the leaving-air-temperature may only cool down to 75 degrees F., which is not suitable if the desired zone temperature is 74 degrees F. Therefore, under such conditions, the electronic controller 115 would detect that the leaving-air-temperature was too high and would activate both the first and second stages of the heat pump 120 in an attempt to reduce the leaving-air-temperature. Many other scenarios are possible as well which may be handled by embodiments of the present invention.

Whenever one or more of the sensed parameters (e.g., temperature, humidity), from a sensor sensing a present status of at least one of the environmental parameters, changes within a zone, or OAT or LAT changes, the electronic controller 115 may select a new staging combination which is more appropriate for the new conditions. The electronic controller 115 provides the flexibility needed to better control environmental parameters within a home, building, or other environment, for example. That is, multiple controls (functions) are built into the controller 115, eliminating the need for separate control devices. In accordance with an embodiment of the present invention, the controller 115 includes built-in controls for resistance heat lock-out capability, outdoor reset capability, outdoor temperature balance point capability, discharge temperature (LAT) controls (two independent high limits and one low limit), and selectable O/B outputs. As a result, the controller 115 could be used simply as, for example, a heat pump controller and not a zone controller. The two independent LAT high limits include a first limit for setting the maximum allowable temperature for heat-pump only operation, and a second limit for setting the maximum temperature for heat-pump plus some form of backup or auxiliary heat. The low LAT limit is for setting the minimum allowable temperature across the coil for cooling. Staging decisions are made based on these limits being exceeded or not, for example.

In general, the various methods described herein with reference to the various flow charts are performed by the electronic controller 115. The electronic controller 115 accepts various input signals, performs various logic functions and calculations based on, at least in part, those input signals, and outputs various output signals to control the various equipment of the system 100.

In accordance with another embodiment of the present invention, the zone weighting values are used only to stage the air handler 130. The staging of the heating and cooling equipment is done based on capacity and/or demand.

Figure 5B:
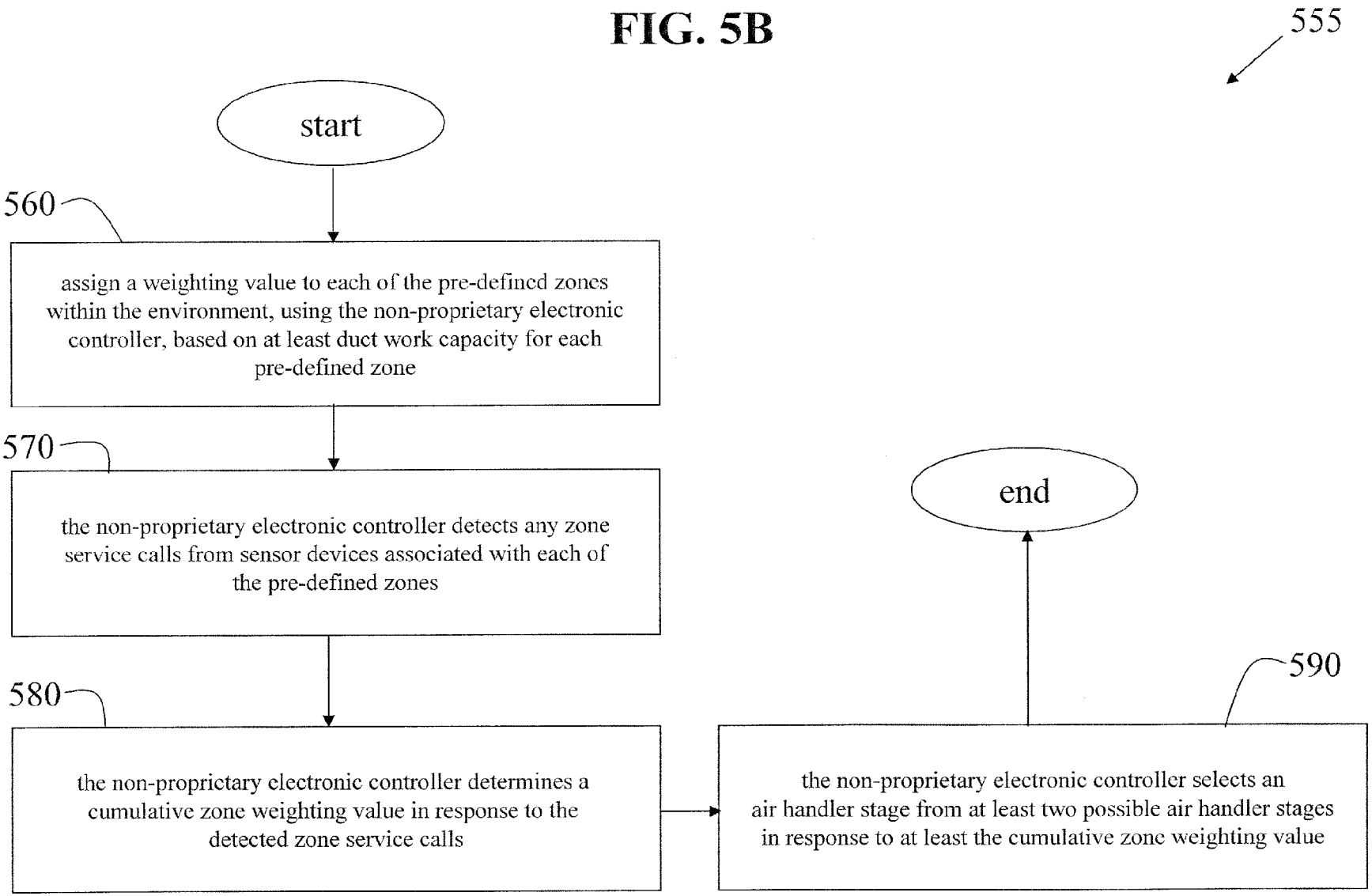
FIG. 5B illustrates a flowchart of a second embodiment of a method to control environmental parameters of pre-defined zones within a first environment using the system of FIG. 1A which includes the electronic controller of FIGS. 2A and 2B, in accordance with various aspects of the present invention.

FIG. 5B illustrates a flowchart of a second embodiment of a method 555 to control environmental parameters of pre-defined zones within a first environment using the system 100 of FIG. 1A which includes the electronic controller 115 of FIGS. 2A and 2B, in accordance with various aspects of the present invention. In step 560, a weighting value is assigned to each of the pre-defined zones within the environment, using the non-proprietary electronic controller, based on at least duct work capacity for each pre-defined zone. In step 570, the non-proprietary electronic controller detects any zone service calls from sensor devices associated with each of the pre-defined zones. In step 580, the non-proprietary electronic controller determines a cumulative zone weighting value in response to the detected zone service calls. In step 590, the non-proprietary electronic controller selects an air handler stage from at least two possible air handler stages in response to at least the cumulative zone weighting value.

For example, referring to FIG. 1, the system 100 may presently be servicing only a previous heating call from zone 1 161. The weighting of zone 1 is 35 percent and is based on the ductwork capacity associated with zone 1. The air handler weighting threshold is currently set to 50%. Since only zone 1 has called For service, the cumulative zone weighting value is 35 percent which is below the 50% threshold. As a result, the selected air handler stage is the first lower speed stage, which is adequate to handle the zone 1 heating call.

During the servicing of zone 1 161, zone 3 163 calls to the non-proprietary electronic controller 115 for heat (a new zone service call). The weighting for zone 3 is 20% and is based on the ductwork capacity associated with zone 3. Since both zone 1 and zone 3 are to be serviced, the cumulative zone weighting value is now 35%+20%, or 55%, which is above the 50% threshold. As a result, the selected air handler stage is the different second higher speed stage, which is adequate to handle the zone 1 and zone 3 heating calls. Based on the 50% threshold setting, the first lower speed stage of the air handler is no longer adequate to handle both calls. The particular equipment staging combination (e.g., staging of the heat pump 120) is selected independently of the air handler staging and zone weightings (e.g., selected based on LAT and/or OAT).

FIG. 6 is a flowchart of an exemplary embodiment of a method 600 for translating thermostat inputs to HVAC outputs based on the type of HVAC equipment being used, in accordance with various aspects of the present invention. Such a translation demonstrates the non-proprietary nature of the controller 115. In the method 600, a reversing valve output is set based on the type of HVAC equipment being used. In accordance with an embodiment of the present invention, the electronic controller 115 performs the translation.

FIG. 7 is a flowchart of an exemplary embodiment of a method 700 for translating thermostat inputs to electronic controller inputs based on zone, in accordance with various aspects of the present invention. Such a translation demonstrates the non-proprietary nature of the controller 115. The method 700 determines which inputs the electronic controller 115 looks for from the zone 1 thermostat.

FIGS. 8*a*-8*b* show exemplary embodiments of setting options that may be displayed to an operator of the electronic controller 115 via the display device 230, in accordance with various aspects of the present invention. For example, the weighting values associated with each zone (e.g., zones 1-4) may be selected in 10% increments for each zone from anywhere between 10% to 90% inclusive. Other setting options than those shown in FIGS. 8*a*-8*b* are possible as well, in accordance with alternative embodiments of the present invention.

Figure 9A:
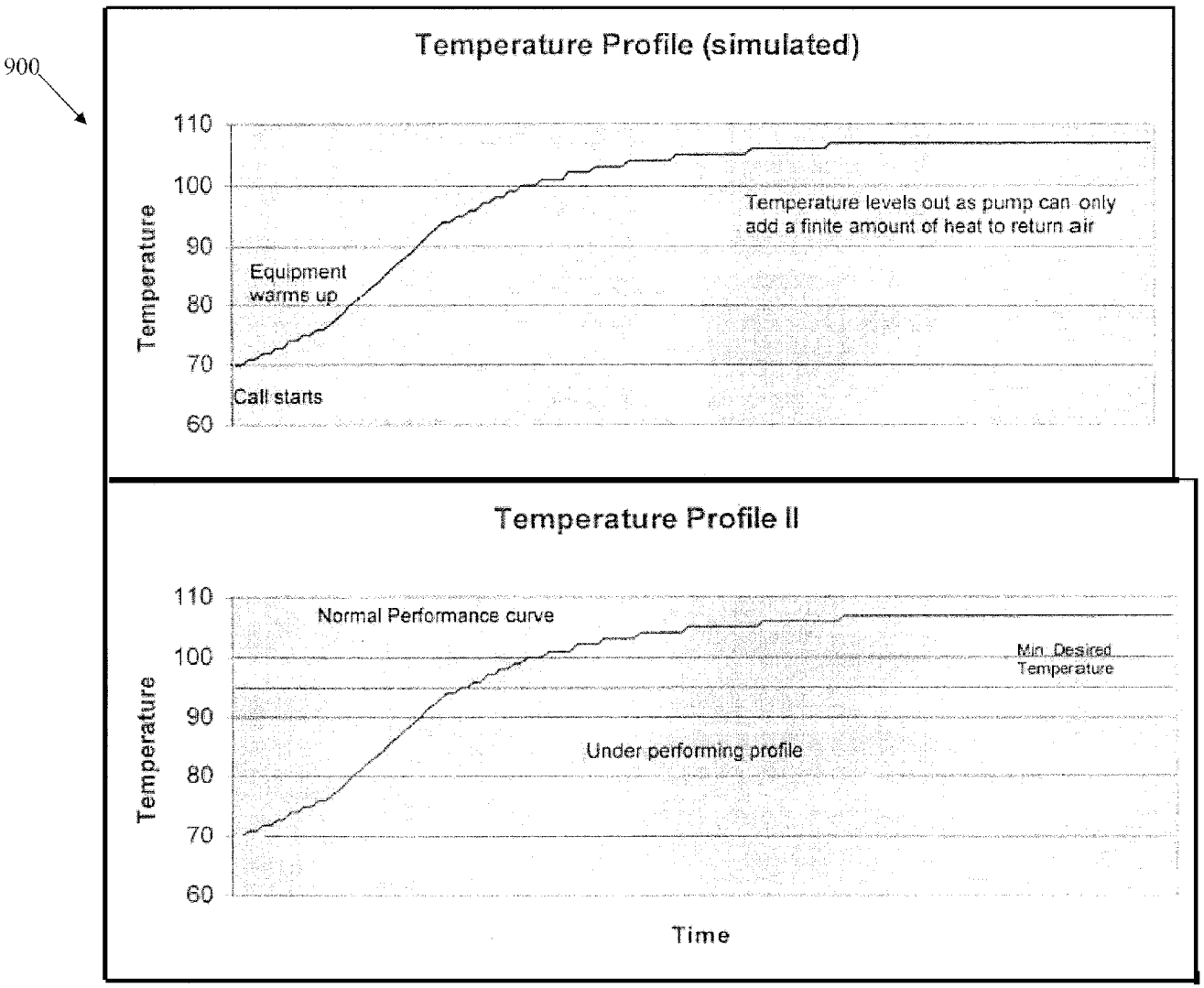
FIG. 9A illustrates graphs of heating temperature profiles, in accordance with an embodiment of the present invention.

FIG. 9A illustrates graphs of heating temperature profiles 900, in accordance with an embodiment of the present invention. Once a sensor (e.g., a thermostat) calls for heat, the equipment (e.g., heat pump) is activated and begins to warm tip. The leaving air temperature (LAT) increases and then levels off at some point. The change in LAT over a given unit of time is defined as ΔT. In accordance with an embodiment of the present invention, the LAT sensor 192 is used to determine ΔT. ΔT indicates the change in temperature from one unit of time to the next and indicates whether or not the heat pump is keeping up with demand. In accordance with an embodiment of the present invention, ΔT is the basis of all equipment staging decisions. That is, the system stages, at least in part, based on thermal capacity.

ΔT starts out small as the coil and condenser of the heat pump start to work. Then ΔT increases as the equipment gets up to speed. Finally, ΔT decreases and eventually goes to zero as the temperature levels out. In accordance with an embodiment of the present invention, ΔT is used as a flag for making staging decisions. That is, the system stages, at least in part, based on thermal capacity. It is typically known, apriori, how the equipment has been designed to operate with respect to equipment profiles. Therefore, a decision can be made as to when the current operating mode of the equipment is sufficient or when heating capacity should be increased. A minimum desired temperature is also known. If ΔT goes to zero but is still below the desired temperature, then the equipment is not generating enough heat to get the job done. As a result, the equipment will be upstaged to provide the additional heat. In accordance with an embodiment of the present invention, the electronic controller 115 checks to ensure that ΔT starts out with a strong magnitude to prove that the heat pump is operating.

Figure 9B:
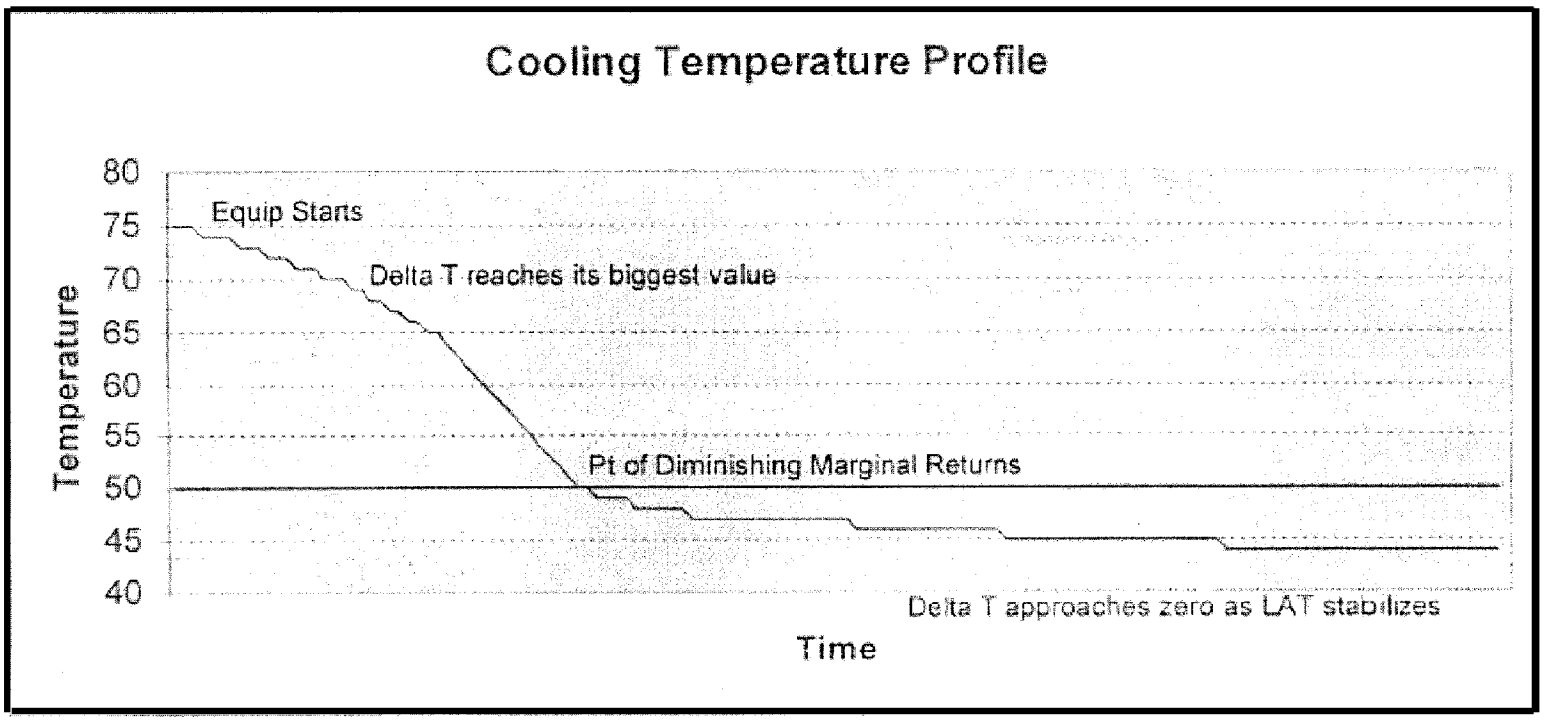
FIG. 9B illustrates a graph of a cooling temperature profile, in accordance with an embodiment of the present invention.

FIG. 9B illustrates a graph of a cooling temperature profile 910, in accordance with an embodiment of the present invention. Cooling works in a similar manner to heating, except in the opposite direction. As the coolant reaches its most efficient speed for heat transfer, the temperature starts to fall more quickly. Therefore |ΔT| reaches its highest point. Once the temperature profile proceeds below the point of diminishing marginal returns, the |ΔT| starts to decrease. As the equipment continues to run and remove all the heat it can, the leaving air temperature (SAT) reading stabilizes and ΔT becomes very close to zero. Such temperature characteristics may be monitored and used to stage at the appropriate time (i.e., staging based on thermal capacity).

Figure 10A:
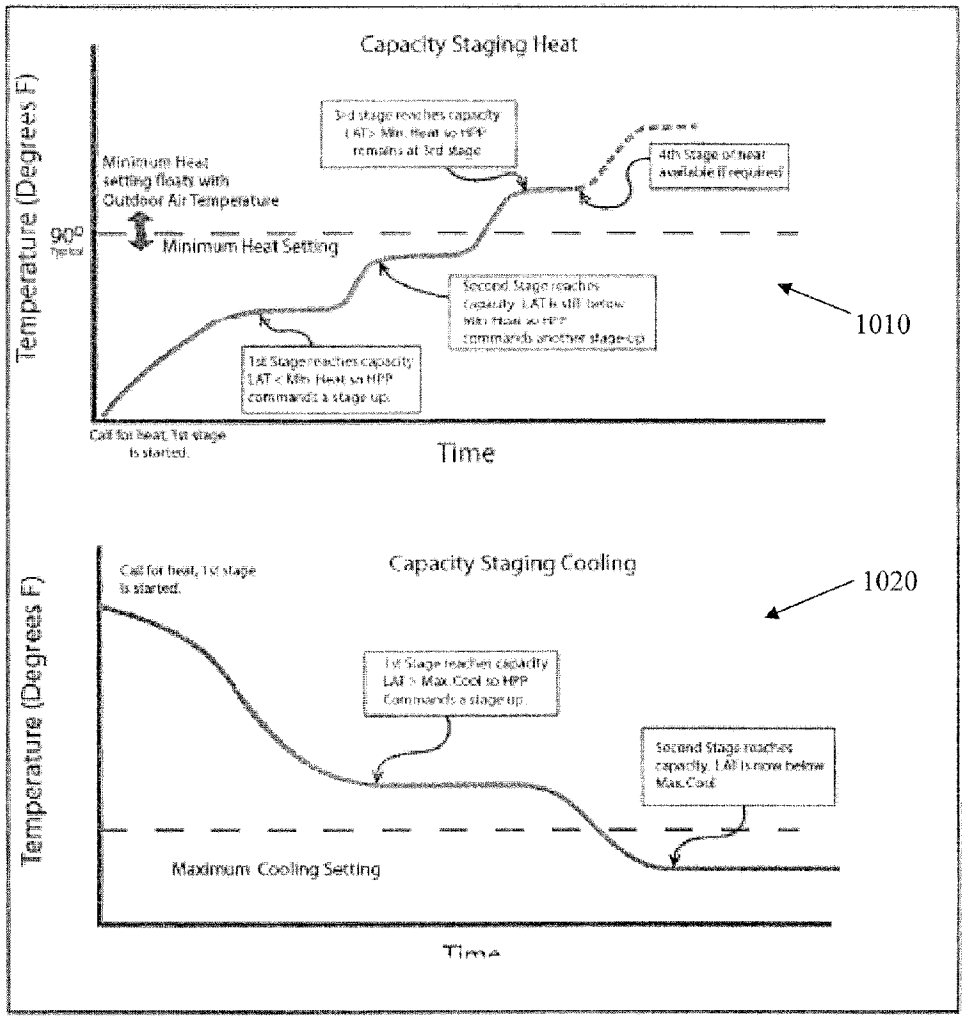
FIG. 10A illustrates two exemplary graphs of temperature vs. time for heating capacity staging and cooling capacity staging, in accordance with an embodiment of the present invention.

In accordance with an embodiment of the present invention, the system 100 provides four stages for heating and two stages for cooling. FIG. 10A illustrates two exemplary graphs 1010 and 1020 of temperature vs. time for heating capacity staging and cooling capacity staging. The two graphs of FIG. 10A illustrate how capacity is staged Up for heating or cooling if needed, in accordance with an embodiment of the present invention.

Figure 10B:
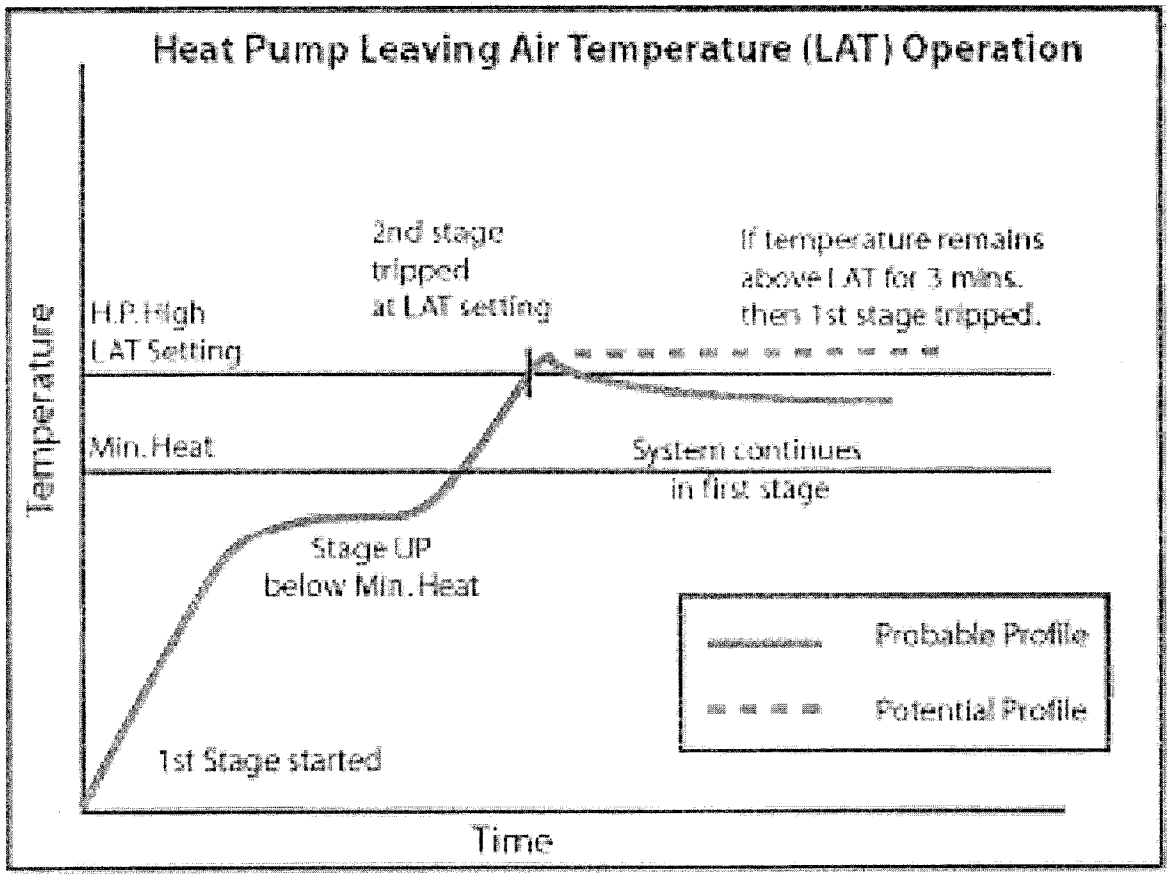
FIG. 10B is a graph that illustrates staging up for heating with only a two-stage heat pump, in accordance with an embodiment of the present invention.
Figure 10C:
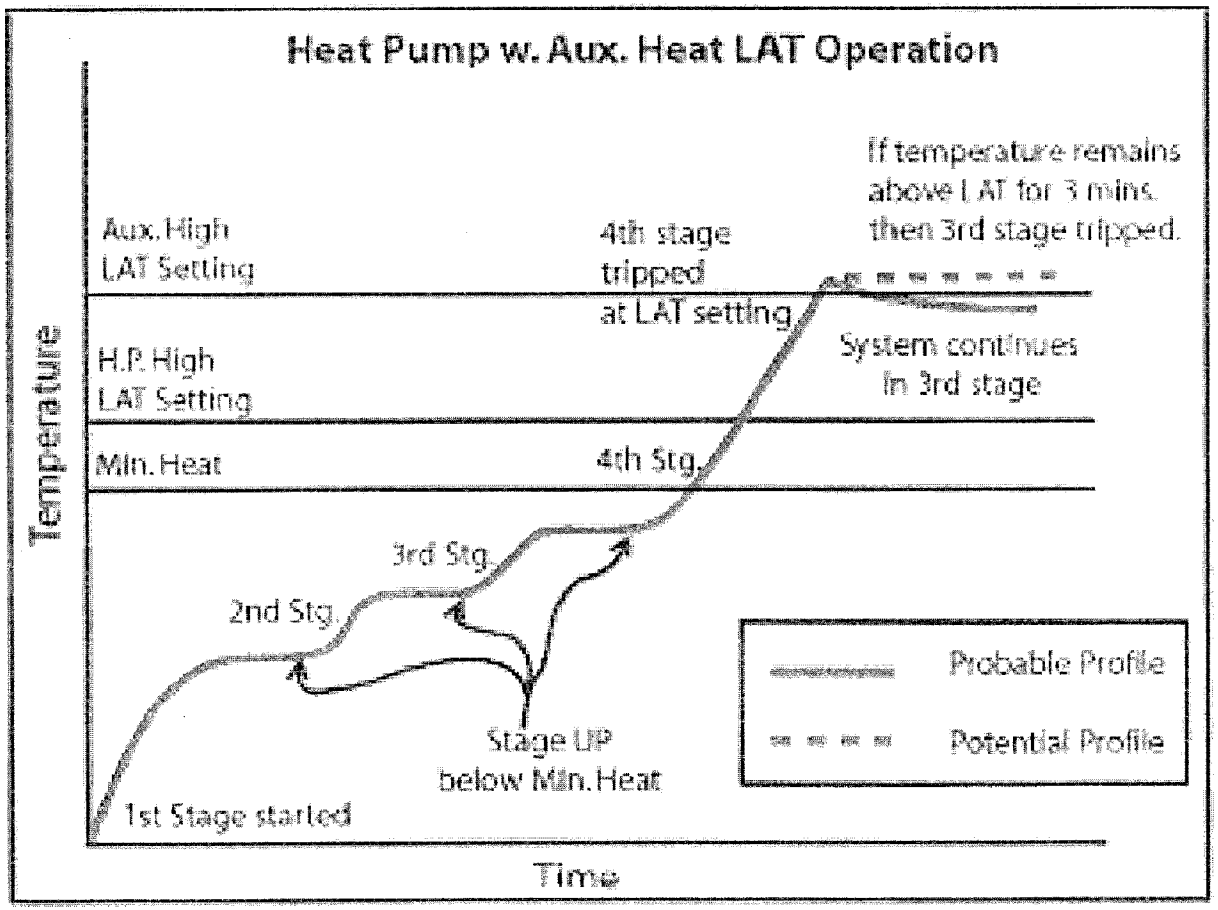
FIG. 10C is a graph that illustrates staging up for heating with a heat pump and auxiliary heat available, allowing four stages of heating, in accordance with an embodiment of the present invention.
Figure 10D:
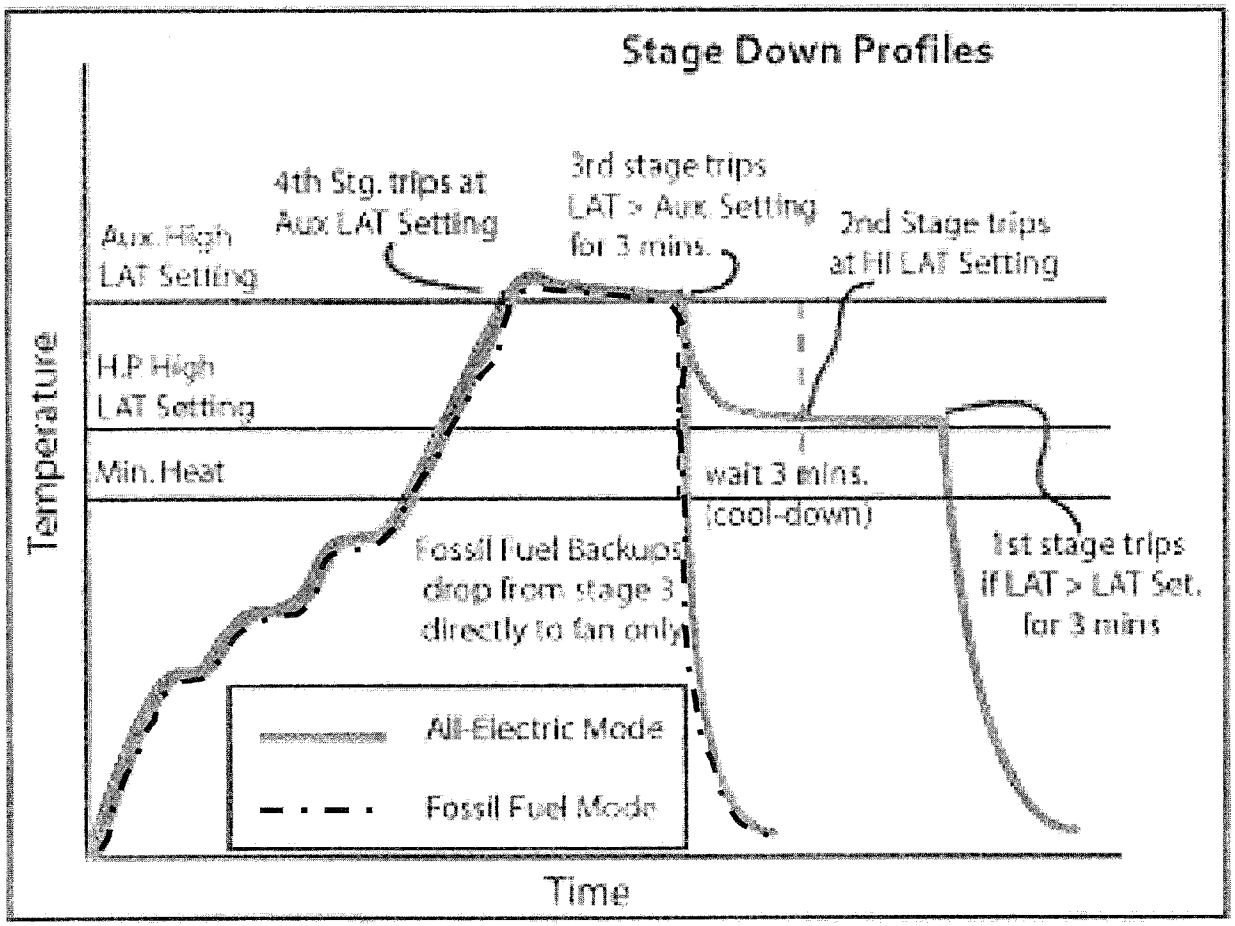
FIG. 10D is a graph that illustrates two staging down profiles, one for an all-electric mode and one for a fossil fuel mode, in accordance with an embodiment of the present invention.

FIGS. 10B-10D illustrate the basic operation of the system 100 with respect to leaving air temperature (LAT), in accordance with an embodiment of the present invention. The graph 1030 of FIG. 10B illustrates staging up for heating with only a two-stage heat pump. The graph 1040 of FIG. 10C illustrates staging tip for heating with a heat pump and auxiliary heat available, allowing four stages of heating. The graph 1050 of FIG. 10D illustrates two staging down profiles, one for an all-electric mode and one for a fossil fuel mode.

Figure 11A:
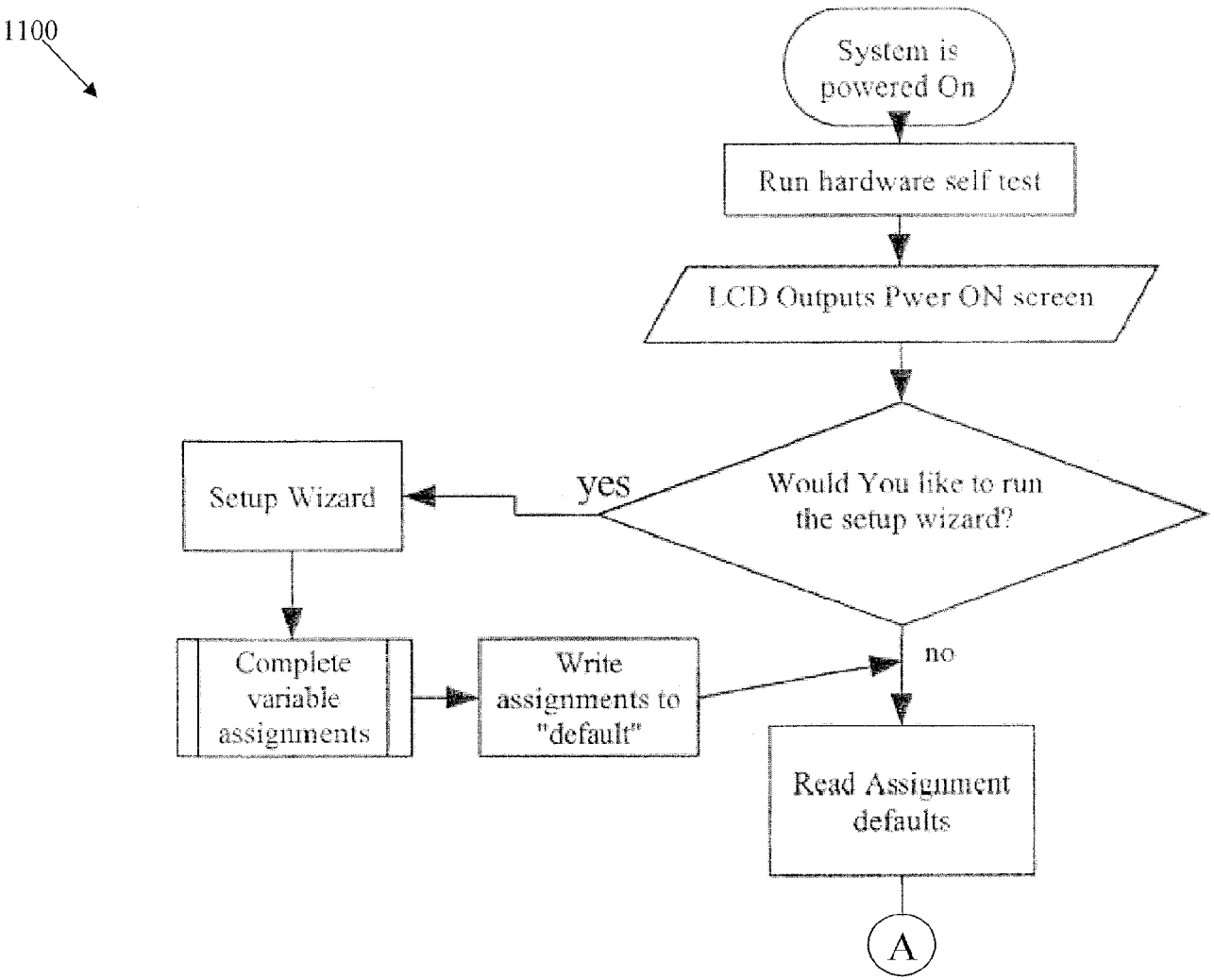
FIGS. 11*a*-11*b* illustrate a flowchart of an exemplary embodiment of a method of general system operation of the system of FIG. 1A, in accordance with various aspects of the present invention.
Figure 11B:
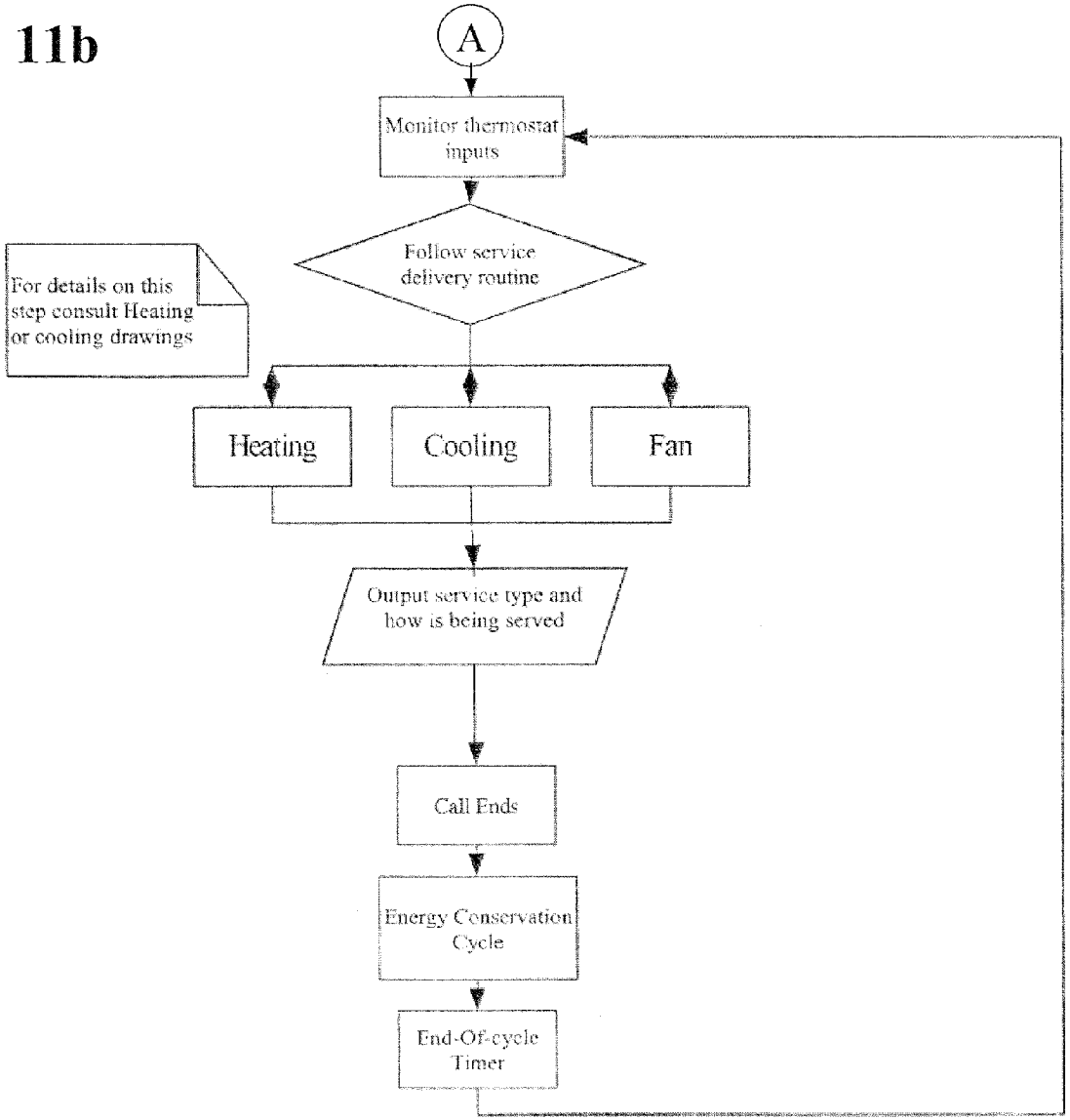

FIGS. 11*a*-11*b* illustrate a flowchart of an exemplary embodiment of a method 1100 of general system operation of the system 100, in accordance with various aspects of the present invention. The method 1100 includes running a "Setup Wizard" which includes selecting the various setting options displayed to an operator on the display device 230. The method 1100 also includes monitoring sensor (e.g., a thermostat and/or a humidistat) inputs and selecting an appropriate service routine to run (e.g., heating, cooling, fan-only).

In general, the electronic controller 115 monitors the progress of the heating or cooling process and adjusts the staging to produce enough heat transfer to get the job done in an efficient manner while minimizing airflow when only small zones are calling. ΔT is the difference between two temperature readings over a given time increment and is the basis for monitoring system performance. In accordance with an embodiment of the present invention, when the electronic controller 115 starts to service a call, the electronic controller 115 will wait approximately one minute and then start to take temperature readings (LAT readings). The electronic controller 115 averages enough readings to effectively filter out any anomalous readings.

The process is monitored in three ways, in accordance with an embodiment of the present invention. First, the rate at which the temperature is rising or falling during the initial heating or cooling process is monitored. Second, the final temperature is recorded when ΔT decreases to nearly zero. The final recorded temperature value should be above (for heating) or below (for cooling) a minimum setting which should feel comfortable to end users. Third, if ΔT changes from a positive value to a negative value, then this means that the heat pump, for example, is not keeping up with demand and the thermostat will soon start to move away from setpoint rather than toward it. ΔT is monitored to see if it chances sign and this information is also used to decide whether or not to stage up.

The decision to stage up is checked against the cumulative zone weighting value. If the cumulative zone weighting value does not exceed a zone weight threshold, the staging up is delayed until the LAT has drifted 5 degrees F. below (for heating) or above (for cooling) the minimum heat or maximum cooling settings. The decision to stage up is also checked against the OAT, in accordance with an embodiment of the present invention. For heating, if the OAT is above 45 degrees F., for example, then the system is not allowed to stage up until the LAT has drifted 5 degrees F. below the minimum heat settings. For cooling, if the OAT is below 75 degrees F., then the system is not allowed to stage up until the LAT has drifted 5 degrees F. above the maximum cooling settings.

Figure 12A:
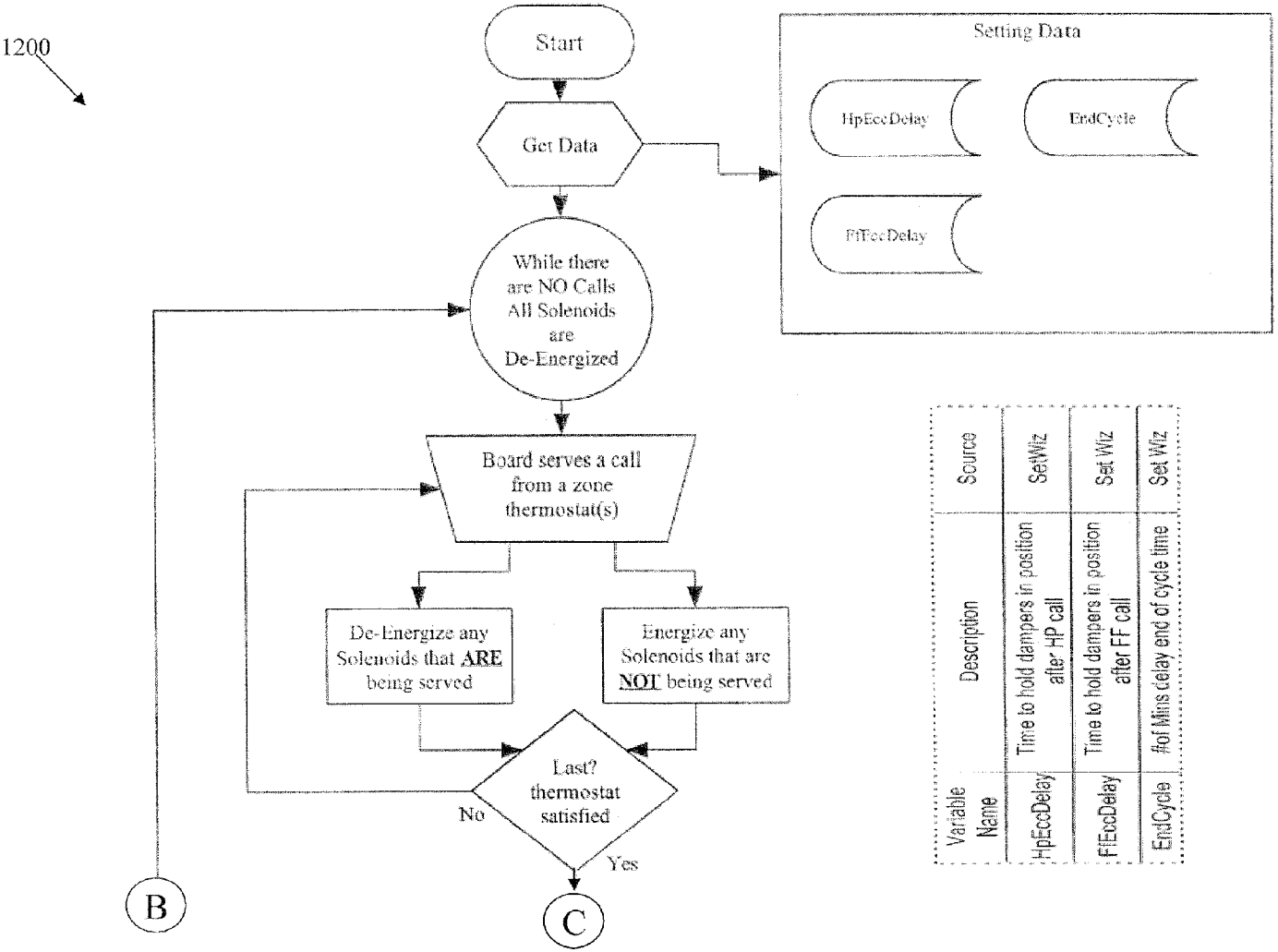
FIGS. 12*a*-12*b* illustrate a flowchart of an exemplary embodiment of a method of solenoid operation on the control panel of the system of FIG. 1A, in accordance with various aspects of the present invention.
Figure 12B:
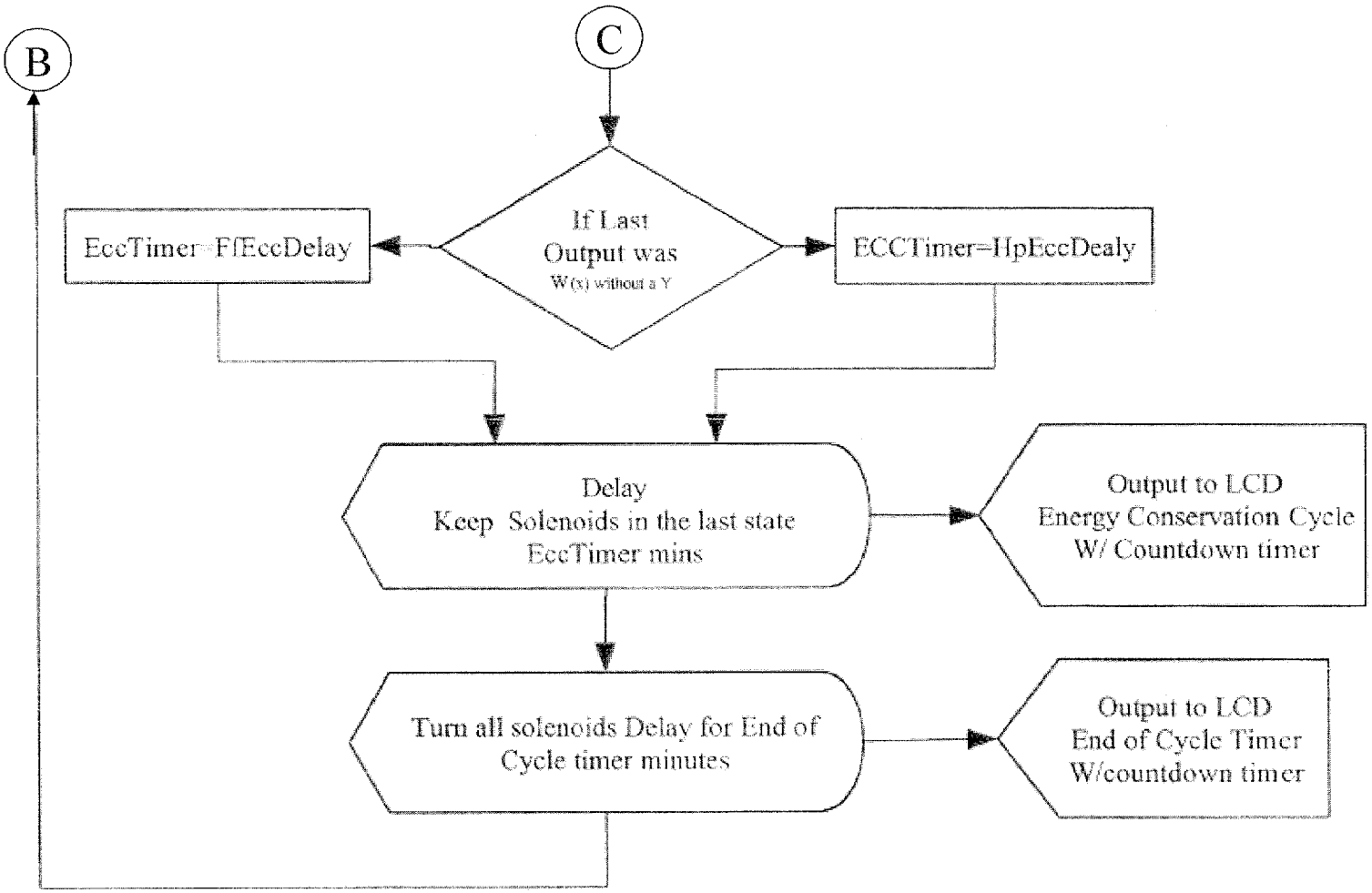

FIGS. 12*a*-12*b* illustrate a flowchart of an exemplary embodiment of a method 1200 of solenoid operation on the control panel 110 of the system 100, in accordance with various aspects of the present invention. In accordance with an embodiment of the present invention, the solenoids of the control panel 110 are controlled by 24 VDC. The electronic controller 115 provides sufficient power to drive six solenoids. Solenoids which are used to open and close air dampers are High (24 VDC) when the dampers are to be closed and Low (0 VDC) when the dampers are to be opened. When the electronic controller 115 is idle, all solenoids are off (0 VDC).

Figure 13A:
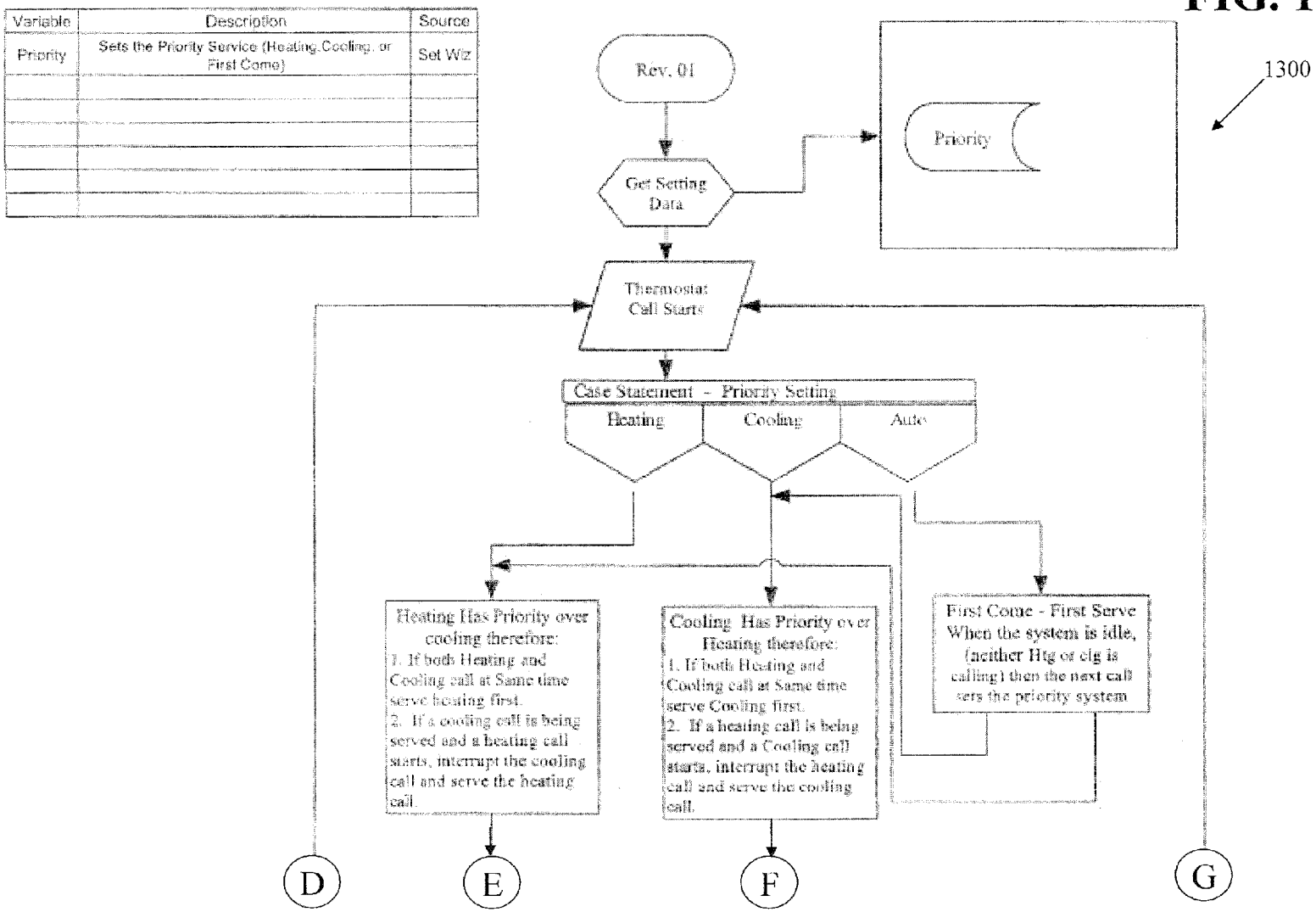
FIGS. 13*a*-13*b* illustrate a flowchart of an exemplary embodiment of a method of a priority select function, in accordance with various aspects of the present invention.
Figure 13B:
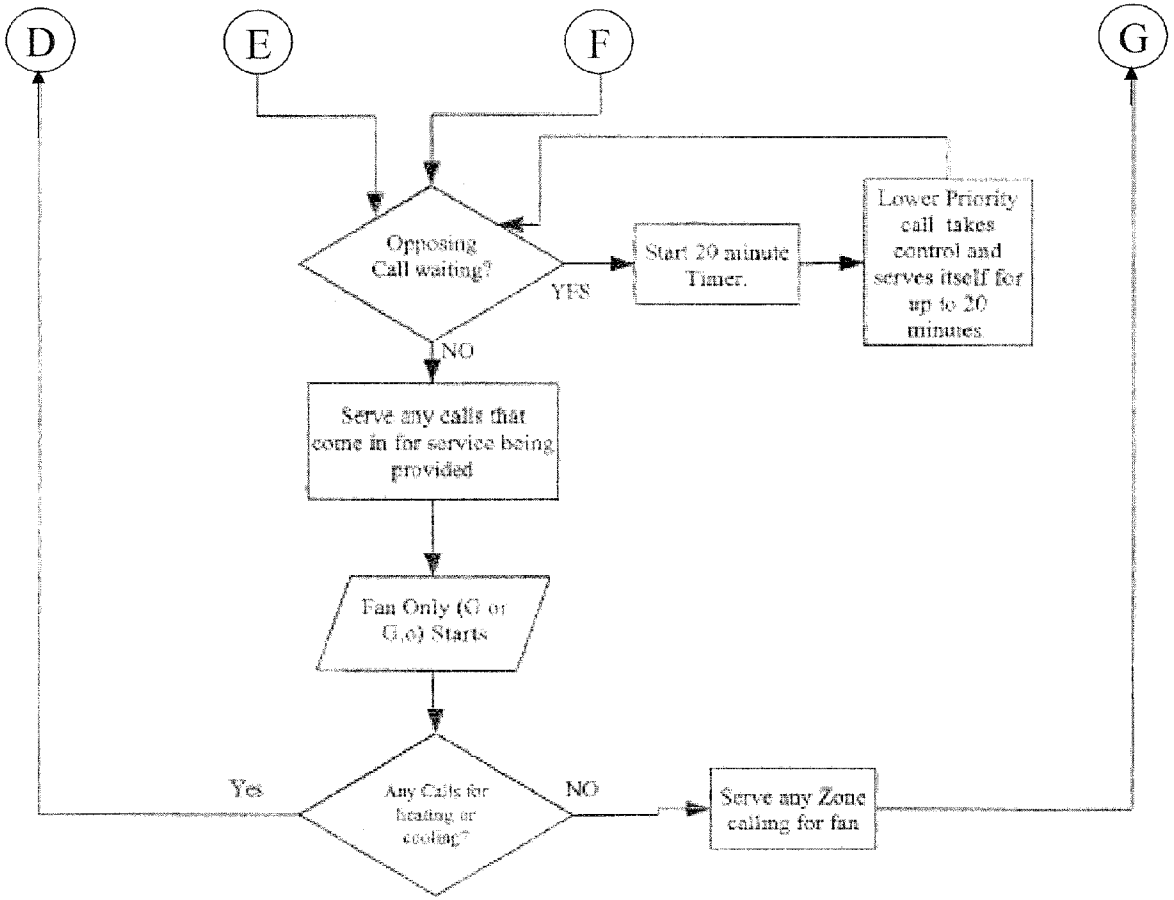

FIGS. 13*a*-13*b* illustrate a flowchart of an exemplary embodiment of a method 1300 of a priority select function, in accordance with various aspects of the present invention. The priority select function determines the priority given to heating, cooling, and fan-only calls based on the current circumstances (e.g., current zone service calls). For example, when "heating" has priority, heating calls have priority over cooling and fan calls. Heating calls interrupt any lower priority calls and a purge cycle commences immediately (as described later herein). Upon completion of the purge cycle, the electronic controller 115 serves the heating call. Any other zone that calls for heating may have it. When "cooling" has priority, cooling calls have priority over heating and fan calls. Cooling calls interrupt any lower priority calls and the purge cycle commences immediately. Upon completion of the purge cycle, the electronic controller serves the cooling call. Any other zone that calls for cooling may have it. In the "Auto" or "First Come, First Served" mode, the call (either heating or cooling) currently being served has priority over any other calls. The current call is not interrupted. The fan is always a lower priority than heating or cooling. In accordance with an embodiment of the present invention, if a non-priority call (heating or cooling) waits for 20 minutes, this call will take control and serve itself for up to 20 minutes. This is to preclude orphan zones (i.e., some zones never being served).

Figure 14A:
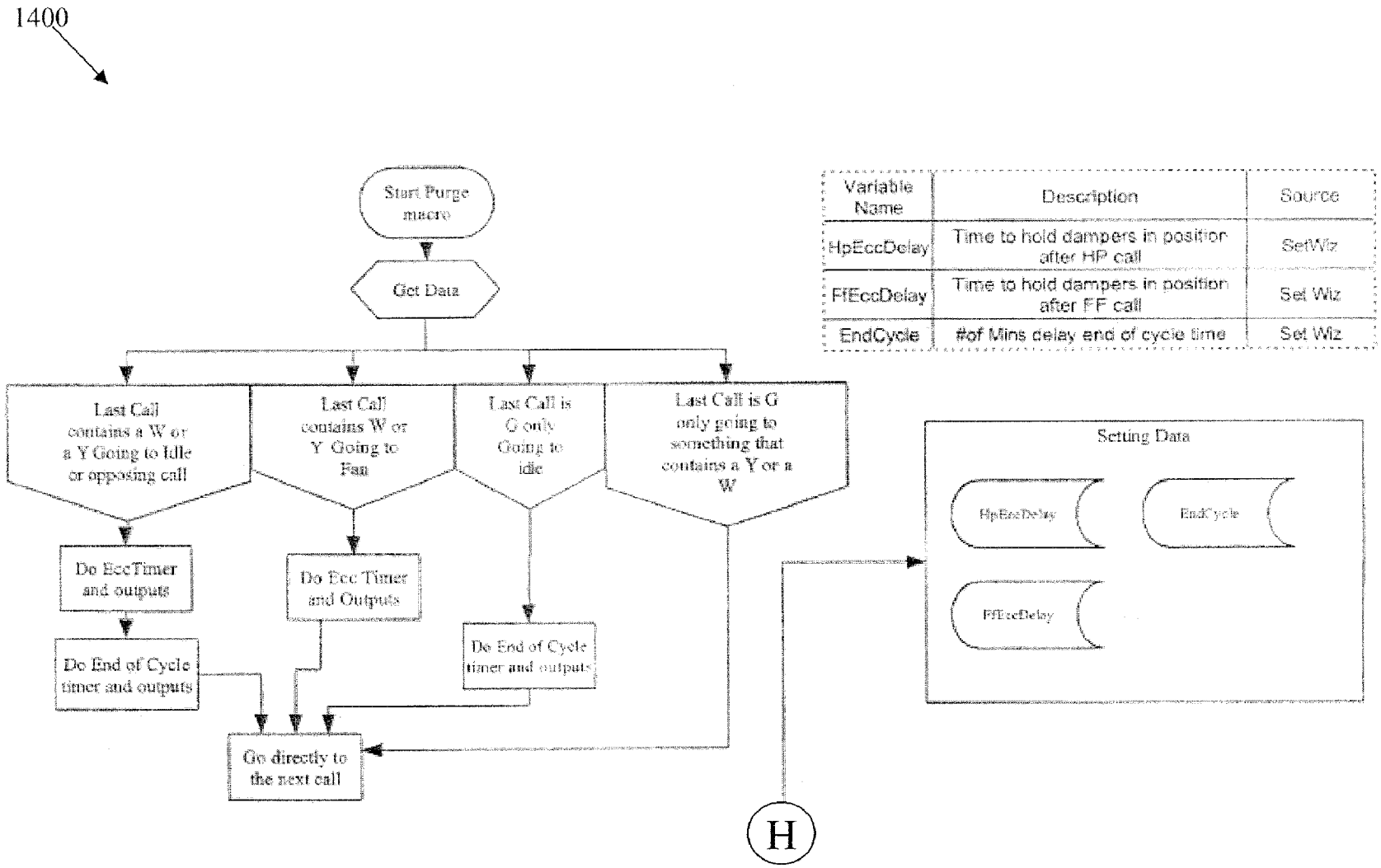
FIGS. 14*a*-14*c* illustrate flowcharts of an exemplary embodiment of methods for performing end of cycle purges, in accordance with various aspects of the present invention.
Figure 14B:
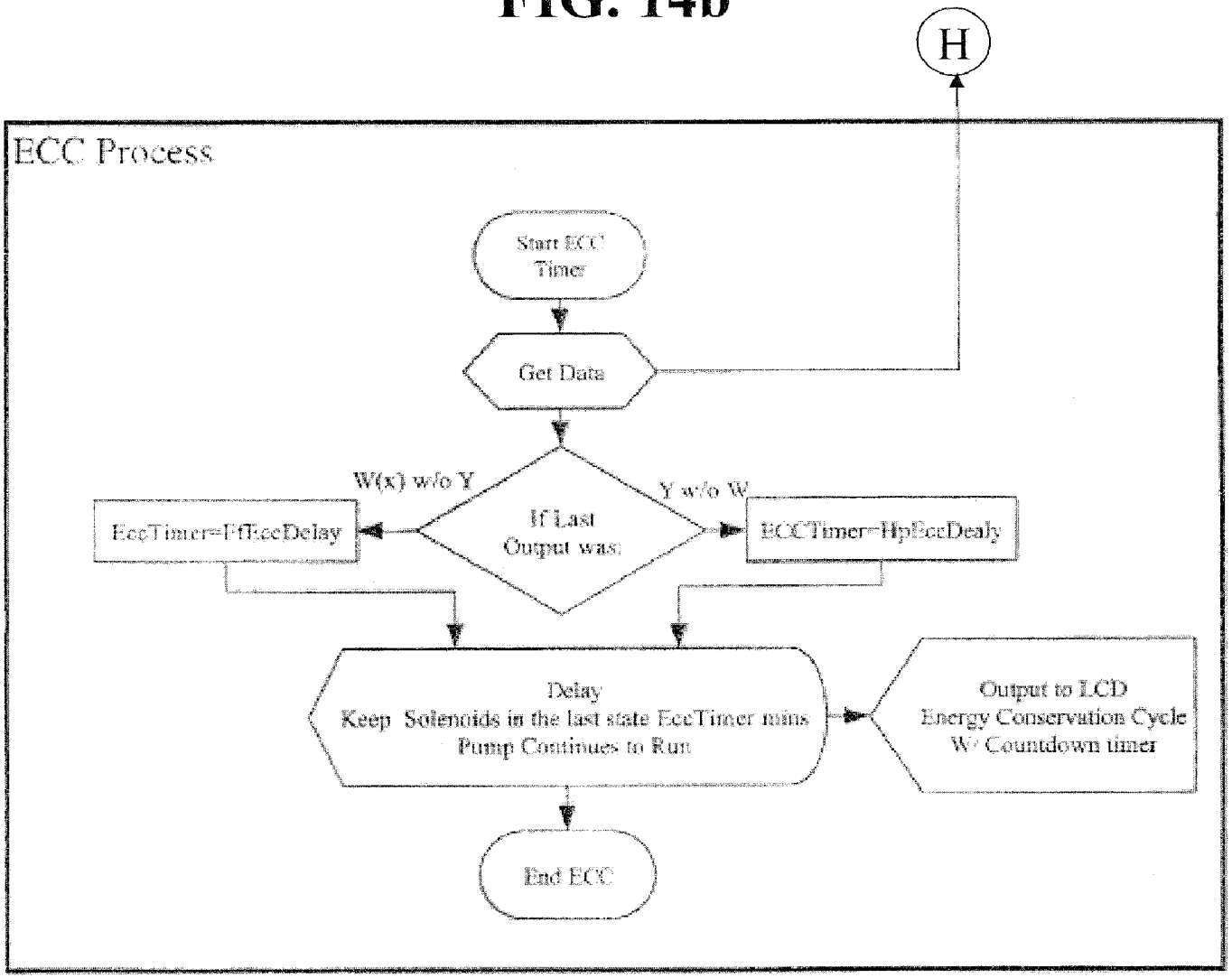
Figure 14C:
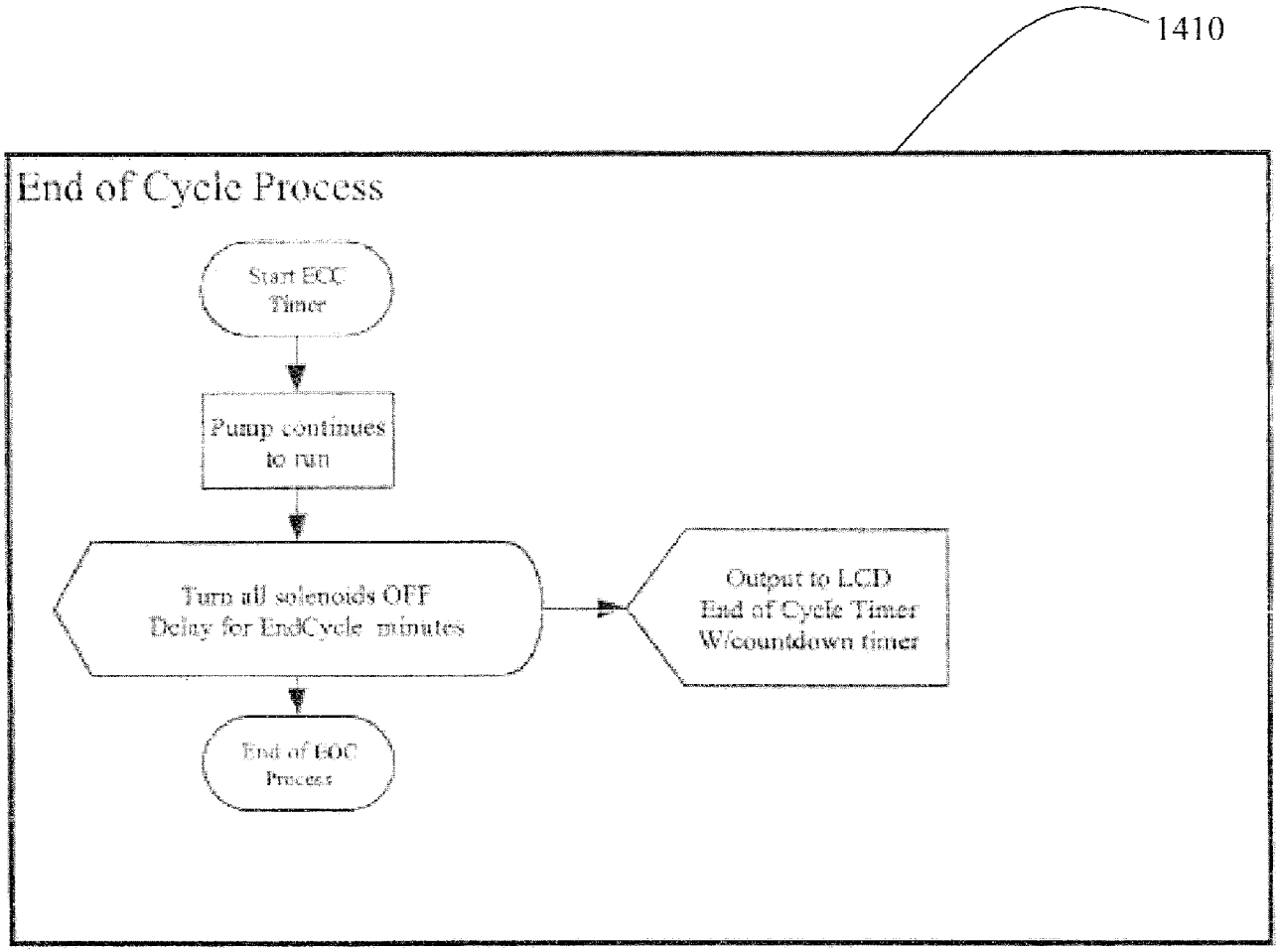

FIGS. 14*a*-14*c* illustrate flowcharts of an exemplary embodiment of methods 1400 and 1410 for performing end of cycle purges, in accordance with various aspects of the present invention. At the end of calls which contain a "Y" (primary heating/cooling source), turn off all solenoids and run the air pump device 170 for one minute. Then run the pre-cycle timer for a length of time previously set up by the operator. At the end of calls that contain a "W" (auxiliary heating/cooling source), hold the dampers in position for two minutes, then turn off all of the solenoids and run the air pump device 170 for the duration of the End-of-Cycle timer. The End-of-Cycle time is the amount of time that the air pump device 170 will run at the conclusion of a call and any purge cycle to open the dampers in preparation for the next call and is adjustable for zero to three minutes. If there is a fan call waiting, allow the fan to continue running during the post-purge and any end-of-cycle damper timing.

Figure 15A:
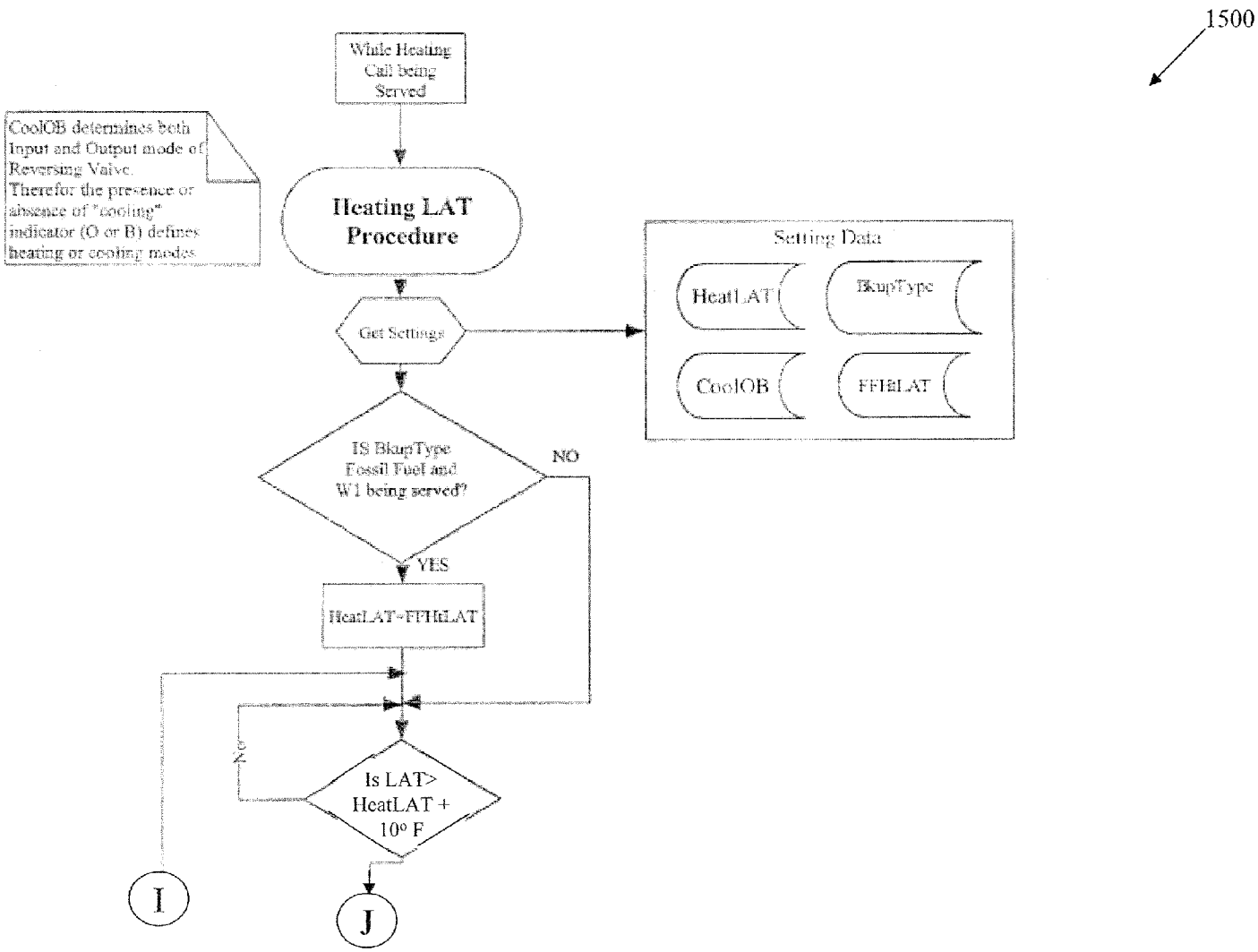
FIGS. 15*a*-15*c* illustrate a flowchart of an exemplary embodiment of a method for performing a heating LAT procedure, in accordance with various aspects of the present invention.
Figure 15B:
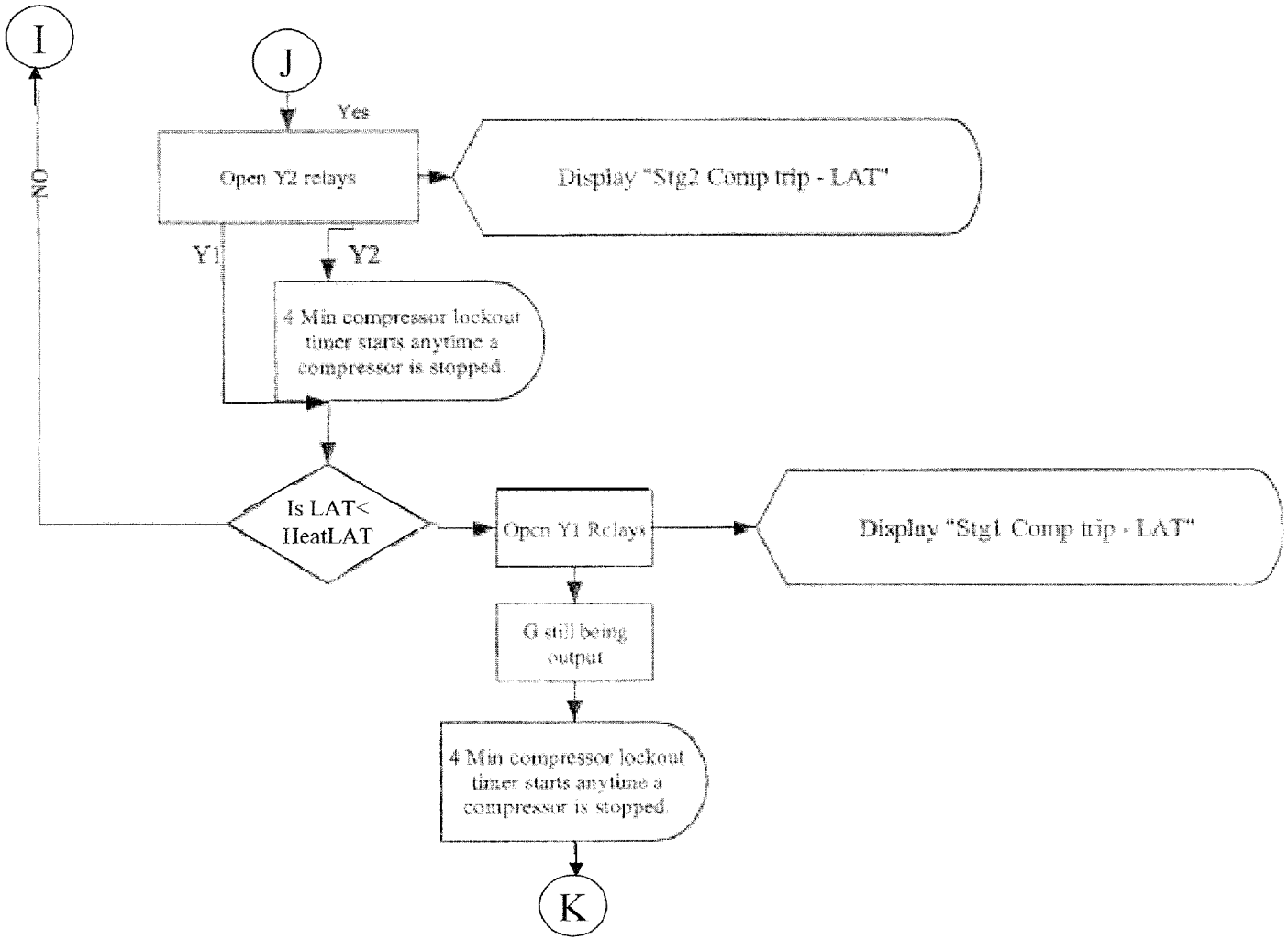
Figure 15C:
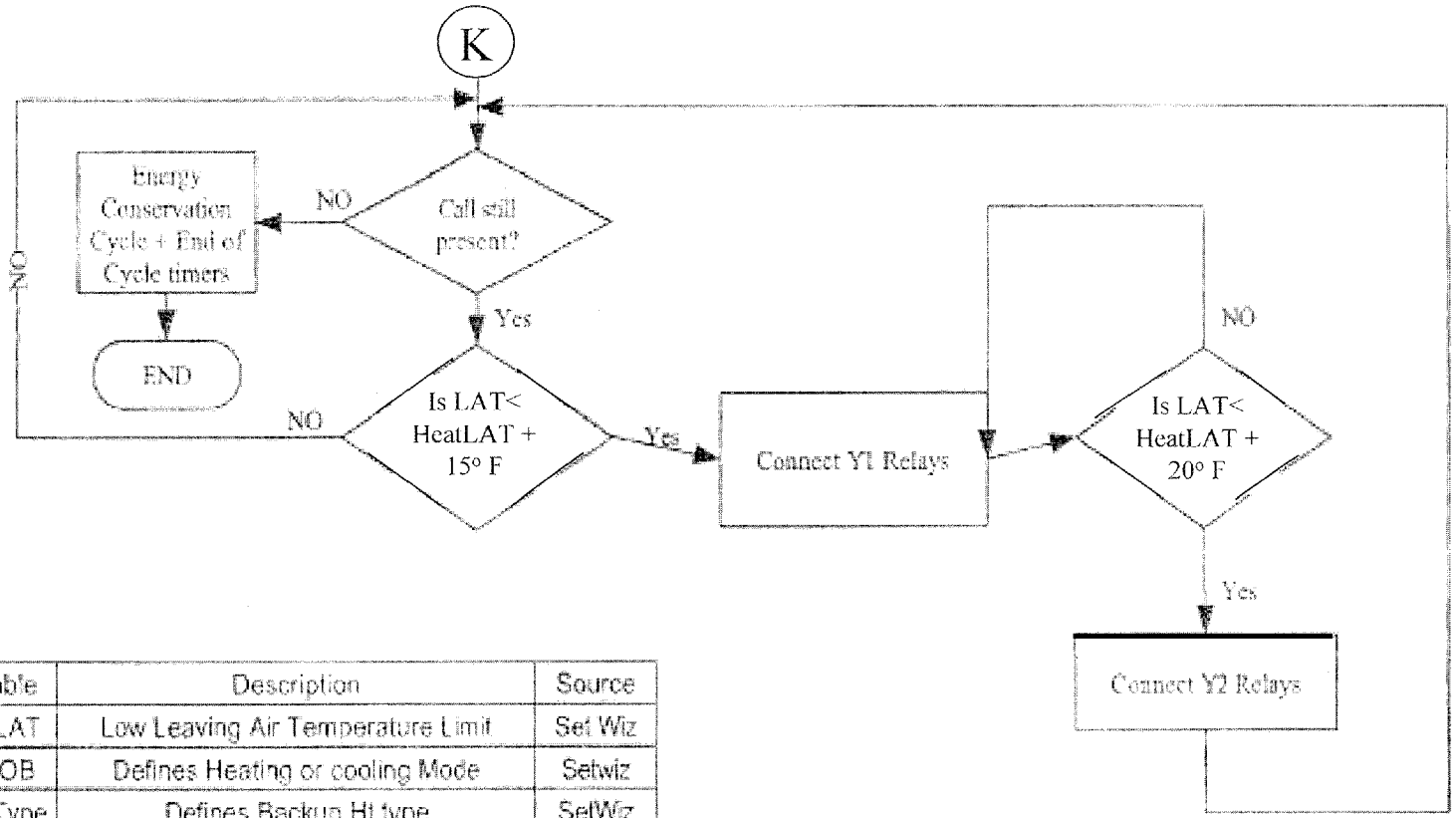

FIGS. 15*a*-15*c* illustrate a flowchart of an exemplary embodiment of a method 1500 for performing a heating LAT procedure, in accordance with various aspects of the present invention. While in the heating mode with the heat pump being served, if the LAT rises above the heating LAT setting minus 10 degrees F., then open the relays associated with Y2(hp) second stage signal to the condenser, and Y2(ah) second stage signal to the furnace/air handler. Also, if the LAT rises above the heating LAT setting, then open the relays associated with Y1(hp) first stage signal to the condenser, and Y1(ah) first stage signal to the furnace/air handler. While in the heating mode with auxiliary equipment (e.g., a furnace) being served, if the LAT rises above the heating LAT setting minus 10 degrees F., then open the relay associated with the W2 second stage auxiliary or backup heat. Also, if the LAT rises above the heating LAT setting, then open the relay associated with the W1 first stage auxiliary or backup heat. The method 1500 is part of the heating method 2300 of FIGS. 23*a*-23*c*.

Figure 16:
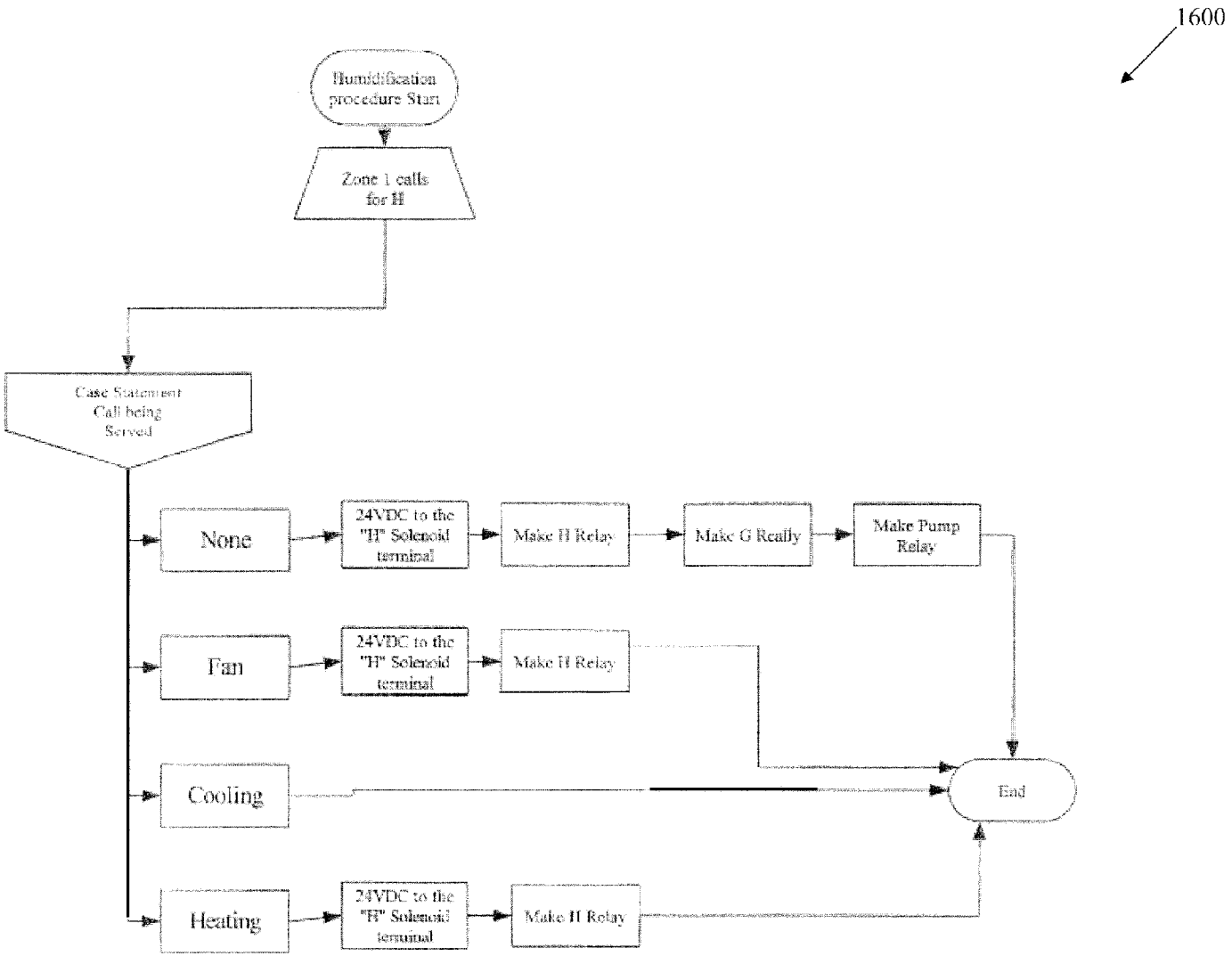
FIG. 16 illustrates a flowchart of an exemplary embodiment of a method for performing a humidification procedure, in accordance with various aspects of the present invention.

FIG. 16 illustrates a flowchart of an exemplary embodiment of a method 1600 for performing a humidification procedure, in accordance with various aspects of the present invention. In accordance with an embodiment of the present invention, zone 1 will have an "H" terminal on the electronic controller 115 for humidification calls which is for powered humidifiers. Any time there is an "H" call, it will pass directly to the "H" output relay regardless of anything else that is happening on the electronic controller 115. There is also an "H" 24 VDS terminal that goes hot when the "H" output terminal goes hot. This allows humidify calls to be handled from any source. A DC terminal provides for a humidifier damper and also provides a flexible built-in auxiliary relay for use in custom operations sequences.

In accordance with an embodiment of the present invention, an automatic humidification mode is provided. A humidifier is integrated into the HVAC system (i.e., the indoor air quality comfort system) such that a damper is automatically opened when the controller 115 receives a humidification call. An additional solenoid is provided on the control panel 110 to operate the damper via the controller 115 (e.g., see the wiring of solenoid 199 in FIG. 1C). The humidifier is typically located, for example, on the forced air system (e.g., at a furnace) and the damper is located between the humidifier and the ductwork to the forced air system. The open damper allows humidified air to pass into the forced air system such that the humidified air may be distributed to calling zones. The non-proprietary electronic controller automatically closes the humidifier damper when servicing of the zone associated with the humidification zone service call is complete. In this way, a home owner does not have to remember to manually open the damper in the Winter and close the damper in the Spring, for example.

For a de-humidification call, if the electronic controller 115 is currently serving a cooling call, then the electronic controller will turn off the highest stage of the air handler 130. If the electronic controller is idle (not presently serving a call), then when a de-humidification call is received, the electronic controller 115 will activate a first cooling stage of the heat pump 120 and a first stage of the air handler 130 with all dampers open and run for X minutes on and X minutes off where X is pre-defined during setup. In general, the humidity in the air may be decreased by slowing down the fan speed of the air handler 130 on a call for dehumidification from a thermidistat or other humidity monitoring controls. By slowing down the fan, the air is given more contact time with the coil allowing more water to be condensed out of the air.

Figure 17:
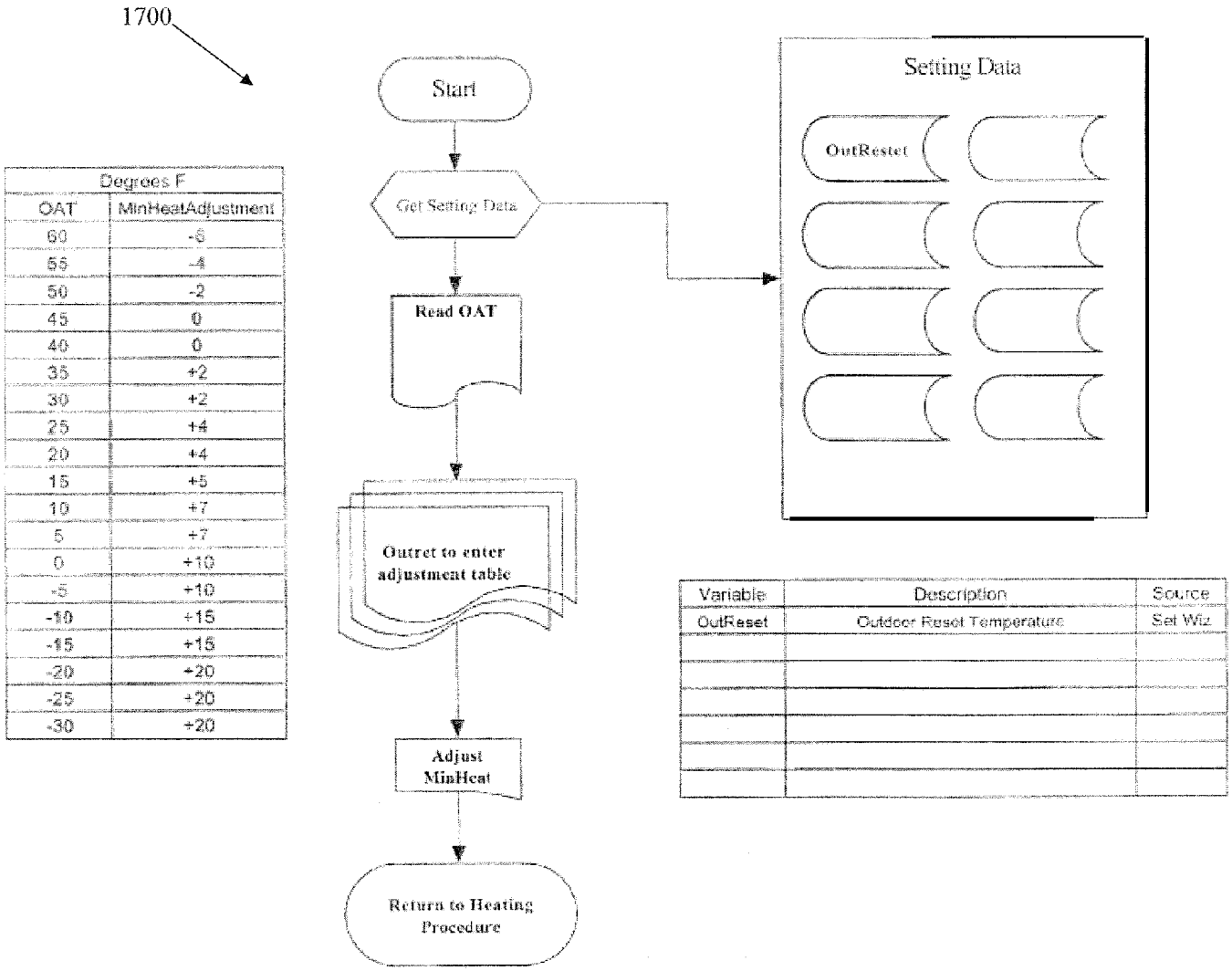
FIG. 17 illustrates a flowchart of an exemplary embodiment of a method for performing outside reset calculations, in accordance with various aspects of the present invention.
Figure 18:
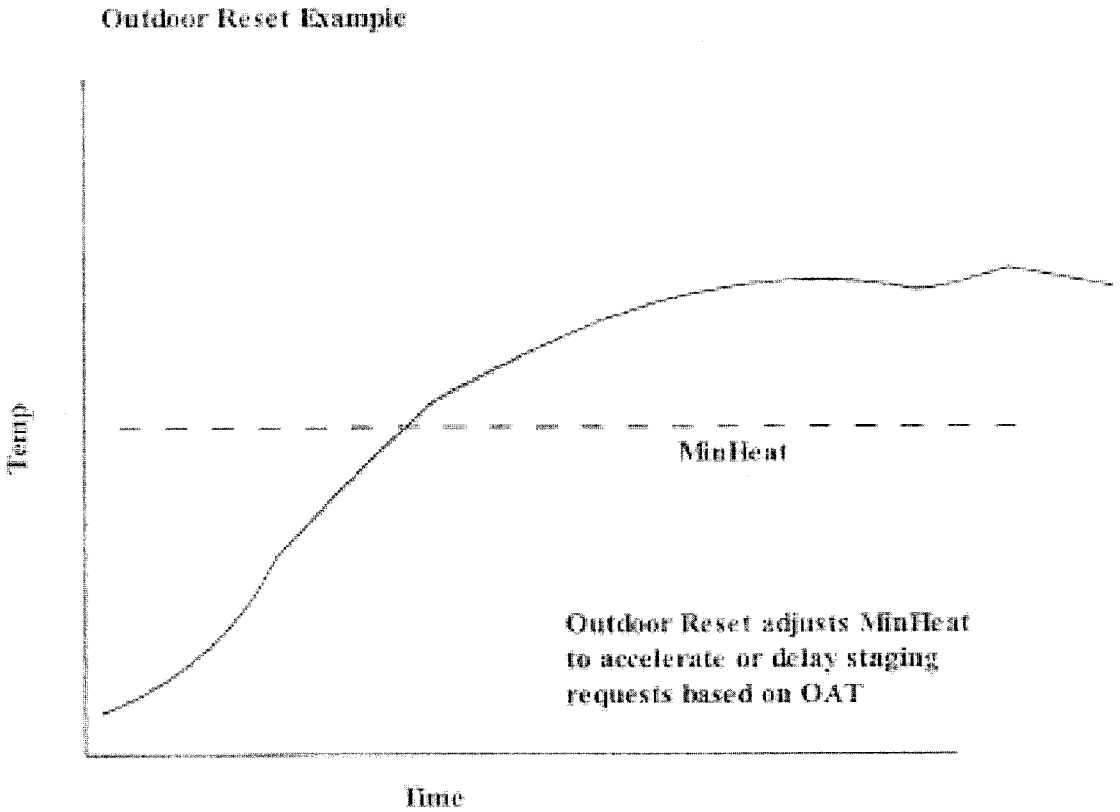
FIG. 18 illustrates a graph of an outdoor reset example using the method of FIG. 17, in accordance with an embodiment of the present invention.

FIG. 17 illustrates a flowchart of an exemplary embodiment of a method 1700 for performing outside reset calculations, in accordance with various aspects of the present invention. The outside reset method 1700 adjusts a minimum heat threshold to accelerate or delay staging requests based on OAT (outside air temperature). FIG. 18 illustrates a graph 1800 of an outdoor reset example using the method 1700 of FIG. 17, in accordance with an embodiment of the present invention.

Figure 19:
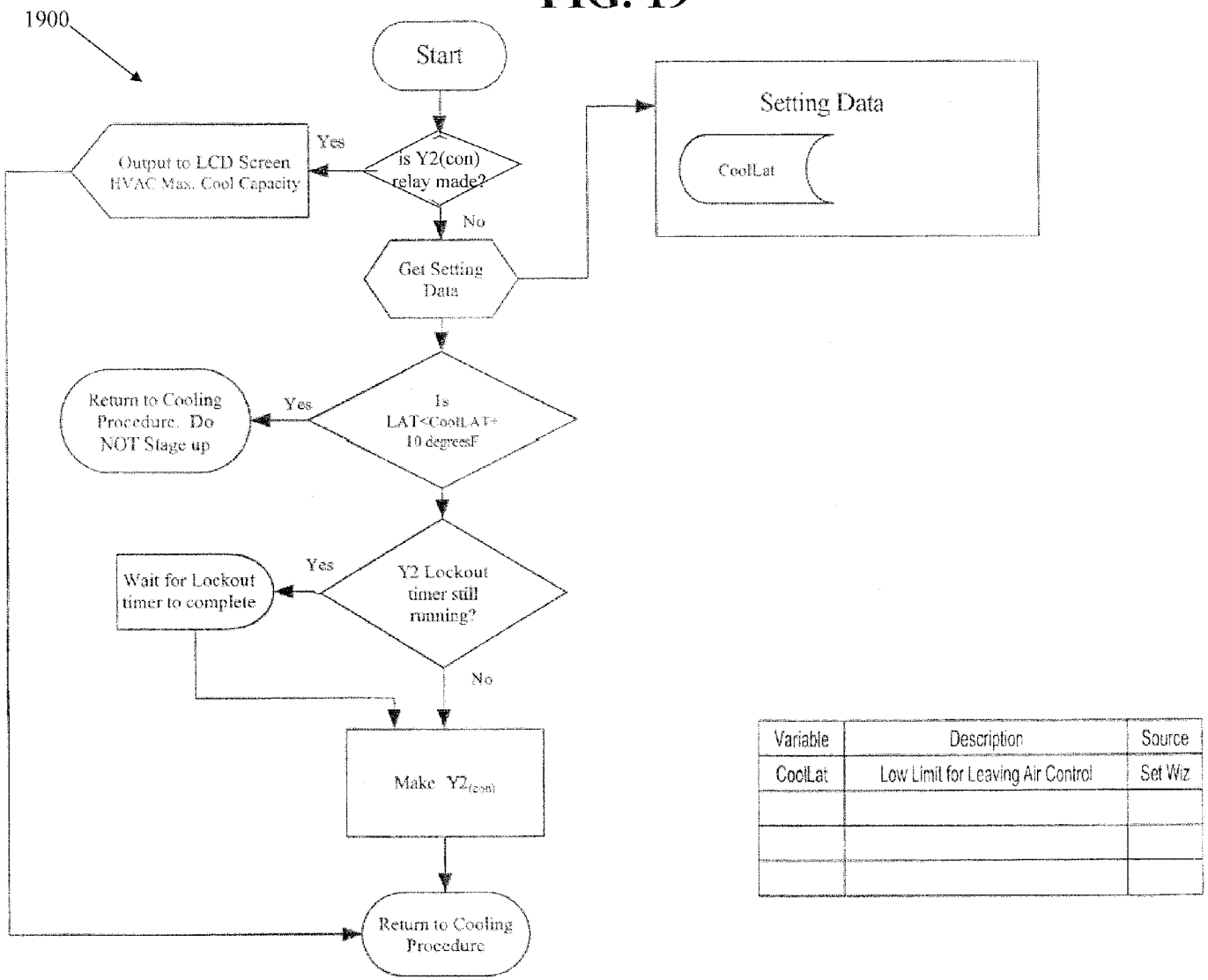
FIG. 19 illustrates a flowchart of an exemplary embodiment of a method for performing a cooling stage-up procedure, in accordance with various aspects of the present invention.

FIG. 19 illustrates a flowchart of an exemplary embodiment of a method 1900 for performing a cooling stage-tip procedure, in accordance with various aspects of the present invention. The method 1900 checks for current stage operation and compares LAT to a threshold value to determine whether or not to stage up during a cooling cycle. The cooling stage-up procedure is a part of the cooling procedure of FIGS. 20*a*-20*b*.

Figure 20A:
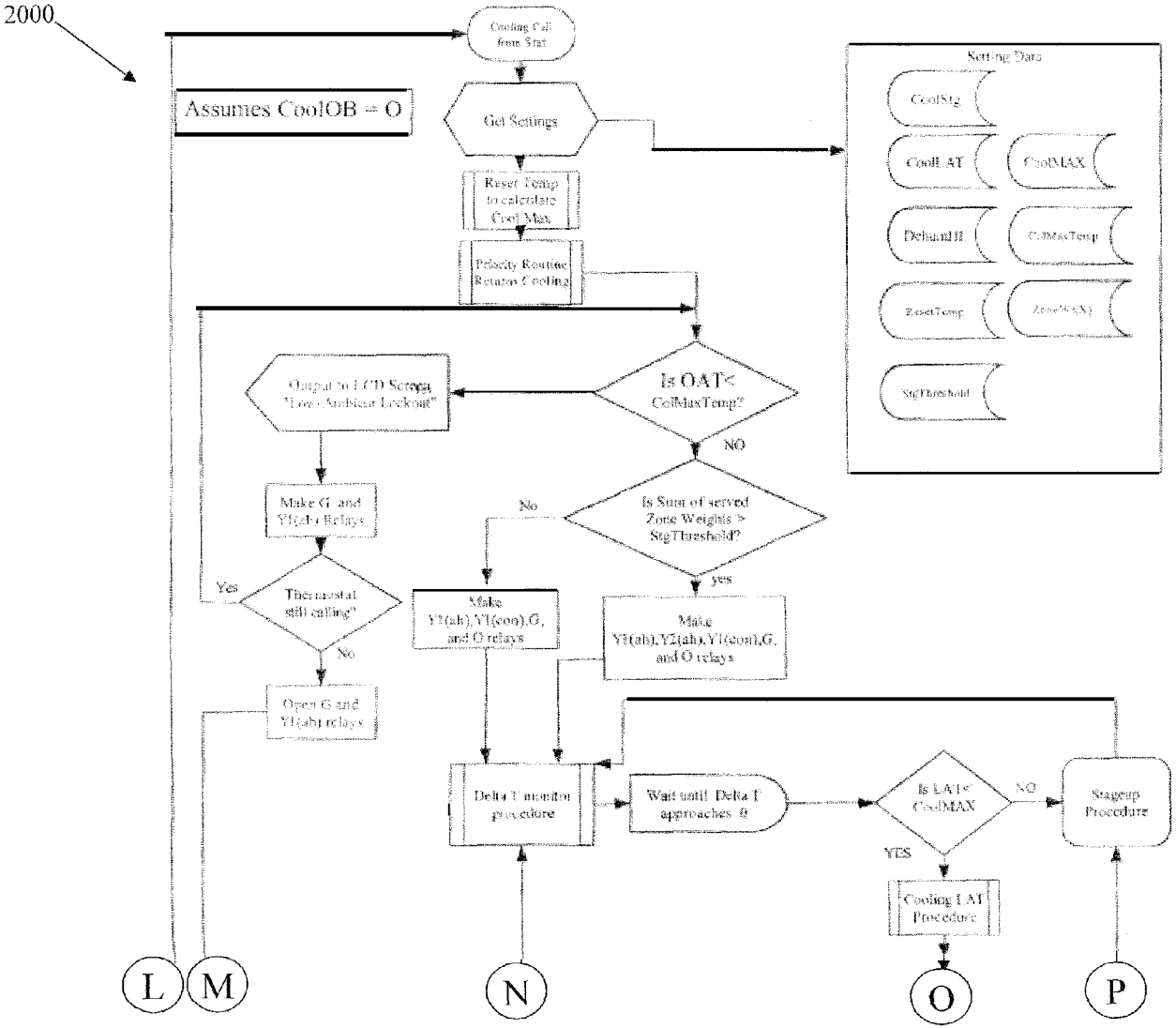
FIGS. 20*a*-20*b* illustrate a flowchart of an exemplary embodiment of a method for performing a cooling procedure, in accordance with various aspects of the present invention.
Figure 20B:
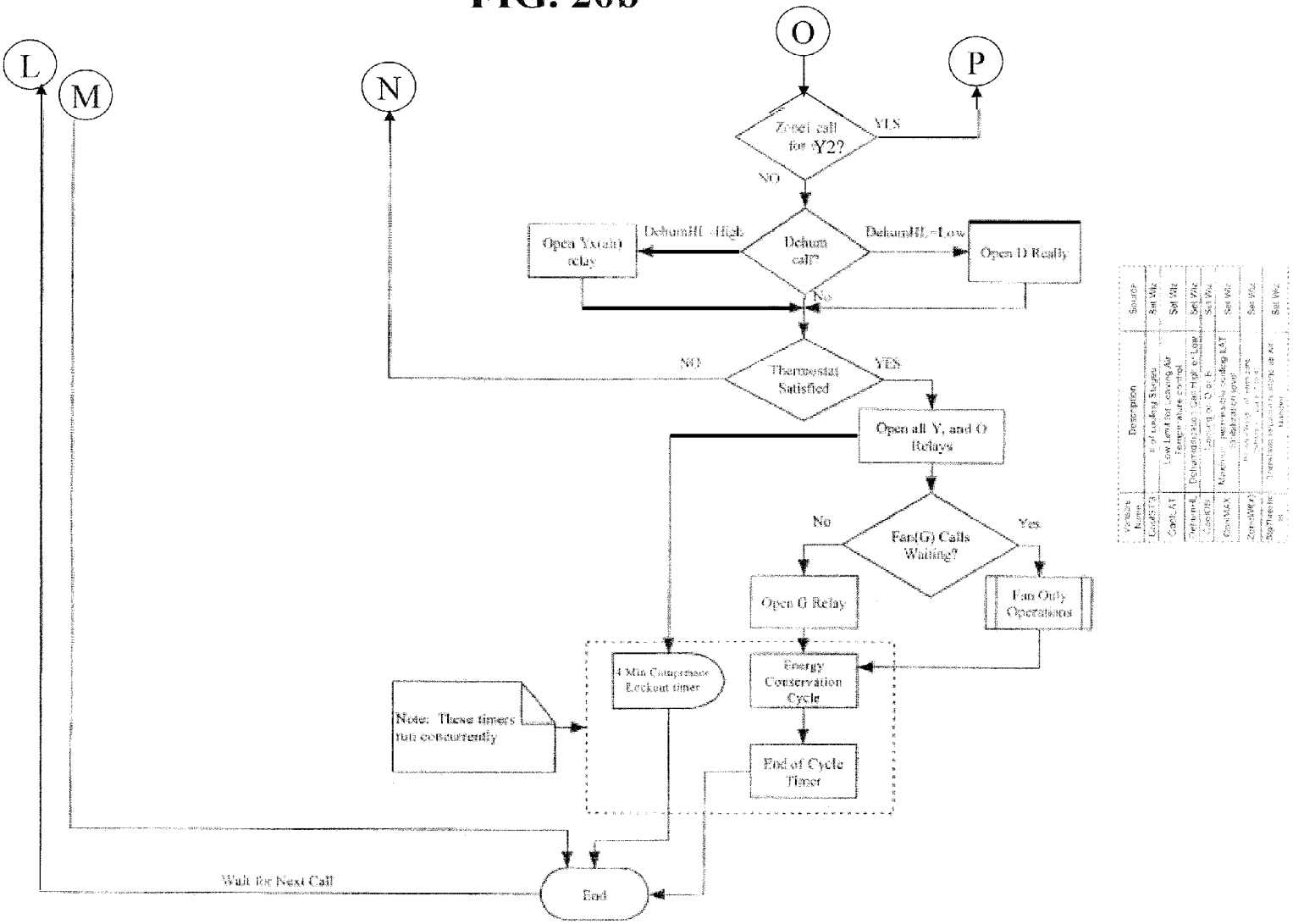

FIGS. 20*a*-20*b* illustrate a flowchart of an exemplary embodiment of a method 2000 for performing a cooling procedure, in accordance with various aspects of the present invention. The method 2000 takes into account OAT, LAT, ΔT, zone service calls, the cumulative weighting value, and other parameters as part of providing cooling to the calling zones in an efficient manner.

Figure 21A:
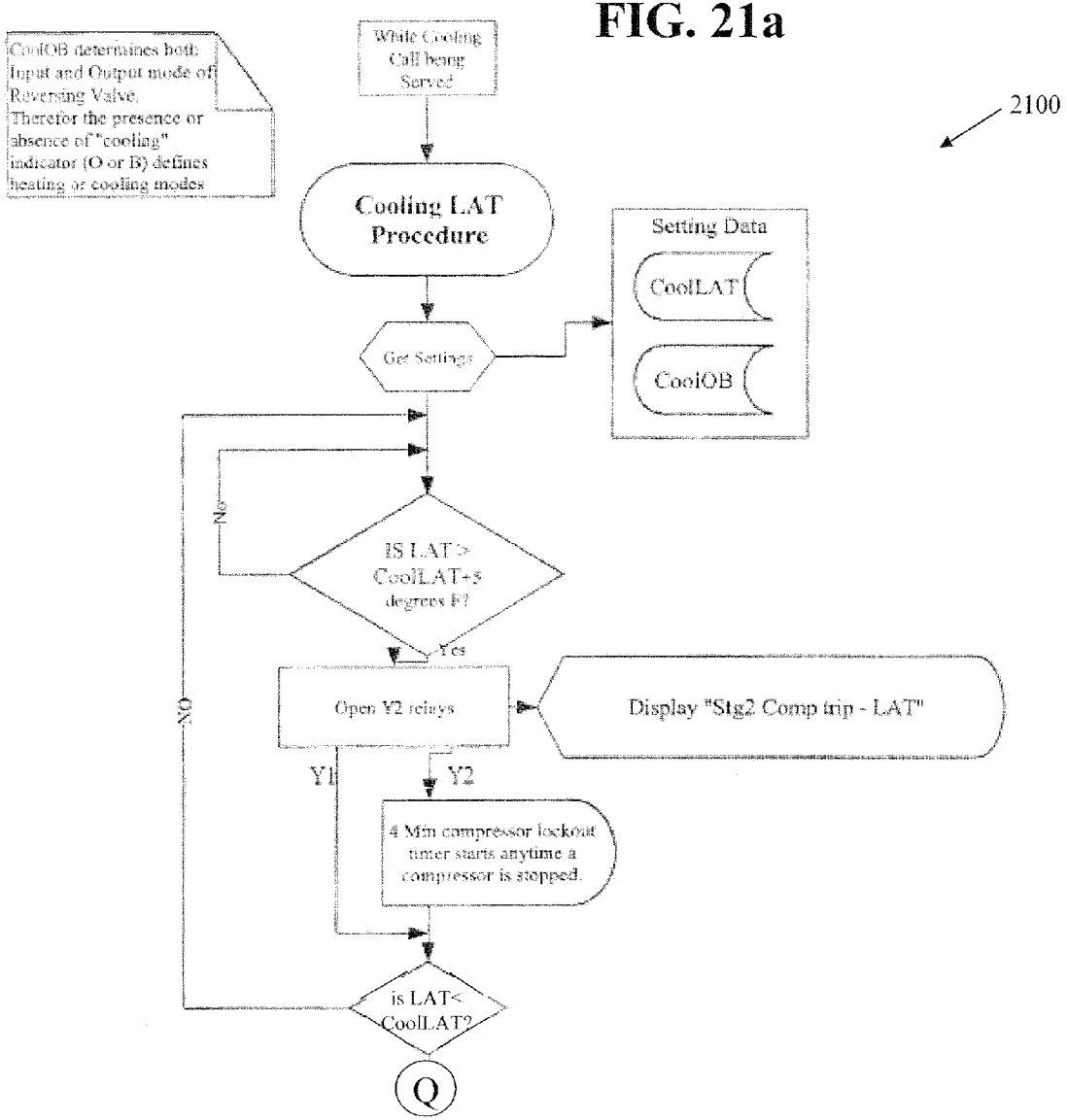
FIGS. 21*a*-21*b* illustrate a flowchart of an exemplary embodiment of a method for performing a cooling LAT procedure, in accordance with various aspects of the present invention.
Figure 21B:
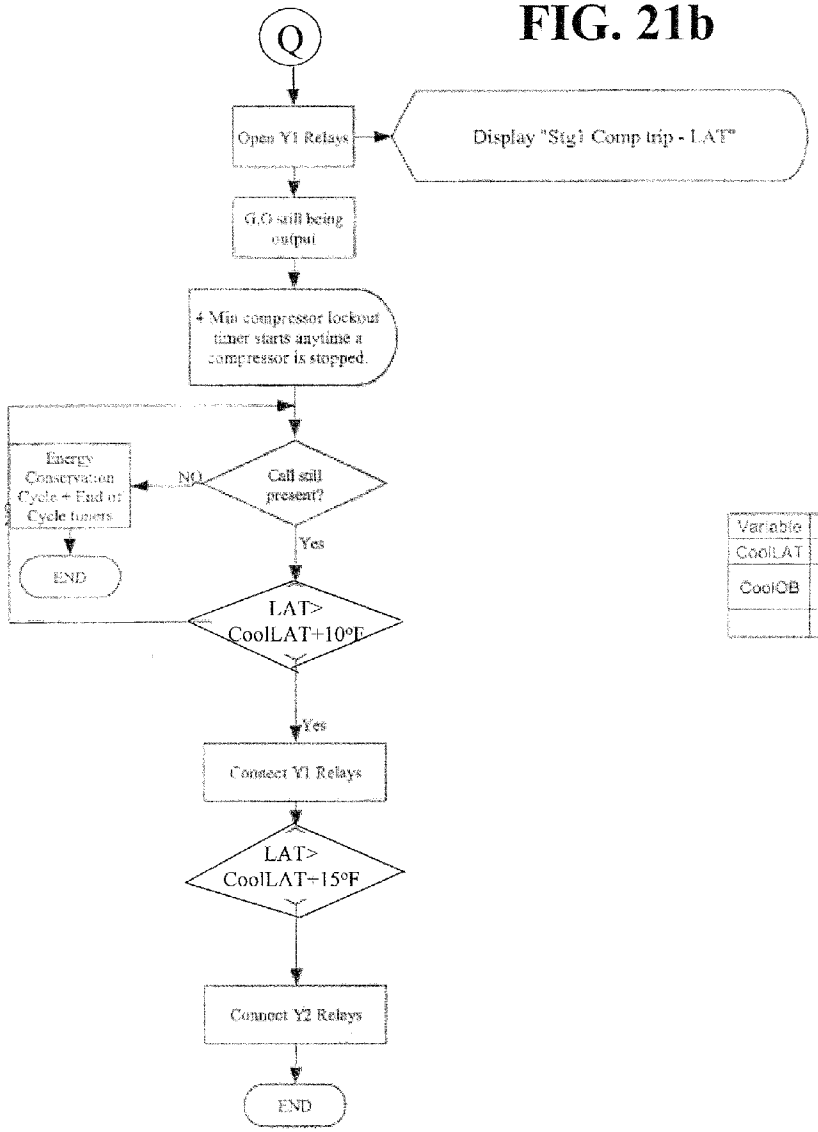

FIGS. 21*a*-21*b* illustrate a flowchart of an exemplary embodiment of a method 2100 for performing a cooling LAT procedure, in accordance with various aspects of the present invention. The method 2100 is a part of the cooling method 2000 of FIGS. 20*a*-20*b*. While in the cooling mode, if the LAT drops below the cooling LAT setting plus 5 degrees F., then the relays associated with the Y2(hp) second stage cooling signal to the condenser and the Y2(ah) second stage cooling signal to the furnace/air handler are opened. If the LAT drops below the cooling LAT setting, then the relays associated with the Y1(hp) first stage cooling signal to the condenser and the Y1(ah) first stage cooling signal to the furnace/air handler are opened.

Figure 22:
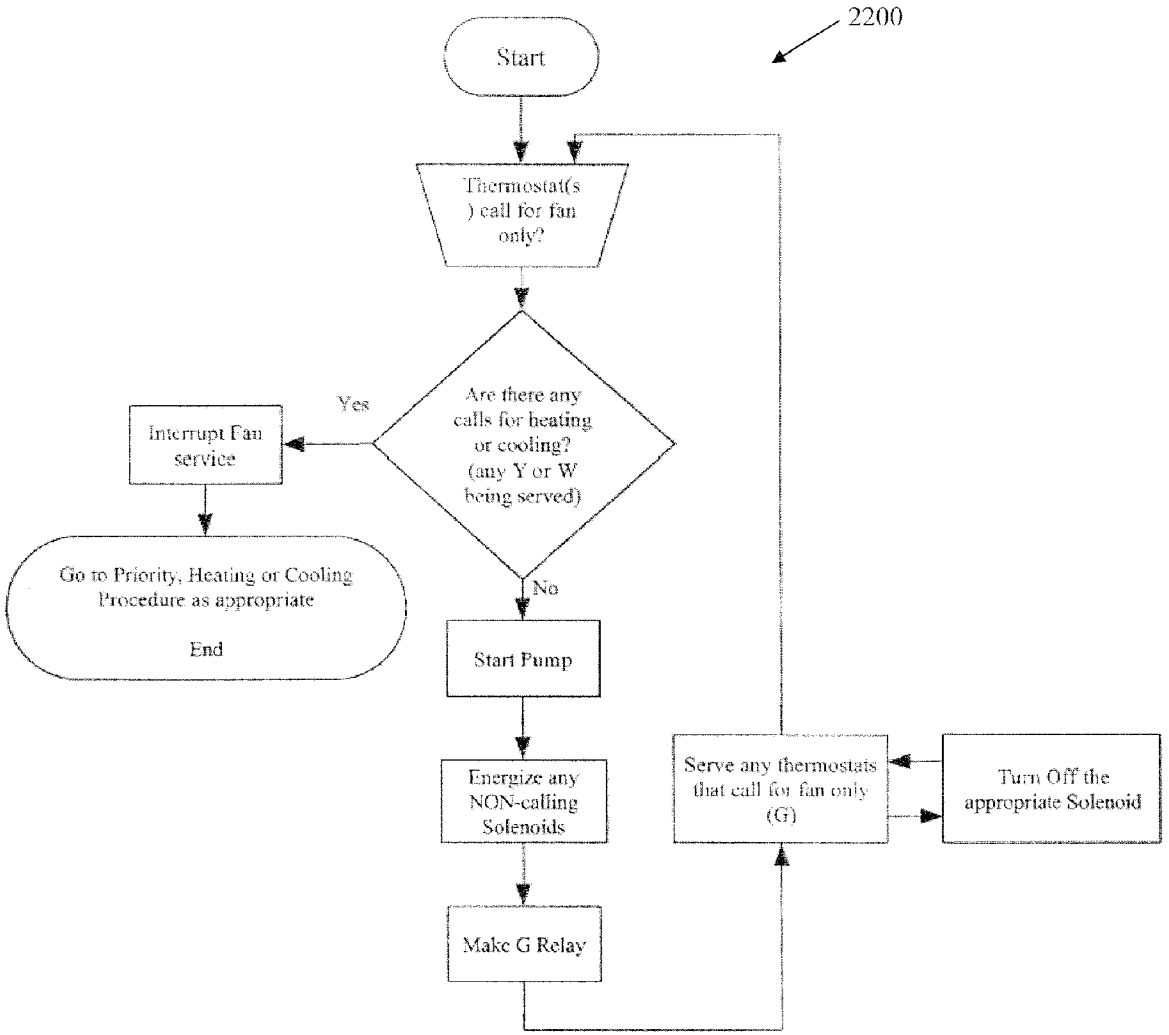
FIG. 22 illustrates a flowchart of an exemplary embodiment of a method for performing fan-only operations, in accordance with various aspects of the present invention.

FIG. 22 illustrates a flowchart of an exemplary embodiment of a method 2200 for performing fan-only operations, in accordance with various aspects of the present invention. In this method 2200, the fan is activated for blowing air to the appropriate calling zones. No heating or cooling is being performed.

Figure 23A:
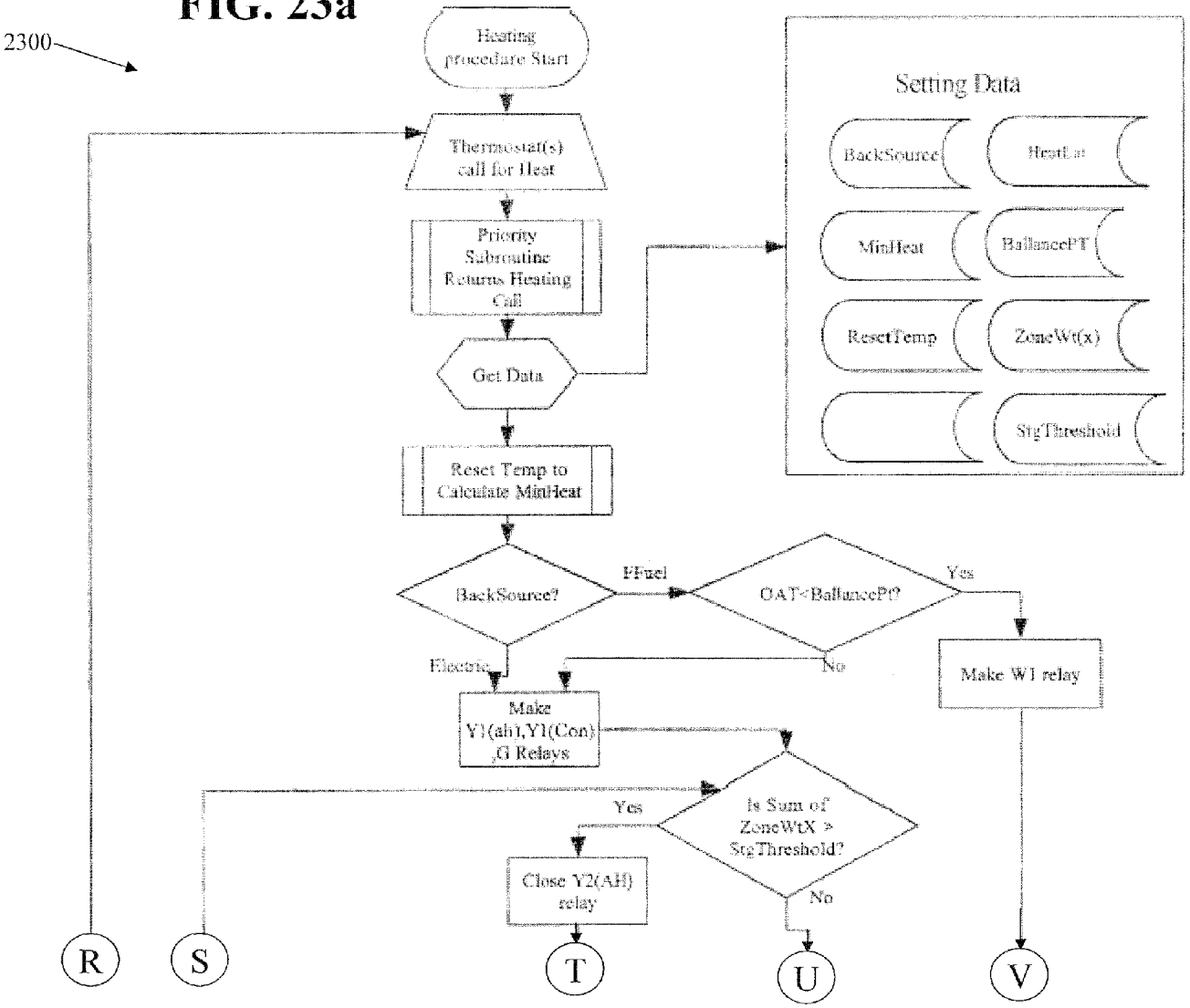
Figure 23B:
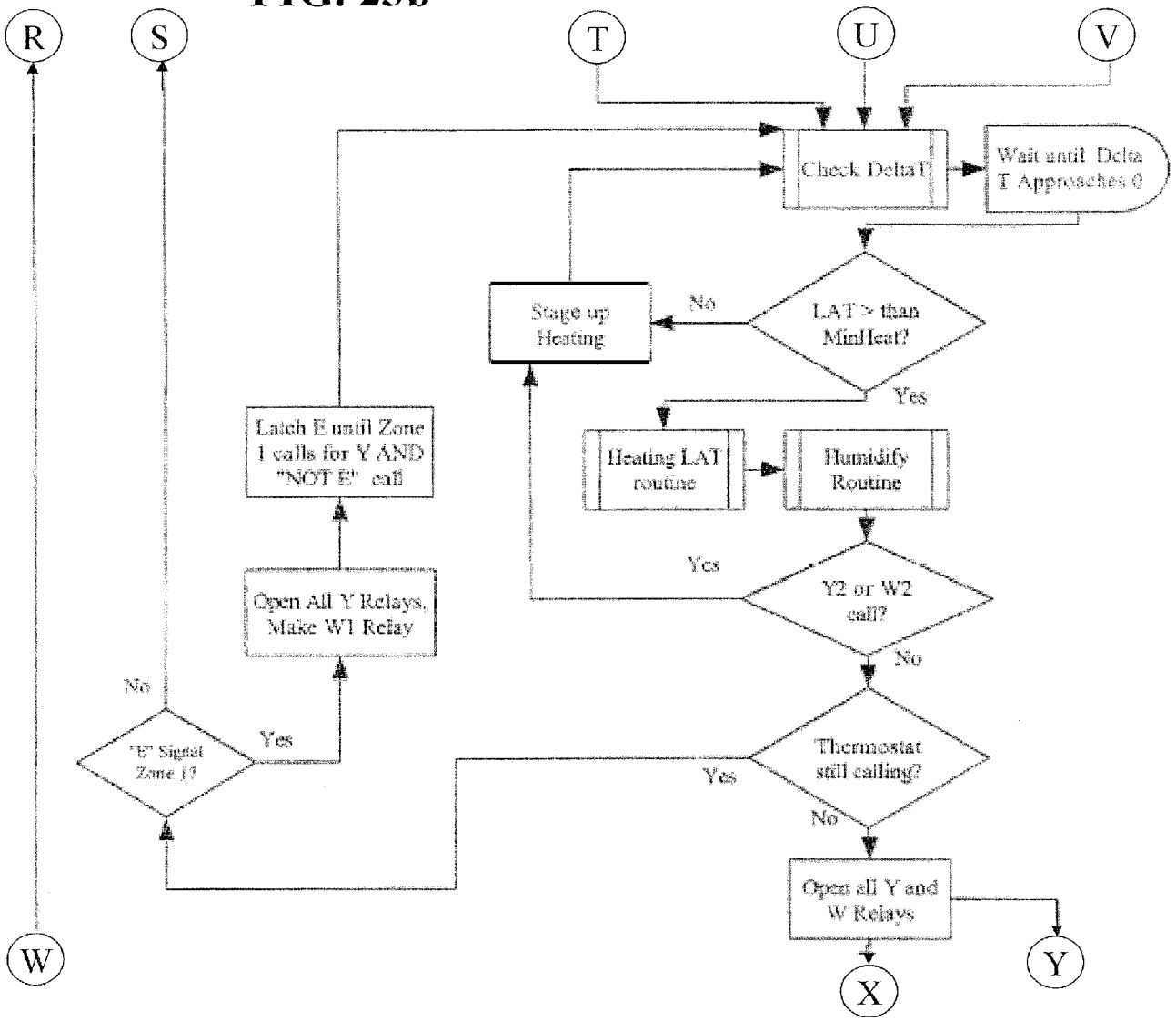

FIGS. 23*a*-23*c* illustrate a flowchart of an exemplary embodiment of a method 2300 for performing a heating procedure, in accordance with various aspects of the present invention. The method 2300 takes into account OAT, LAT, ΔT, zone service calls, the cumulative weighting value, and other parameters as part of providing heating to the calling zones in an efficient manner.

Figure 24A:
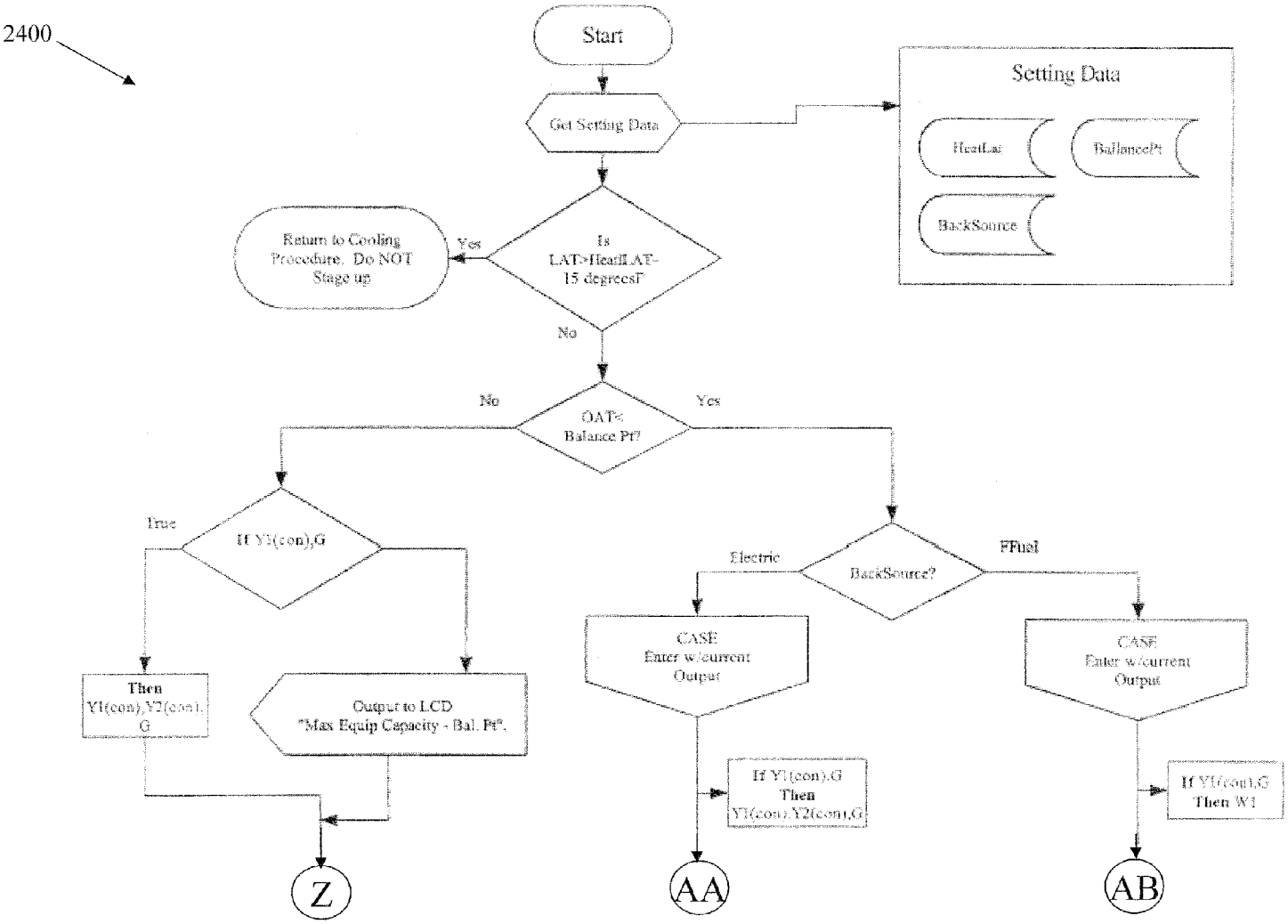
FIGS. 24*a*-24*b* illustrate a flowchart of an exemplary embodiment of a method for performing a heating stage-up procedure, in accordance with various aspects of the present invention.
Figure 24B:
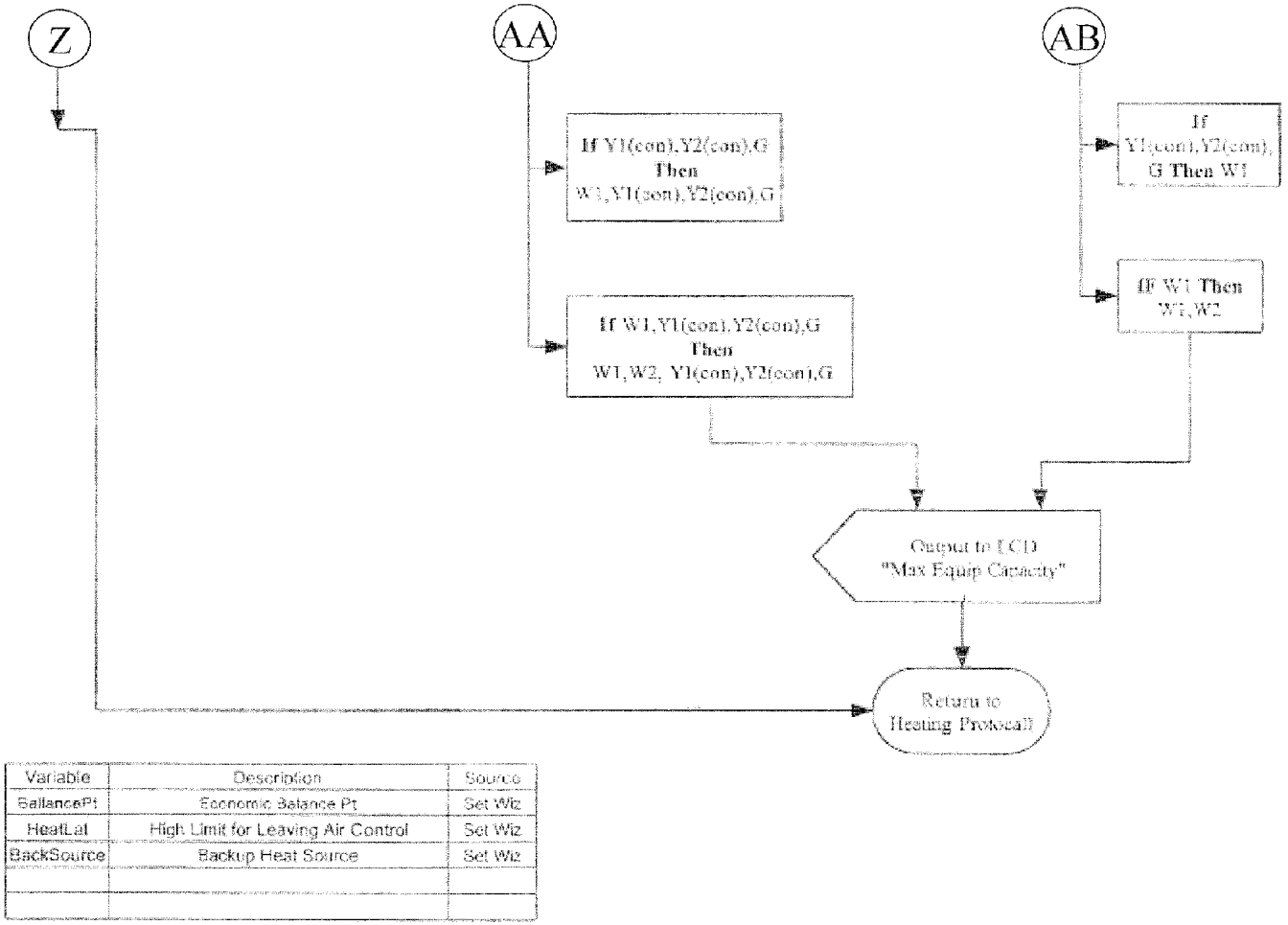

FIGS. 24*a*-24*b* illustrate a flowchart of an exemplary embodiment of a method 2400 for performing a heating stage-up procedure, in accordance with various aspects of the present invention. The method 2400 checks for current stage operation and compares LAT to a threshold value and OAT to a threshold value to determine whether or not to stage up during a heating cycle. The method 2400 is a part of the method 2300 of FIGS. 23*a*-23*c*.

In summary, a system and method to control environmental parameters of pre-defined zones within an environment using an electronic controller are disclosed. Weighting values are assigned, via the electronic controller, to each of the pre-defined zones and zone service calls are detected, via the electronic controller, from sensor devices associated with each of the zones. A cumulative zone weighting value is determined in response to the zone service calls and a staging combination is selected in response to at least the cumulative zone weighting value.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method to control environmental parameters of pre-defined zones within a first environment using a non-proprietary electronic controller, where each of said pre-defined zones has an associated duct work capacity, and where said non-proprietary electronic controller stores a weighting value for each of said pre-defined zones representative of said associated duct work capacity of each of said pre-defined zones, said method comprising:

said non-proprietary electronic controller detecting any zone service calls from sensor devices associated with each of said pre-defined zones;

said non-proprietary electronic controller transforming said detected zone service calls and said weighting value of each of said pre-defined zones associated with said detected zone service calls into a cumulative zone weighting value representative of a cumulative duct work capacity of said pre-defined zones associated with said detected zone service calls;

said non-proprietary electronic controller selecting an air handler stage from at least two possible air handler stages in response to at least said cumulative zone weighting value; and said non-proprietary electronic controller activating said selected air handler stage.

2. The method of claim 1 further comprising said non-proprietary electronic controller selecting an equipment staging combination from at least two possible equipment staging combinations in response to at least one of a leaving air temperature (LAT) from said air handler and an outside air temperature (OAT) of a second environment which is external to said first environment.

3. The method of claim 2 wherein each of said at least two possible equipment staging combinations includes a unique, pre-defined combination of heat pump and/or auxiliary equipment stages that may be activated by said electronic controller for servicing said zones.

4. The method of claim 3 further comprising said non-proprietary electronic controller activating said equipment stages defined by said selected staging combination.

5. The method of claim 3 wherein said selected equipment staging combination includes a first stage of a heat pump, and said selected air handler stage includes a first lower speed stage of an air handler.

6. The method of claim 3 wherein said selected equipment staging combination includes a first and a second stage of a heat pump.

7. The method of claim 3 wherein said selected equipment staging combination includes a first and a second stage of a heat pump, and said selected air handler stage includes a second higher speed stage of an air handler.

8. The method of claim 3 wherein said selected equipment staging combination includes a first and a second stage of a heat pump and a first stage of an auxiliary heat source, and said selected air handler stage includes a second higher speed stage of an air handler.

9. The method of claim 3 wherein said selected equipment staging combination includes a first and a second stage of a heat pump and a first and a second stage of an auxiliary heat source, and said selected air handler stage includes a second higher speed stage of an air handler.

10. The method of claim 2 wherein said selected equipment staging combination is selected also in response to types of said zone service calls.

11. The method of claim 10 wherein said types of said zone service calls may include any of a heating call, a cooling call, a humidification call, a de-humidification call, and a fan-only call.

12. The method of claim 2 further comprising said non-proprietary electronic controller selecting a new equipment staging combination from said at least two possible equipment staging combinations in response to at least one of a new zone service call, a change in said outside air temperature (OAT), and a change in said leaving air temperature (LAT).

13. The method of claim 12 further comprising said non-proprietary electronic controller activating equipment stages defined by said selected new equipment staging combination.

14. The method of claim 13 further comprising said non-proprietary electronic controller activating the opening of dampers associated with said new zone service call.

15. The method of claim 1 further comprising said non-proprietary electronic controller opening air dampers associated with said zone service calls.

16. The method of claim 1 wherein said environmental parameters include at least one of temperature, humidity, and air flow.

17. The method of claim 1 wherein said sensor devices associated with each of said pre-defined zones includes at least one of a thermostat, a humidistat, and a de-humidistat.

18. The method of claim 1 wherein said weighting value for each of said pre-defined zones is assigned also based on a floor-space area associated with each of said zones.

19. The method of claim 1 wherein said weighting value for each of said pre-defined zones is assigned also based on a spatial volume associated with each of said zones.

20. The method of claim 1 wherein said zone service calls may include any of a heating call, a cooling call, a humidification call, a de-humidification call, and a fan-only call for any number of said pre-defined zones.

21. The method of claim 1 wherein said pre-defined zones are pre-defined also based on separate spatial volumes within said environment.

22. The method of claim 1 wherein said pre-defined zones are pre-defined also based on a time of day.

23. The method of claim 1 further comprising said non-proprietary electronic controller selecting a different air handler stage in response to at least one of a new zone service call and a completion of service to a previous zone service call.

24. The method of claim 23 further comprising said non-proprietary electronic controller activating said selected different air handler stage.

25. The method of claim 24 further comprising said non-proprietary electronic controller activating the opening and/or closing of dampers associated with said new zone service call and/or said completion of service.

26. The method of claim 1 wherein said non-proprietary electronic controller supports a set of functions including all of resistance heat lock-out, outdoor reset, outdoor temperature balance point, selectable O/B outputs, and discharge temperature controls.

27. The method of claim 1 further comprising:

manually selecting an emergency heat mode using one of said sensor devices associated with a first zone of said pre-defined zones; and said non-proprietary electronic controller responding to said selecting of emergency heat by allowing emergency heat to be provided to all said zones.

28. The method of claim 1 further comprising said non-proprietary electronic controller automatically opening a humidifier damper, located between a humidifier on a forced air system and ductwork to the forced air system, in response to a humidification zone service call.

29. The method of claim 28 further comprising said non-proprietary electronic controller automatically closing said humidifier damper when servicing of said zone associated with said humidification zone service call is complete.

30. The method of claim 1 wherein one of said sensor devices associated with a first zone of said pre-defined zones comprises a complex heat pump thermostat.

31. The method of claim 1 wherein three of said sensor devices respectively associated with three zones of said pre-defined zones each comprise a simple heating/cooling thermostat.

32. A forced air system to control environmental parameters of pre-defined zones within a first environment, said system comprising:

an air handler providing at least two air handler stages; and a non-proprietary electronic controller, wherein said non-proprietary electronic controller is capable of (1) being used to assign a weighting value to each of said pre-defined zones within said environment based on at least duct work capacity for each said predefined zone;

(2) detecting any zone service calls originating from any of said pre-defined zones;

(3) determining a cumulative zone weighting value in response to said detected zone service calls; and (4) selecting an air handler stage from said at least two air handler stages in response to at least said cumulative zone weighting value.

33. The system of claim 32 wherein said air handler is operationally connected to said non-proprietary electronic controller such that said non-proprietary electronic controller is capable of activating said selected air handler stage in response to said selecting an air handler stage.

34. The system of claim 33 wherein said non-proprietary electronic controller is capable of selecting an equipment staging combination from at least two possible equipment staging combinations in response to at least one of a leaving air temperature (LAT) from said air handler and an outside air temperature (OAT) of a second environment which is external to said first environment.

35. The system of claim 34 further comprising a heat pump operationally connected to said non-proprietary electronic controller such that said non-proprietary electronic controller may activate at least one stage of said heat pump in response to said selected equipment staging combination.

36. The system of claim 34 further comprising at least one auxiliary heating source operationally connected to said non-proprietary electronic controller such that said non-proprietary electronic controller may activate at least one stage of said at least one auxiliary heating source in response to said selected equipment staging combination.

37. The system of claim 34 wherein each of said at least two possible equipment staging combinations includes a unique, pre-defined combination of heat pump and/or auxiliary equipment stages that may be activated by said non-proprietary electronic controller.

38. The system of claim 34 wherein said non-proprietary electronic controller is capable of activating said stages defined by said selected equipment staging combination.

39. The system of claim 34 wherein one of said at least two possible equipment staging combinations includes a first stage of a heat pump, a first stage of an air handler.

40. The system of claim 34 wherein one of said at least two possible equipment staging combinations includes a first and a second stage of a heat pump, and one of said at least two possible air handler stages includes a first stage of an air handler.

41. The system of claim 34 wherein one of said at least two possible equipment staging combinations includes a first and a second stage of a heat pump, and one of said at least two possible air handler stages includes a second stage of an air handler.

42. The system of claim 34 wherein one of said at least two possible equipment staging combinations includes a first and a second stage of a heat pump and a first stage of an auxiliary heat source, and one of said at least two possible air handler stages includes a second stage of an air handler.

43. The system of claim 34 wherein one of said at least two possible equipment staging combinations includes a first and a second stage of a heat pump and a first and a second stage of an auxiliary heat source, and one of said at least two possible air handler stages includes a second stage of an air handler.

44. The system of claim 34 wherein said selected equipment staging combination is selected by said electronic controller also in response to types of said zone service calls.

45. The system of claim 44 wherein said types of said zone service calls may include any of a heating call, a cooling call, a humidification call, a de-humidification call, and a fan-only call.

46. The system of claim 34 wherein said non-proprietary electronic controller is capable of selecting a new equipment staging combination from said at least two possible equipment staging combinations in response to at least one of a new zone service call, a change in said outside air temperature (OAT), and a change in said leaving air temperature (LAT).

47. The system of claim 46 wherein said non-proprietary electronic controller is capable of activating corresponding stages defined by said selected new equipment staging combination.

48. The system of claim 47 wherein said non-proprietary electronic controller is capable of activating dampers to be opened which are associated with said new zone service call.

49. The system of claim 34 further comprising an outside air temperature (OAT) sensor operationally connected to said non-proprietary electronic controller.

50. The system of claim 34 further comprising a leaving air temperature (LAT) sensor operationally connected to said non-proprietary electronic controller.

51. The system of claim 32 further comprising sensor devices being associated with each of said pre-defined zones and being operationally connected to said non-proprietary electronic controller such that there is at least one of said sensor devices for each pre-defined zone to sense a present status of at least one of said environmental parameters and to make said zone service calls to said non-proprietary electronic controller.

52. The system of claim 51 wherein said sensor devices associated with each of said pre-defined zones includes at least one of a thermostat, a humidistat, and a de-humidistat.

53. The system of claim 51 wherein one of said sensor devices is associated with a first zone of said pre-defined zones and comprises a complex heat pump thermostat.

54. The system of claim 51 wherein three of said sensor devices is respectively associated with three zones of said pre-defined zones and each comprise a simple heating/cooling thermostat.

55. The system of claim 32 further comprising at least one air pump device operationally connected to said non-proprietary electronic controller such that said non-proprietary electronic controller may activate said air pump device to service at least one of said zones in response to any said detected zone service calls.

56. The system of claim 55 further comprising at least one air damper operationally connected to said air pump device such that said air pump device may pump air to open said at least one air damper in response to an activation signal from said non-proprietary electronic controller.

57. The system of claim 56 wherein said non-proprietary electronic controller is capable of activating the opening of air dampers associated with said zone service calls.

58. The system of claim 55 further comprising a humidifier operationally connected to said forced air system and a humidifier damper located between said humidifier and ductwork of said forced air system.

59. The system of claim 58 wherein said humidifier damper is operationally connected to said air pump device and wherein said non-proprietary electronic controller is capable of automatically opening said humidifier damper in response to a humidification zone service call.

60. The system of claim 32 wherein said environmental parameters include at least one of temperature, humidity, and air flow.

61. The system of claim 32 wherein said weighting value for each of said pre-defined zones is assigned also based on at least a floor-space area associated with each of said zones.

62. The system of claim 32 wherein said weighting value for each of said pre-defined zones is assigned also based on at least a spatial volume associated with each of said zones.

63. The system of claim 32 wherein said zone service calls may include any of a heating call, a cooling call, a humidification call, a de-humidification call, and a fan-only call for any number of said pre-defined zones.

64. The system of claim 32 wherein said pre-defined zones are pre-defined based on at least separate spatial volumes within said first environment.

65. The system of claim 32 wherein said pre-defined zones are pre-defined based on at least a time of day.

66. The system of claim 32 wherein said non-proprietary electronic controller includes a display device to aid an operator in manually selecting setting options which are pre-programmed into said non-proprietary electronic controller.

67. The system of claim 66 wherein said manual selecting includes the steps of:

powering up said electronic controller;

displaying a first set of options on said display device;

selecting at least one of said options from said first set of options using at least one switching device on said non-proprietary electronic controller;

displaying a second set of options on said display device; and selecting at least one of said options from said second set of options using at least one switching device on said non-proprietary electronic controller.

68. The system of claim 67 wherein said manual selecting further includes the steps of:

displaying a third set of options on said display device; and selecting at least one of said options from said third set of options using at least one switching device on said non-proprietary electronic controller.

69. The system of claim 32 wherein said non-proprietary electronic controller includes a USB port for interfacing to a personal computer (PC) or a home automation device.

70. The system of claim 69 wherein said electronic controller is capable of storing a history of operational data which may be read out of said electronic controller to said personal computer (PC) via said USB port.

71. The system of claim 69 wherein said non-proprietary electronic controller is capable of having a set of default setting options reloaded from said personal computer (PC) into said non-proprietary electronic controller via said USB port.

72. The system of claim 32 wherein said non-proprietary electronic controller is capable of supporting a set of functions including all of resistance heat lock-out, outdoor reset, outdoor temperature balance point, selectable O/B outputs, and discharge temperature controls.

73. A non-proprietary electronic controller for use in a forced air system to control environmental parameters of pre-defined zones within a first environment, where each of said pre-defined zones has an associated duct work capacity, and where said non-proprietary electronic controller stores a weighting value for each of said pre-defined zones representative of said associated duct work capacity of each of said pre-defined zones, wherein said non-proprietary electronic controller is capable of:

(1) detecting any zone service calls originating from any of said pre-defined zones;

(2) transforming said detected zone service calls and said weighting value of each of said pre-defined zones associated with said detected zone service calls into a cumulative zone weighting value representative of a cumulative duct work capacity of said pre-defined zones associated with said detected zone service calls;

(3) selecting an air handler stage from at least two possible air handler stages in response to at least said cumulative zone weighting value; and (4) activating said selected air handler stage.

74. The non-proprietary electronic controller of claim 73 wherein said non-proprietary electronic controller is capable of selecting and activating an equipment staging combination from at least two possible equipment staging combinations in response to at least one of a leaving air temperature (LAT) from an air handler of said forced air system and an outside air temperature (OAT) of a second environment which is external to said first environment.

75. The non-proprietary electronic controller of claim 73 wherein said non-proprietary electronic controller is capable of supporting a set of functions including all of resistance heat lock-out, outdoor reset, outdoor temperature balance point, selectable O/B outputs, and discharge temperature controls.

76. The non-proprietary electronic controller of claim 73 wherein said non-proprietary electronic controller is capable of activating dampers of said forced air system in response to said zone service calls.

77. The non-proprietary electronic controller of claim 73 wherein said non-proprietary electronic controller is capable of staging heating and/or cooling equipment of said forced air system based on thermal capacity alone, and not just calls from said pre-defined zones.

78. The non-proprietary electronic controller of claim 73 wherein said non-proprietary electronic controller is capable of staging cooling and/or heating equipment of said forced air system on thermal capacity, based on at least a discharge temperature of air leaving an air handler of said forced air system.

79. The non-proprietary electronic controller of claim 77 wherein said non-proprietary electronic controller is capable of staging an air handler based on said cumulative zone weighting value, independent of said staging of said heating and/or cooling equipment of said forced air system.

80. The non-proprietary electronic controller of claim 73 wherein said non-proprietary electronic controller is capable of allowing emergency heat to be provided to all said zones when an emergency heat mode is selected.

81. The non-proprietary electronic controller of claim 73 wherein said zone service calls may include any of a heating call, a cooling call, a humidification call, a de-humidification call, and a fan-only call for any number of said pre-defined zones.

* * * * *